US007602340B2

(12) United States Patent
Sato

(10) Patent No.: US 7,602,340 B2
(45) Date of Patent: Oct. 13, 2009

(54) ANTENNA DEVICE AND WIRELESS TERMINAL USING THE ANTENNA DEVICE

(75) Inventor: Junji Sato, Tokyo (JP)

(73) Assignee: Panasonic Corporation, Osaka (JP)

( * ) Notice: Subject to any disclaimer, the term of this patent is extended or adjusted under 35 U.S.C. 154(b) by 411 days.

(21) Appl. No.: 11/574,894

(22) PCT Filed: Sep. 12, 2005

(86) PCT No.: PCT/JP2005/016735

§ 371 (c)(1),
(2), (4) Date: Mar. 8, 2007

(87) PCT Pub. No.: WO2006/038432

PCT Pub. Date: Apr. 13, 2006

(65) Prior Publication Data

US 2009/0046019 A1 Feb. 19, 2009

(30) Foreign Application Priority Data

Oct. 1, 2004 (JP) ..... 2004-290063
Oct. 1, 2004 (JP) ..... 2004-290143

(51) Int. Cl.
*H01Q 1/38* (2006.01)

(52) U.S. Cl. ..... 343/700 MS; 343/702; 343/833; 343/834

(58) Field of Classification Search ..... 343/700 MS, 343/702, 833, 834, 846
See application file for complete search history.

(56) References Cited

U.S. PATENT DOCUMENTS 6,211,830 B1 4/2001 Monma et al.
6,456,249 B1 * 9/2002 Johnson et al. ..... 343/702

(Continued)

FOREIGN PATENT DOCUMENTS

GB 2 351 848 A 1/2001

(Continued)

OTHER PUBLICATIONS

European Search Report.

*Primary Examiner*—Hoang V Nguyen
(74) *Attorney, Agent, or Firm*—Pearne & Gordon LLP

(57) ABSTRACT

The present invention aims at providing an antenna apparatus which enables switching directivity suitable for a plurality of usage patterns of a wireless terminal, such as that achieved during voice conversation and that achieved during data communication, and is easily slimmed down, as well as providing a wireless terminal using the antenna apparatus.

An antenna apparatus 1 of the present invention includes a linear radiating element 3 placed on a first plane; a first parasitic element 6 placed on the first plane in parallel with the radiating element 3; a first ground conductor 5 placed on the first plane; a first switch 7 which connects both ends of the first parasitic element 6 to the first ground conductor; and a second ground conductor 8 placed on a second plane opposing the first plane, wherein a part of the first ground conductor 5 is placed in parallel with the radiating element 3 and on a side opposite the first parasitic element 6 with the radiating element 3 sandwiched therebetween; and the second ground conductor 8 is placed opposite the radiating element 3, and ends of the second ground conductor 8 oppose an area sandwiched between the radiating element 3 and the first parasitic element 6.

20 Claims, 50 Drawing Sheets

U.S. PATENT DOCUMENTS

| | | | |
|---|---|---|---|
| 2001/0029173 | A1 | 10/2001 | Ogino |
| 2003/0193446 | A1 | 10/2003 | Chen |

FOREIGN PATENT DOCUMENTS

| | | | |
|---|---|---|---|
| JP | 54-127616 | A | 10/1979 |
| JP | 5-48506 | | 2/1993 |
| JP | 6-69723 | | 3/1994 |
| JP | 2001-292017 | | 10/2001 |
| JP | 2001-345633 | | 12/2001 |
| JP | 2004-363909 | | 12/2004 |
| JP | 2005-110231 | | 4/2005 |
| JP | 2005-253043 | | 9/2005 |
| WO | 99/65108 | A1 | 12/1999 |
| WO | 03/079561 | A2 | 9/2003 |

* cited by examiner

SIDE VIEW

TOP VIEW

SIDE VIEW

TOP VIEW

FIG. 16

| SWITCH 7 | SWITCH 18 | MAXIMUM RADIATION DIRECTION |
|---|---|---|
| SHORT-CIRCUITED | SHORT-CIRCUITED | DIRECTION +Z |
| SHORT-CIRCUITED | OPENED | DIRECTION −X |
| OPENED | SHORT-CIRCUITED | DIRECTION +X |
| OPENED | OPENED | DIRECTION +Z (OMNIDIRECTIONAL) |

SIDE VIEW

TOP VIEW

TOP VIEW

SIDE VIEW

FIG. 38

| SWITCH 7a | SWITCH 7b | MAXIMUM RADIATION DIRECTION |
|---|---|---|
| SHORT-CIRCUITED | SHORT-CIRCUITED | DIRECTION +Z |
| SHORT-CIRCUITED | OPENED | DIRECTION −X |
| OPENED | SHORT-CIRCUITED | DIRECTION +X |
| OPENED | OPENED | DIRECTION +Z (OMNIDIRECTIONAL) |

ANTENNA DEVICE AND WIRELESS TERMINAL USING THE ANTENNA DEVICE

FIELD OF THE INVENTION

The present invention relates to an antenna apparatus and a wireless terminal having the antenna apparatus built-in, and more particularly, to a wireless terminal having a built-in antenna having the function of electrically changing a directional characteristic.

BACKGROUND ART

Recently, in the field of a wireless terminal such as a cellular phone or the like, demand has grown for a data communications function in addition to a voice conversation function, and a wireless terminal having both the voice conversation function and the data communications function has become prevalent. In the case of a wireless terminal having both a voice conversation function and a data communications function, a positional relationship between the wireless terminal and a user who uses the wireless terminal changes between the case where voice conversation is performed and the case where data communication is performed.

For instance, in the case of voice conversation, the user uses a wireless terminal such that the terminal is pressed against one of the user's ears, as can be seen from FIG. 10, which shows an example positional relationship between the wireless terminal and the user which is adopted during voice conversation. Accordingly, the wireless terminal is used while being positioned on the side of the user's head. In contrast, in the case of data communication, the user ascertains information appearing on the display of the wireless terminal as can be seen from FIG. 11, which shows an example positional relationship between the wireless terminal and the user which is adopted during data communication. For this reason, the wireless terminal is used while being positioned at a distance from the front of the user's head.

As mentioned above, when the positional relationship between the wireless terminal and the user who uses the wireless terminal changes between the case of voice conversation and the case of data communication, the directional characteristic of the antenna apparatus built-in the wireless terminal is required to be changed to one appropriate to the positional relationship. FIG. 12 specifically shows an example radiation directivity of the antenna acquired during voice conversation and that acquired during data communication.

For instance, a unidirectional antenna is required to be configured so as to be able to switch directivity such that, when the wireless terminal is placed on the side of the head as in the case of voice communication, the maximum radiation direction of the antenna is toward the back of the wireless terminal; and such that, when the wireless terminal is placed at a position distant from the front of the user's head as in the case of data communication, the maximum radiation direction of the antenna toward the zenith direction of the wireless terminal. In short, the antenna apparatus built-in the wireless terminal is desired to be unidirectional and have a configuration which enables switching of the maximum radiation direction of the antenna achieved in the respective usage patterns; namely, during voice conversation and data communication, from the zenith of the wireless terminal to the back of the wireless terminal.

By means of the configuration of such an antenna apparatus, the orientation of a radiation field from the antenna apparatus to the human body is prevented, so that an SAR (Specific Absorption Rate) can be enhanced. Further, since electromagnetic radiation in an unnecessary direction is prevented to thus achieve unidirectivity, an attempt to enhance an antenna gain can be enabled.

For instance, an antenna configuration which switches the directivity of a Yagi antenna to and fro by means of controlling the length of a parasitic element through use of a control element has hitherto been proposed as an antenna configuration capable of switching the directivity of the antenna (see, e.g., Patent Document 1).

FIG. 46 is a schematic diagram of a related-art directivity switching antenna described in Patent Document 1. In FIG. 46, reference numeral 101 designates a pair of parasitic elements; 102 a feeder element; 103 an auxiliary element; and 104 a control element.

Operation of the related-art directivity switching antenna described in Patent Document 1 will be described hereinbelow. The parasitic elements 101 are placed, in a related-art directivity switching antenna, at given intervals from the feeder element 102 in the lateral direction thereof. Each of the parasitic elements 101 is configured so as to enable the control elements 104 to connect the auxiliary elements 103, which are additionally provided in an electrically-insulated manner, to the end portions of the parasitic element 101. The control element 104 is formed from a diode switch, or the like, and attached in such a way that the control element 104 is brought into conduction with one of the parasitic elements 101 and the auxiliary elements 103 provided at the respective ends thereof.

Consequently, when a positive voltage has been applied to the parasitic elements 101 via a lead wire, one of the parasitic elements 101 is brought into conduction with the auxiliary elements 103 provided at the respective ends thereof, to thus act as a reflector. The remaining parasitic element 101 is not brought into conduction with the auxiliary elements 103, to thus act as a director. Therefore, the antenna of Patent Document 1 exhibits directivity in the direction of the parasitic element 101 that remains out of conduction with the auxiliary elements 103. When a negative voltage has been applied to the parasitic elements 101 via the lead wire, the positional relationship between the parasitic element 101 operating as the reflector and the parasitic element 101 acting as a director is reversed, and hence directivity is also reversed.

By means of adoption of the above configuration, the Yagi antenna, which can reverse directivity through 180° by means of simple control; i.e., switching of the polarity of a voltage applied to the parasitic elements 101, can be configured.

There has also been proposed an antenna configuration where an antenna element is placed upright on a bottom board and parasitic elements are provided around the antenna element and which switches directivity by means of switching the function of the parasitic element between a director and a reflector (see, e.g., Patent Document 2).

FIG. 47 is a schematic view of a related-art directivity switching antenna described in Patent Document 2. In FIG. 47, reference numeral 111 designates a bottom board; 112 a radiating element; 113 to 116 parasitic elements; and 117 to 120 dielectric substrates.

Operation of the related-art directivity switching antenna described in Patent Document 2 will be described hereinbelow. The radiating element 112, which acts as a radiator, is placed on the bottom board 111 realized by the dielectric substrates 117 to 120. The parasitic elements 113 to 116, which act as reflectors or directors, are mounted on the dielectric substrates 117 to 120. The dielectric substrates 117 to 120 are placed upright on the bottom board 111.

The bottom board 111 is equipped with switching circuits for switching the functions of the parasitic elements 113 to 116 between reflectors and directors. One of the switching circuits is short-circuited to thus open the other switching circuits, thereby imparting directivity to the antenna. For instance, the switching circuits are selected in such a manner that the parasitic element 113 is caused to act as a conductor and such that the other parasitic elements 114 to 116 are caused to act as reflectors, whereby the directivity of the antenna can be oriented toward the parasitic element 113. Likewise, any one of the switching circuits of the parasitic elements 114 to 116 is short-circuited, to thus enable switching of directivity to any of four directions arranged at 90° intervals.

By means of the above configuration, there can be constituted an antenna which can switch directivity at intervals of 90° by means of simple control; i.e., inducing a short circuit to open the switching circuits. Further, the parasitic elements 113 to 116 are formed on the dielectric substrates 117 to 120. Hence, the dielectric constants of the dielectric substrates 117 to 120 are increased, so that the lengths of the parasitic elements 113 to 116 are reduced by means of the effect of a reduction in wavelength. Thus, an attempt to reduce the profile of the antenna can be enabled.

An other proposed configuration of the antenna apparatus capable of switching directivity thereof is, for example, to divide an earth metal conductor into two subdivisions and change the electrical length of the overall earth metal conductor by means of a switch, thereby switching directivity (see, e.g., Patent Document 3).

FIG. 48 is a schematic view of a related-art directivity switching antenna described in Patent Document 3. In FIG. 48, the directivity switching antenna comprises an antenna element 301; a matching circuit 302 for matching the antenna element 301 with a receiving circuit 303; a receiving field intensity comparator 304 for effecting comparison of intensity of a signal delivered from the receiving circuit 303; a control circuit 305 for activating and deactivating a high-frequency switch 308; earth metal conductors 306 and 307 divided into two sub-divisions which are connected in series to the antenna element 301 and correspond to the earth conductor of the antenna apparatus; and two high-frequency switches 308.

Operation of the related-art directivity switching antenna described in Patent Document 3 will now be described. An electromagnetic wave received by the antenna element 301 is delivered to the receiving circuit 303 by way of the matching circuit 302. Further, the control circuit 305 controls the high-frequency switch 308 such that the high-frequency switch repeats activation and deactivation at arbitrary time intervals. As shown in FIG. 49(*a*), when activated, the high-frequency switch 308 exhibits radiation directivity which is substantially perpendicular to the antenna element 301. As shown in FIG. 49(*b*), when deactivated, the high-frequency switch 308 exhibits a directivity characteristic having a radiation directivity characteristic of about −30° as compared with the case where the high-frequency switch 308 is activated.

By means of the above configuration, the lengths of the earth metal conductors 306, 307 serially connected to the antenna element 301 are electrically changed by the high-frequency switch 308, so that two types of antenna directivity characteristics can be obtained.

An other proposed antenna configuration is to place antenna reflectors at rear right and left positions with respect to the antenna element and to control ground impedance of the antenna reflectors, to thus switch directivity (see, e.g., Patent Document 4).

FIG. 50 is a schematic view of a related-art directivity switching antenna described in Patent Document 4. In FIG. 50, the directivity switching antenna comprises an antenna 311, an antenna element 312, antenna reflectors 313, 314 which are disposed at right and left positions with reference to the antenna element 312 and are each formed from a substantially triangular conductor plate, and a mold 315 for covering the antenna 311.

Operation of the related-art directivity switching antenna described in Patent Document 4 will now be described. The antenna reflectors 313, 314 are provided at lower right and left positions with reference to the antenna element 312 and connected to a ground impedance circuit for impedance variation purpose provided on a substrate of the wireless section. FIG. 51 is a characteristic view showing a change in the characteristic of the antenna acquired when switching between the antenna reflectors 313 and 314 is performed. Switching between the antenna reflectors 313, 314 is performed by means of grounding either of them.

Moreover, the directivity of the electromagnetic waves radiated from the antenna element 312 is switched by means of the antenna reflectors 313, 314 that are connected to the ground by way of the ground impedance circuit, to thus realize a diversity function. When switching between the antenna reflectors 313, 314 has been performed to thus select the antenna reflector 314 as a ground-side reflector, directivity of the antenna element 312 interferes with the antenna reflector 314 as shown in FIG. 51(*a*), to thus exhibit rightward directivity. Conversely, when the antenna reflector 313 has been selected, the directivity of the antenna element 312 interferes with the antenna reflector 313 as shown in FIG. 51(*b*), to thus exhibit leftward directivity.

By means of the above configuration, directivity can be switched leftward or rightward through 180° with respect to the antenna element 312 by means of a simple method for controlling the ground impedance circuit connected to the antenna reflectors 313, 314 to thus ground one of the antenna reflectors.

Patent Document 1: JP-A-6-69723
Patent Document 2: JP-A-2001-345633
Patent Document 3: JP-A-5-48506
Patent Document 4: JP-A-2001-292017

DISCLOSURE OF THE INVENTION

Problem to be Solved by the Invention

However, by use of the configuration such as that described in connection with Patent Document 1, conductor patterns can be formed on, e.g., the dielectric substrates 117 to 120. Hence, the antenna apparatus is suitable for being built in the wireless terminal. Since directivity can be switched to and fro merely by 180°, there has been a problem of difficulty in realizing directivity of an antenna apparatus suitable for the usage pattern of the wireless terminal achieved during voice conversation and that of the wireless terminal achieved during data communication.

By use of a configuration such as that described in connection with Patent Document 2, directivity of the antenna can be switched at intervals of 90° by means of switching of the switch. However, in order to effect switching between the zenith direction and the back direction of the wireless terminal, the bottom board 111 must be provided at right angles to the dielectric substrates 117 to 120 provided in the wireless terminal. Hence, difficulty is encountered in reducing the profile of the wireless terminal.

By use of a configuration such as that described in connection with Patent Document 3, the earth metal conductor can be formed from a conductor pattern on, e.g., the enclosure or the dielectric substrate, whereby the electrical length of the earth metal conductor can be readily changed to thus change directivity. However, the earth metal conductor must be connected in series to the antenna element. Hence, the configuration has the problem of being applicable solely to a monopole antenna element and being inapplicable to an antenna element of a dipole antenna balanced feeding system.

An antenna reflector is formed within an antenna enclosure by use of a configuration such as that described in connection with Patent Document 4, so that the antenna element can be incorporated into the wireless terminal. The antenna reflector can be applied, as an antenna element, to an antenna element of a balanced feeding system, such as a dipole. However, directivity can be switched rightward and leftward by merely 180°. Accordingly, there exists a problem of a failure to realize directivity of the antenna apparatus suitable for each of the usage patterns of the wireless terminal acquired during voice conversation and data communication.

The present invention has been conceived in light of the above situation and aims at providing an antenna apparatus capable of switching directivity suitable for a plurality of usage patterns of a wireless terminal, such as that achieved during voice conversation or that achieved during data communication, as well as providing a wireless terminal using the antenna apparatus.

Means for Solving the Problem

An antenna apparatus of the present invention comprises a linear radiating element placed on a first plane; a first parasitic element placed on the first plane in parallel to the radiating element; a first ground conductor placed on the first plane; a first switch which connects both ends of the first parasitic element to the first ground conductor; a second ground conductor placed on a second plane opposing the first plane; and control means for controlling short-circuiting/opening of the switch, wherein a part of the first ground conductor is placed in parallel to the radiating element and on a side opposite the first parasitic element with the radiating element sandwiched therebetween; and the second ground conductor is placed opposite the radiating element, and ends of the second ground conductor oppose an area sandwiched between the radiating element and the first parasitic element.

An antenna apparatus of the present invention comprises a linear radiating element placed on a first plane; a first linear parasitic element placed on the first plane in parallel to the radiating element; a linear auxiliary element provided at both ends of a longitudinal imaginary extension of the first parasitic element; a first ground conductor placed on the first plane; a first switch which connects both ends of the first parasitic element to the auxiliary element; and a second ground conductor placed on a second plane opposing the first plane, wherein the first ground conductor is placed in parallel to the radiating element and on a side opposite the first parasitic element with the radiating element sandwiched therebetween; and the second ground conductor is placed opposite the radiating element, and ends of the second ground conductor oppose an area sandwiched between the radiating element and the first parasitic element.

In the antenna apparatus of the present invention, the first ground conductor is a linear conductor which is longer than the radiating element.

An antenna apparatus of the present invention comprises a linear radiating element placed on a first plane; a first linear parasitic element placed on the first plane in parallel to the radiating element; a second linear parasitic element which is provided on the first plane opposite the first parasitic element with the radiating element interposed therebetween, and in parallel to the radiating element; a linear auxiliary element provided at both ends of longitudinal imaginary extensions of the respective first and second parasitic elements; a first switch and a second switch which connect both ends of the first and second parasitic elements to the auxiliary elements provided on both sides of the respective first and second parasitic elements; and a second ground conductor placed on a second plane opposing the first plane, wherein the second ground conductor is placed opposite the radiating element, and one end of the second ground conductor opposes an area sandwiched between the radiating element and the first parasitic element, and the other end of the second ground conductor opposes an area sandwiched between the radiating element and the second parasitic element.

The antenna apparatus of the present invention includes a first substrate having one surface on which the radiating element, the first and second parasitic elements, the first ground conductor, and the first and second switches are provided, and another surface on which the second ground conductor is provided.

The antenna apparatus of the present invention further comprises control means for controlling short-circuiting/opening of the switches.

When a usage pattern of the wireless terminal changes from voice conversation to data communication, a related-art antenna apparatus cannot change the maximum radiation direction of the antenna to a desired direction according to the usage pattern. Thus, the antenna configuration has not been suitable for the wireless terminal. According to the above configurations, on the other hand, when the switches are short-circuited, the parasitic element operates as a ground conductor, thereby covering the surroundings of the radiating element with the ground conductor. When the switches are opened, the parasitic element is disconnected from the ground conductor, and hence directivity of the antenna can be switched to a desired direction by means of short-circuiting/opening the switches.

The antenna apparatus of the present invention includes a configuration where, when the switches are opened, the parasitic element acts as a director with respect to the radiating element.

By means of this configuration, the parasitic element can be caused to act as a director. Hence, when the switches are opened, the configuration of a Yagi antenna can be formed from the radiating element and the parasitic element. Directivity of the antenna can be switched through about 90° while the switches remain short-circuited.

The antenna apparatus of the present invention includes a configuration where, when the switches are short-circuited, the parasitic element and the auxiliary element act as a reflector with respect to the radiant element.

By means of this configuration, the parasitic element can be switched between the director and the reflector by means of short-circuiting/opening of the switches. Hence, when the switches remain short-circuited, the directivity of the antenna can be switched through about 90° without connecting the parasitic element to the ground conductor.

The antenna apparatus of the present invention includes the parasitic element whose reactance is variable.

The antenna apparatus of the present invention includes the parasitic element that is formed from switches used for connecting together a plurality of conductor pieces.

The antenna apparatus of the present invention includes the parasitic element that is a variable capacity element.

According to the configurations, the electrical length of the parasitic element can be varied. Hence, the directivity of the antenna achieved during opening of the switches can be changed. Further, an input impedance characteristic of the antenna can also be adjusted.

The antenna apparatus of the present invention includes the substrate that is formed from a dielectric material.

By means of this configuration, the electrical length of the radiating element can be shortened by means of a wavelength-shortening effect induced by the dielectric constant of the dielectric substrate. Hence, an attempt can be made to miniaturize the antenna.

The antenna apparatus of the present invention includes the substrate that is formed from a foaming material.

By means of this configuration, the radiating element, the parasitic element, and the like are formed in such a manner that they can be subjected to sheeting. The thus-formed elements are fastened to the foaming material, whereby a directivity switching antenna can be manufactured in a very inexpensive manner.

The antenna apparatus of the present invention includes the radiating element that is folded in a horizontal direction with respect to the first substrate.

By means of this configuration, the input impedance of the radiating element can be enhanced. Even when the input impedance has become lower as a result of the ground conductor having been placed in the vicinity of the poles of the radiating element, matching to the feeding section can be effected readily.

The antenna apparatus of the present invention includes the radiating element that is formed on the first substrate from a conductor pattern.

By means of this configuration, the radiating element and the substrate can be integrally manufactured, and hence inexpensive manufacture can be carried out. Further, an attempt can also be made to achieve a more stable characteristic.

The antenna apparatus of the present invention includes the second ground conductor that is formed on the first substrate from a conductor pattern.

By means of this configuration, the second ground conductor and the substrate can be integrally manufactured, and hence the end portion of the second ground conductor can be accurately positioned, and the characteristics can be made stable.

The antenna apparatus of the present invention includes the radiating element and the second ground conductor, which are arranged such that an interval between the radiating element and the second ground conductor becomes greater than the thickness of the first substrate.

By means of this configuration, the distance between the radiating element and the second ground conductor can be ensured. Hence, occurrence of a drop in the input impedance of the radiating element can be prevented, and matching with the feeding section can be readily achieved.

In the antenna apparatus of the present invention, the radiating element has a dipole configuration having a structure folded in a vertical direction with respect to the substrate, and comprises a lower conductor placed on the first substrate and folded sections placed on both ends of the lower conductor in an upright position with respect to the first substrate, and an upper conductor disposed for connecting ends of the folded ends.

By means of this configuration, the radiating element can be arranged in a three-dimensionally folded manner. Accordingly, the degree of design freedom of the antenna is increased, and the area used for mounting the antenna can be reduced.

The antenna apparatus further comprises a second substrate provided on the first substrate, wherein the lower conductor is interposed between the first and second substrates; the folded section is provided so as to penetrate through the second substrate; and the upper substrate is provided on the second substrate.

By means of this configuration, a radiating element having a folded structure can be formed by means of rendering a substrate multilayer. Hence, the antenna apparatus can be manufactured more inexpensively, and the characteristic can be made more stable.

The antenna apparatus further comprises a dielectric block on the first substrate, wherein the lower conductor, the folded section, and the upper conductor are provided on and/or in the dielectric block.

In the antenna apparatus of the present invention, portions of the parasitic element, the switches, and the first ground conductor are provided on and/or in the dielectric block.

By means of this configuration, the radiating element and/or the parasitic element can be arranged in the dielectric block of a high dielectric material in a three-dimensionally-folded manner. Accordingly, the degree of design freedom of the antenna is increased, and the area used for mounting the antenna can be made very small. Moreover, a dielectric antenna having a directivity switching function can be manufactured.

In the antenna apparatus of the present invention, the radiating element can be formed into a linear dipole.

According to this configuration, the radiating element can be manufactured very simply. Moreover, the antenna can be formed into a Yagi antenna configuration along with the parasitic element. Hence, switching of directivity through 90° can be achieved.

In the antenna apparatus of the present invention, the radiating element is formed into a dipole having the shape of a meander line.

By means of this configuration, the radiating element can be made very small.

In the antenna apparatus of the present invention, the first and second switches are formed from diode switches.

In the antenna apparatus of the present invention, the first and second switches are formed from FET switches.

In the antenna apparatus of the present invention, the first and second switches are formed from MEMS switches.

By means of these configurations, the switches can be realized in a very simple configuration. Further, the switches can be made very compact by use of the MEMS technique. Hence, an attempt can be made to miniaturize the antenna.

An antenna apparatus of the present invention comprises a linear radiating element placed on a first plane; a ground conductor placed on a second plane opposite the other surface of the first substrate; a first conductor which is placed on the second plane while being electrically isolated from the ground conductor; and a first switch for connecting the ground conductor to the conductor, wherein one of the ground conductor and the conductor is placed opposite the radiating element.

The antenna apparatus of the present invention further comprises a second conductor placed at a position symmetrical to the first conductor with respect to the ground conductor; and a second switch for connecting the ground conductor to the second conductor, wherein the ground conductor is placed opposite the radiating element.

The antenna apparatus of the present invention further comprises a first substrate on which the first and second planes are provided.

The antenna apparatus of the present invention includes the ground conductor that is disposed opposite the radiating element.

The antenna apparatus of the present invention includes the conductor that acts as a director with respect to the radiating element.

The antenna apparatus of the present invention includes the conductor that is disposed opposite the radiating element.

The antenna apparatus of the present invention includes the conductor that is longer than the radiating element.

When a usage pattern of the wireless terminal changes from voice conversation to data communication, a related-art antenna apparatus cannot change the maximum radiation direction of the antenna to a desired direction through 90° according to the usage pattern. Thus, the antenna configuration has not been suitable for the wireless terminal. According to the above configurations, on the other hand, when the switches are short-circuited, the first metal conductor operates as a ground conductor. When the switches are opened, the first metal conductor is disconnected from the ground conductor, and hence directivity of the antenna can be switched to a desired direction by means of short-circuiting/opening the switches.

The antenna apparatus of the present invention includes that conductor whose reactance is variable.

The antenna apparatus of the present invention includes that conductor has a variable capacitance element.

In the antenna apparatus of the present invention, the conductor includes a plurality of conductor pieces divided into a lengthwise direction thereof and a third switch for connecting the plurality of conductor pieces.

By means of these configurations, the electrical length of the first metal conductor can be varied. Accordingly, when the switches are opened, the directivity of the antenna can be adjusted. Further, the input impedance characteristic of the antenna can also be adjusted.

In the antenna apparatus of the present invention, the conductor comprises a plurality of conductor pieces divided into a widthwise direction thereof, and a third switch for connecting the plurality of conductor pieces.

By means of these configurations, the widthwise electrical length of the first metal conductor can be varied. Accordingly, when the switches are opened, the directivity of the antenna can be adjusted.

The antenna apparatus of the present invention includes the first substrate that is formed from a dielectric material.

By means of this configuration, the electrical length of the radiating element can be shortened by means of a wavelength shortening effect induced by the dielectric constant of the dielectric substrate. Hence, an attempt can be made to miniaturize the antenna.

The antenna apparatus of the present invention includes the first substrate that is formed from a foaming material.

By means of this configuration, the first metal conductor, and the like, is formed in such a manner that it can be subjected to sheeting. The thus-formed first metal conductor is fastened to the foaming material, whereby a directivity switching antenna can be manufactured in a very inexpensive manner.

In the antenna apparatus of the present invention, the first switch comprises a plurality of switches used for connecting the ground conductor to the first metal conductor at a plurality of locations.

In the antenna apparatus of the present invention, the plurality of third switches are provided in a symmetrical pattern with respect to a plane perpendicular to the radiating element including a feeding point thereof.

In the antenna apparatus of the present invention, the third switches are provided in an asymmetrical pattern with respect to a plane perpendicular to the radiating element including a feeding point thereof.

In the antenna apparatus of the present invention, the third switches connect the ground conductor to the first metal conductor located at the position opposite a neighborhood of the maximum voltage position on the radiating element.

These configurations eliminate a necessity for connecting the entire ground conductor to the entire first metal conductor. Directivity can be switched by use of the minimum required switches. Moreover, the switches are short-circuited at positions which are asymmetrical with respect to the lengthwise direction of the radiating element, whereby three-dimensional switching of directivity becomes feasible.

The antenna apparatus of the present invention includes the radiating element that is formed on the first substrate from a conductor pattern.

By means of this configuration, the radiating element and the substrate can be integrally manufactured, and hence inexpensive manufacture can be carried out. Further, an attempt can also be made to achieve a more stable characteristic.

The antenna apparatus of the present invention includes the ground conductor that is formed on the first substrate from a conductor pattern.

By means of this configuration, the ground conductor and the substrate can be integrally manufactured, and hence inexpensive manufacture can be carried out. Further, an attempt can also be made to achieve a more stable characteristic.

The antenna apparatus of the present invention includes the radiating element and the ground conductor that are arranged such that an interval between the radiating element and the second ground conductor becomes greater than the thickness of the first substrate.

By means of this configuration, the distance between the radiating element and the ground conductor can be ensured. Hence, occurrence of a drop in the input impedance of the radiating element can be prevented, and matching with the feeding section can be readily achieved.

The antenna apparatus of the present invention includes the radiating element that is folded in a horizontal direction with respect to the first substrate.

By means of this configuration, the input impedance of the radiating element can be enhanced. Even when the input impedance has become lower as a result of the ground conductor having been placed in the vicinity of the poles of the radiating element, matching to the feeding section can be effected readily.

In the antenna apparatus of the present invention, the radiating element has a dipole configuration having a structure folded in a vertical direction with respect to the substrate, and the radiating element comprises a lower conductor placed on the first substrate, folded sections placed on both ends of the lower conductor in an upright position with respect to the first substrate, and an upper conductor disposed for connecting ends of the folded ends.

By means of this configuration, the radiating element can be arranged in a three-dimensionally folded manner. Accordingly, the degree of design freedom of the antenna is increased, and the area used for mounting the antenna can be reduced.

The antenna apparatus further comprises a second substrate provided on the first substrate, wherein the lower conductor is interposed between the first and second substrates, the folded section is provided so as to penetrate through the second substrate, and the upper substrate is provided on the second substrate.

By means of this configuration, a radiating element having a folded structure can be formed by means of providing a substrate with a multilayer structure. Hence, the antenna apparatus can be manufactured more inexpensively, and the characteristic can be made more stable.

The antenna apparatus further comprises a dielectric block on the first substrate, wherein the lower conductor, the folded section, and the upper conductor are provided on and/or in the dielectric block.

By means of this configuration, the radiating element and/or the parasitic element can be arranged in the dielectric block of a high dielectric material in a three-dimensionally-folded manner. Accordingly, the degree of design freedom of the antenna is increased, and the area used for mounting the antenna can be made very small. Moreover, a dielectric antenna having a directivity switching function can be manufactured.

In the antenna apparatus of the present invention, the radiating element can be formed into a linear dipole.

According to this configuration, the radiating element can be manufactured very simply.

In the antenna apparatus of the present invention, the radiating element is formed into a dipole having the shape of a meander line.

By means of this configuration, the radiating element can be made very small.

In the antenna apparatus of the present invention, the first and second switches are formed from diode switches.

In the antenna apparatus of the present invention, the first and second switches are formed from FET switches.

In the antenna apparatus of the present invention, the first and second switches are formed from MEMS switches.

By means of these configurations, the switches can be realized in a very simple configuration. Further, the switches can be made very compact by use of the MEMS technique. Hence, an attempt can be made to miniaturize the antenna.

A wireless terminal of the present invention comprises the antenna apparatus of the present invention; a transceiving section for transceiving a radio wave by means of the antenna apparatus; an antenna directivity switching section for switching directivity of the antenna apparatus; and a control section for controlling individual sections, wherein the control section controls the antenna directivity switching section and the transceiving section such that the antenna apparatus, whose directivity has been determined to exhibit superior receiving sensitivity on the basis of the intensity of a detected radio wave, performs transmission and receipt by causing the antenna directivity switching section to switch directivity of the antenna apparatus and causing the transceiving section to receive a radio wave.

In the wireless terminal of the present invention, the control section performs control operation for causing the antenna apparatus to perform diversity receiving operation in a receiving state and causing the antenna apparatus, in a transmission state, to perform transmission with the directivity used in a receiving state.

By means of this configuration, diversity receipt can be performed by means of switching the directivity of a single antenna even in a multipath environment. Hence, high-quality communication can be carried out.

In the wireless terminal of the present invention, the control section performs control operation for causing the antenna apparatus to perform diversity receiving operation in a receiving state and causing the antenna apparatus, in a transmission state, to perform transmission with directivity at which a maximum radiation direction of the antenna apparatus is oriented in a direction opposite a direction from the wireless terminal toward a user of the wireless terminal.

By means of this configuration, diversity receipt can be performed by means of switching the directivity of a single antenna even in a multipath environment. Hence, high-quality communication can be carried out. Incidentally, during transmission, the directivity of the antenna is not oriented toward the user who uses the wireless terminal. Accordingly, SAR can be enhanced.

ADVANTAGES OF THE INVENTION

According to the antenna apparatus of the present invention and the wireless terminal using the antenna apparatus, the directivity of the antenna can be switched between a backward direction and a zenith direction by means of short-circuiting and opening switches. Even when the usage pattern of the wireless terminal changes as in the case of voice communication and data transmission, the directivity of the antenna is changed optimally for the usage pattern, whereby high-quality communication can be carried out.

BRIEF DESCRIPTION OF THE DRAWINGS

FIG. 16 is a view showing a relationship between switching operation of a switch and directivity of an antenna, which pertains to the third embodiment of the present invention.

FIG. 38 is a view showing a relationship between switching operation of a switch and directivity of an antenna, which pertain to the eighth embodiment of the present invention.

DESCRIPTIONS OF THE REFERENCE NUMERALS

1 DIRECTIVITY SWITCHING ANTENNA
2 DIELECTRIC SUBSTRATE
3 RADIATING ELEMENT
4 FEEDING POINT
5 FIRST GROUND CONDUCTOR
6 PARASITIC ELEMENT
7 SWITCH
8 SECOND GROUND CONDUCTOR
9 END PORTION
10 CONTROL CIRCUIT
11 USER
12 WIRELESS TERMINAL
13 DISPLAY SECTION
14 OPERATION SECTION
15 AUXILIARY ELEMENT
16 REFLECTOR
17 PARASITIC ELEMENT
18 SWITCH
19 END PORTION
20 RADIATING ELEMENT
21 LOWER CONDUCTOR
22 FOLDED SECTION
23 UPPER CONDUCTOR
24 DIELECTRIC SUBSTRATE
25 DIELECTRIC BLOCK
26 TRANSCEIVING SECTION
27 CONTROL SECTION
28 ANTENNA DIRECTIVITY SWITCHING SECTION
29, 30 CONTROL SIGNALS
101 PARASITIC ELEMENT
102 FEEDING ELEMENT
103 AUXILIARY ELEMENT
104 CONTROL ELEMENT
111 BOTTOM BOARD
112 ANTENNA ELEMENT
113 TO 116 PARASITIC ELEMENTS
117 TO 120 DIELECTRIC SUBSTRATES
201 DIRECTIVITY SWITCHING ANTENNA
202 DIELECTRIC SUBSTRATE
203 RADIATING ELEMENT
204 FEEDING POINT
205 GROUND CONDUCTOR
206 FIRST METAL CONDUCTOR
207*a, b* SWITCHES
208 END PORTION
209 CONTROL CIRCUIT
210 USER
211 WIRELESS TERMINAL
212 DISPLAY SECTION
213 OPERATION SECTION
214 CONDUCTOR PIECE
215 DIODE SWITCH
216 RADIATING ELEMENT
217 LOWER CONDUCTOR
218 FOLDED SECTION
219 UPPER CONDUCTOR
220 DIELECTRIC SUBSTRATE
221 DIELECTRIC BLOCK
222 TRANSCEIVING SECTION
223 CONTROL SECTION
224 ANTENNA DIRECTIVITY SWITCHING SECTION
225, 226 CONTROL SIGNALS
227 SECOND METAL CONDUCTOR
301 ANTENNA ELEMENT
302 MATCHING CIRCUIT
303 RECEIVING CIRCUIT
304 RECEIVING ELECTRIC FIELD INTENSITY COMPARATOR
305 CONTROL CIRCUIT
306, 307 EARTH METAL CONDUCTORS
308 HIGH-FREQUENCY SWITCH
311 ANTENNA
312 ANTENNA ELEMENT
313, 314 ANTENNA REFLECTORS
315 MOLD

BEST MODES FOR IMPLEMENTING THE INVENTION

Antenna apparatuses of embodiments of the present invention and wireless terminals using them will be described in detail hereunder by reference to the drawings.

FIRST EMBODIMENT

Figure 1:
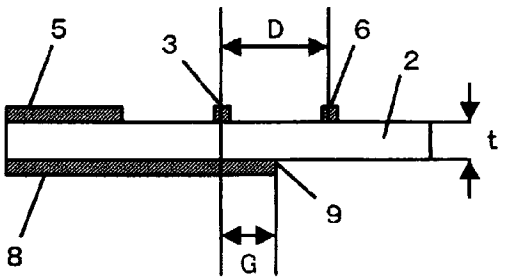
FIGS. 1(*a*) and (*b*) shows a schematic view of a directivity switching antenna according to a first embodiment of the present invention.
Figure 1:
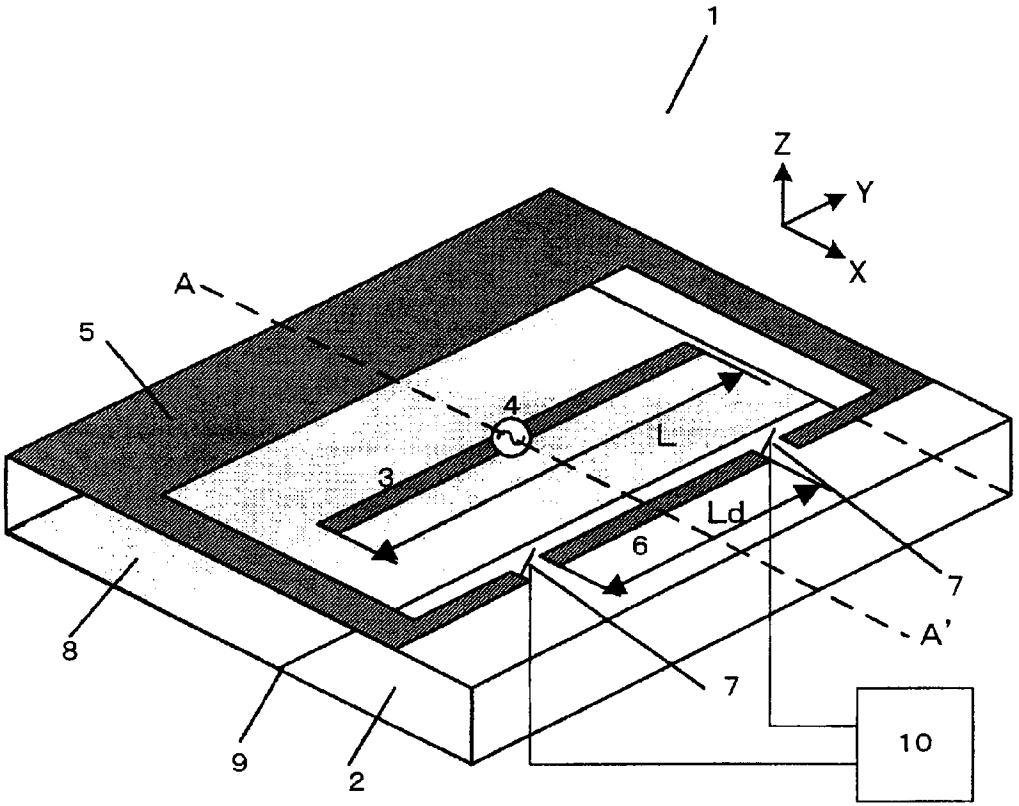

FIG. 1 is a schematic view of a directivity switching antenna according to a first embodiment of the present invention. FIG. 1(*a*) is a perspective view, and FIG. 1(*b*) is a cross-sectional profile taken along line A-A' shown in FIG. 1(*a*).

A directivity switching antenna apparatus 1 comprises a dielectric substrate 2 of thickness "t"; a radiating element 3 which is formed from a linear conductor provided on the dielectric substrate 2 and has a length of L; a feeding point 4; a first ground conductor 5 provided on the dielectric substrate 2 in plane with the radiating element 3; a parasitic element 6 of length Ld(<L) which is provided on the dielectric substrate in plane with the radiating element 3 and substantially parallel to the radiating element 3; switches 7 interposed between the first ground conductor 5 and the parasitic element 6; a second ground conductor 8 provided on a surface of the dielectric substrate 2 opposite to the surface thereof where the radiating element 3 is provided; an end portion 9 of the second ground conductor 8; and a control circuit 10 for controlling a short-circuit and opening of the switches 7.

Descriptions will now be provided on the assumption that the radiating element 3, the first ground conductor 5, the parasitic element 6, and the second ground conductor 8 are formed on the dielectric substrate 2 from a conductor pattern. Forming these elements on the dielectric substrate 2 leads to the advantage of the ability to miniaturize the antenna apparatus by virtue of shortening a wavelength by means of changing a dielectric constant and the advantage of the antenna apparatus becoming inexpensive, easily mass-produced, and stable in terms of an antenna characteristic.

Figure 2:
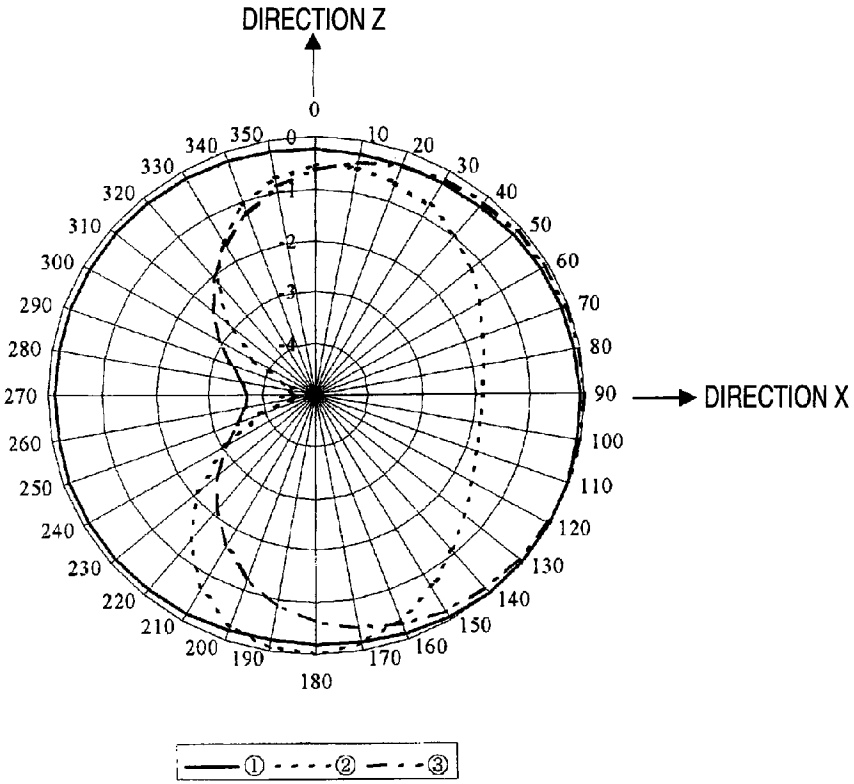
FIGS. 2(*a*) and (*b*) shows the principle of operation for switching directivity of the directivity switching antenna according to the first embodiment of the present invention.
Figure 2:
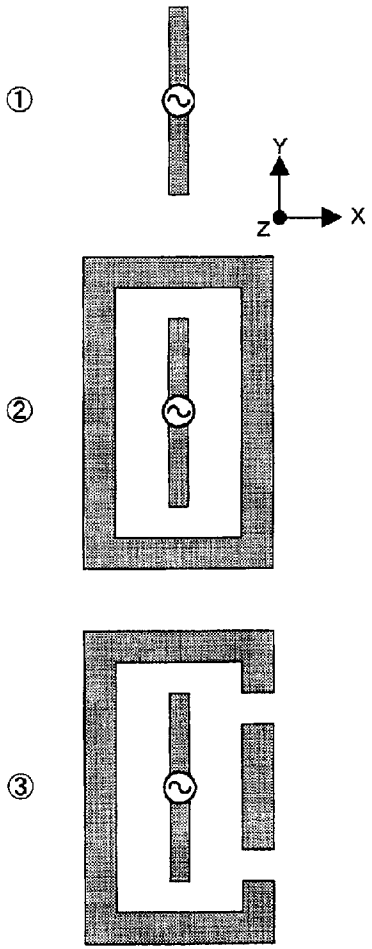

Operation of the directivity switching antenna apparatus according to the first embodiment of the present invention will now be described. A high-frequency signal fed from the feeding point 4 is radiated in the air from the radiating element 3. In the present embodiment, the radiating element 3 is described as having the configuration of a dipole. FIG. 2 shows the principle of directivity switching operation of the present invention. The directivity of the antenna becomes omnidirectional within a plane XZ as shown in (1) of FIG. 2(*b*) when a ground conductor is not disposed around the radiating element 3 as shown in (1) of FIG. 2(*a*).

The first ground conductor 5 and the parasitic element 6 are provided in plane with the radiating element 3. The switches 7 are short-circuited by means of a control signal output from the control circuit 10, to thus bring the first ground conductor 5 and the parasitic element 6 into electrical conduction with each other. Namely, the radiating element 3 is enclosed by the ground conductor as shown in (2) of FIG. 2(*a*). As shown in (2) of FIG. 2(*b*), the antenna exhibits directivity where the maximum radiation arises in directions ±Z. Further, when the switches 7 are opened by the control signal output from the control circuit 10; namely, when a portion surrounding the radiating element 3 is separated from the ground conductor as shown in (3) of FIG. 2(*a*), the parasitic element 6 acts as a director. As shown in (3) of FIG. 2(*b*), the antenna becomes unidirectional and exhibits the maximum radiation in a direction +X. Namely, the directivity of the antenna can be switched through about 90° by means of short-circuiting or opening the switches 7.

As shown in (2) of FIG. 2(*a*), according to the above configuration, however, when the switches 7 remain short-circuited, the antenna becomes bi-directional and exhibits the maximum radiation in directions ±Z. When only the conductor pattern of (2) is placed on the dielectric substrate 2 of the wireless terminal, a radiation field also arises in the direction −Z toward the human body (i.e., the direction opposite the back), which in turn invokes deterioration of SAR. Accordingly, as shown in FIG. 1, the second ground conductor 8 is provided on the surface of the dielectric substrate 2 opposite the radiating element 3. In a state where the switches 7 remain short-circuited, a radiation field in the direction −Z toward the human body is blocked, to thus realize unidirectivity in the direction +Z. Influence of the arrangement of the second ground conductor 8 on switching of directivity of the antenna will be described in detail.

In FIG. 1(*b*), an interval between the radiating element 3 and the parasitic element 6 in the direction of the X axis is taken as D. An interval between the radiating element 3 and the end portion 9 of the second ground conductor 8 in the direction of the X axis is taken as G. At this time, as can be seen from the cross-sectional profile of the directivity switching antenna of the first embodiment of the present invention shown in FIG. 3(*a*), which is obtained at G=D, when the interval G is made equal to or slightly longer than the interval D, substantially equal directivity is achieved when the switches 7 are short-circuited or opened.

Figure 3:
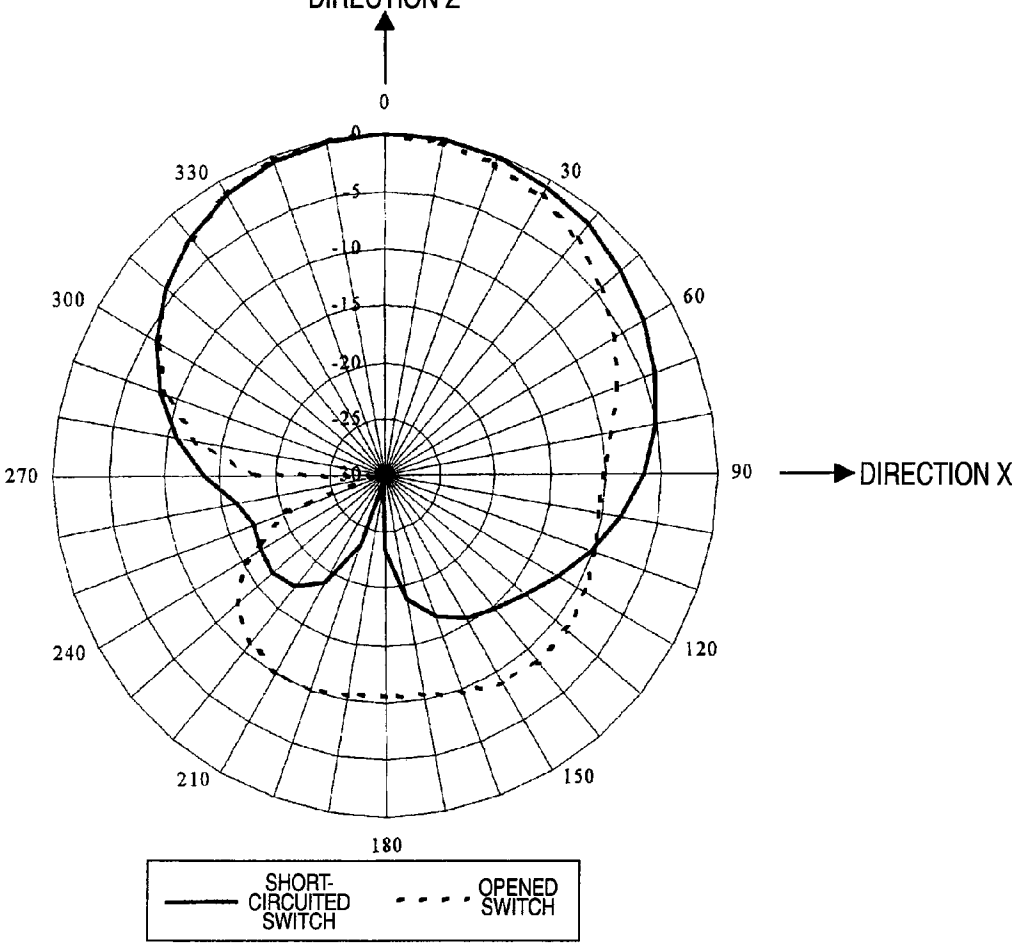
FIG. 3(*a*) is a cross-sectional profile of the directivity switching antenna according to the first embodiment of the present invention achieved when G=D; and (b) Directivity of the directivity switching antenna according to the first embodiment of the present invention acquired when the switch is switched at G=D.
Figure 3:
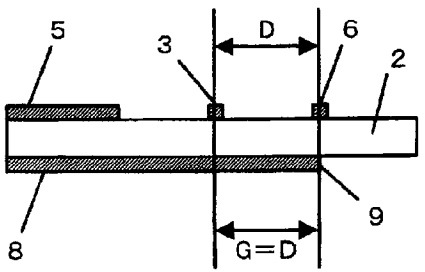

FIG. 3(*b*) shows directivity of the directivity switching antenna of the first embodiment of the present invention, which is achieved when the switch is switched at G=D. By reference to FIG. 3(*b*), it is ascertained that the directivity of the antenna has not yet been switched by toggling actions of the switches 7. This shows that, as a result of the second ground conductor 8 being provided beneath the parasitic element 6, the parasitic element 6 does not operate as a director.

Figure 4:
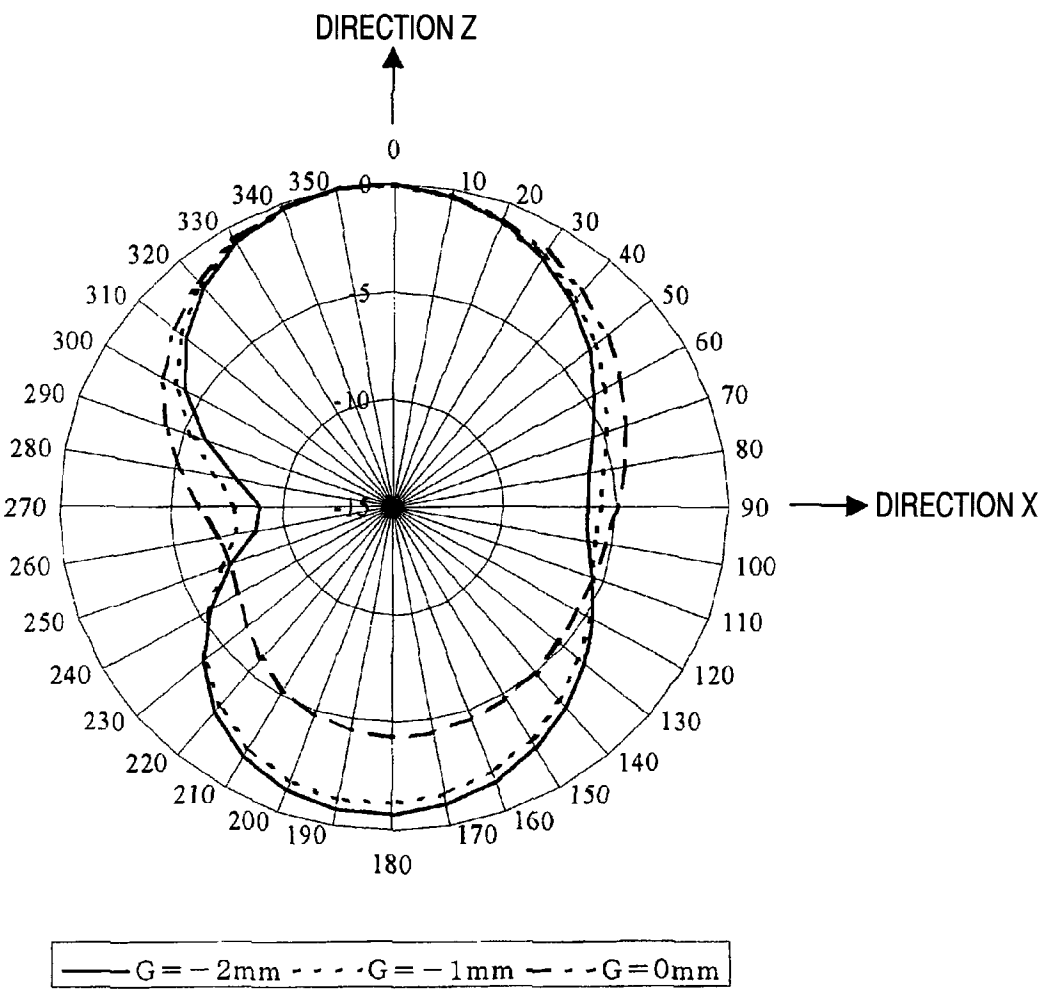
FIG. 4(*a*) is a cross-sectional profile of the directivity switching antenna according to the first embodiment of the present invention achieved when G≦0; and (b) Directivity of the directivity switching antenna according to the first embodiment of the present invention acquired when the switch is short-circuited at G≦0.
Figure 4:
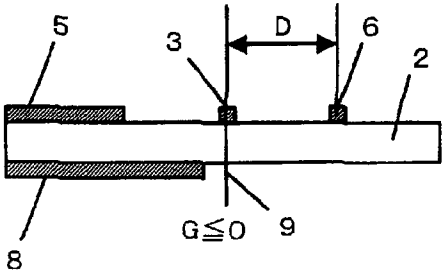

As in the case of the cross-sectional profile of the directivity switching antenna apparatus of the first embodiment of the present invention shown in FIG. 4(*a*), which is acquired at G≦0, when the interval G assumes a negative value, the second ground conductor 8 is not present beneath the radiating element 3. Hence, in the state where the switches 7 remain short-circuited, an electromagnetic wave is intensely radiated in the direction −Z, as well. FIG. 4(*b*) is a view showing directivity of the directivity switching antenna of the first embodiment of the present invention acquired when the switch is short-circuited at G≦0, and showing directivity achieved when the switches 7 are short-circuited when the interval G is −2 mm, −1 mm, and 0 mm, respectively. From FIG. 4(*b*), when the interval G assumes a value of −2 mm and a value of −1 mm, an electromagnetic wave having substantially the same intensity as that of the electromagnetic wave emitted in the direction +Z is understood to be radiated in the direction −Z, as well. When the interval G is 0 mm, the radiation field emitted in the direction −Z is understood to be suppressed by about 5 dB as compared with the radiation field emitted in the direction +Z.

Figure 5:
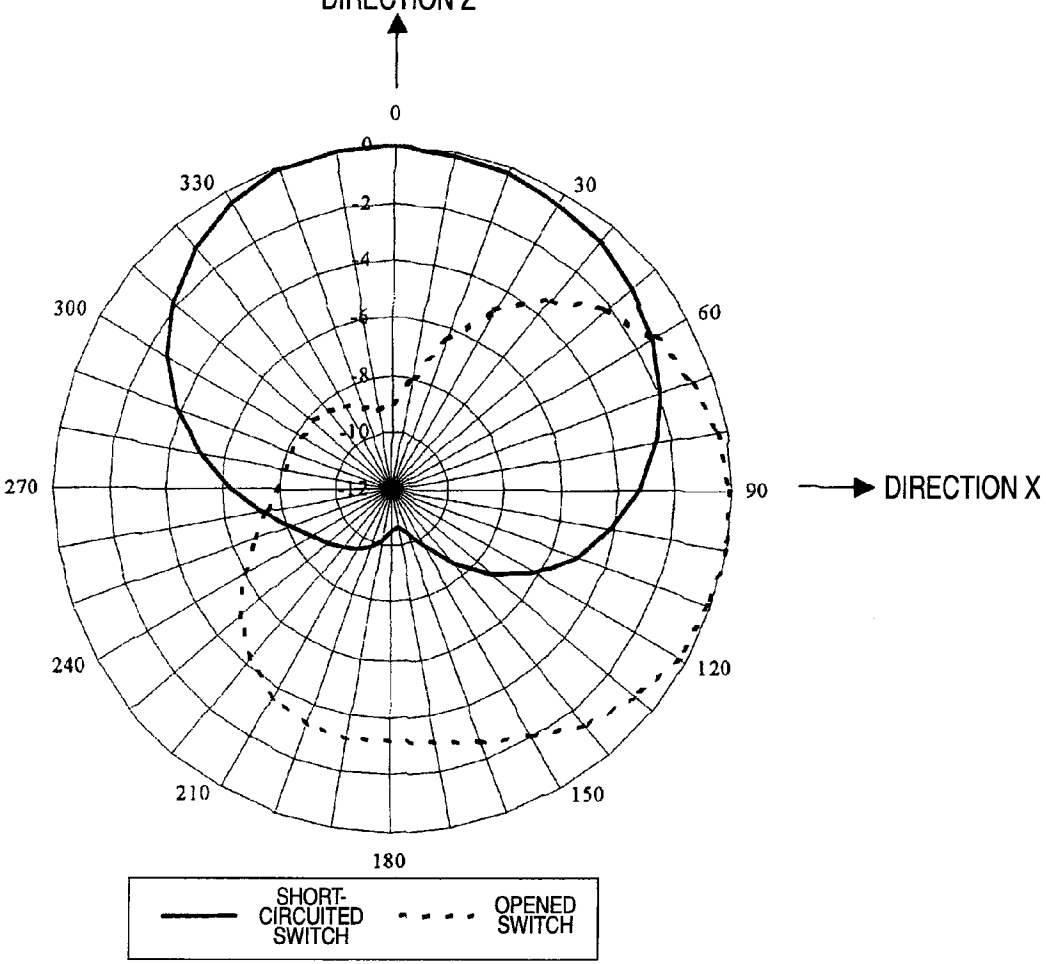
FIG. 5(*a*) is a cross-sectional profile of the directivity switching antenna according to the first embodiment of the present invention achieved when G=D/4; and (b) Directivity of the directivity switching antenna according to the first embodiment of the present invention acquired when the switch is switched at G=D/4.
Figure 5:
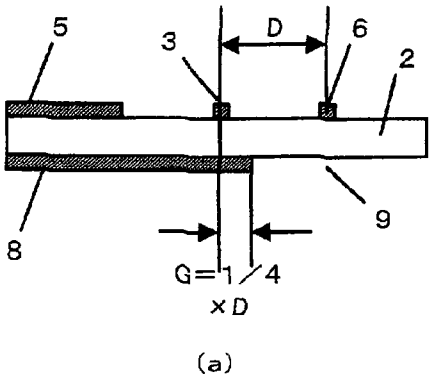

As in the case of the cross-sectional profile of the directivity switching antenna apparatus of the first embodiment of the present invention shown in FIG. 5(*a*), which is acquired at G=D/4, the end portion 9 of the second ground conductor 8 is arranged so as to come between the radiating element 3 and the parasitic element 6 in the direction of the X axis; namely, the interval G satisfies the relational expression of 0≦G<D, thereby toggling the switches 7, to thus implement desired directivity switching operation. By way of an example, FIG. 5(*b*) shows directivity acquired at a frequency F when the switches 7 are short-circuited and opened, on condition that the radiating element 3 having a length L=0.7λ is disposed on the dielectric substrate 2 having a dielectric constant of 3.8 and a thickness "t" of 0.03λ; that the parasitic element 6 having a length of Ld=0.6λ is placed at a position spaced from the radiating element 3 by a distance D=0.13λ; and that the interval G between the radiating element 3 and the end portion 9 of the second ground conductor 8 in the direction of the X axis assumes D/4. From FIG. 5(*b*), the directivity of the antenna is understood to have been changed through about 90° by means of switching actions of the switches 7.

In order to cause the parasitic element 6 to operate as a director, the interval D between the radiating element 3 and the parasitic element 6 is preferably increased to a value of about 0.25λ. However, the antenna size becomes greater as a result of the interval D being increased. Hence, directivity can be switched without increasing the interval D to a value of about 0.25λ, as in the case of the present embodiment. The length of the parasitic element 6 is adjusted so as to act as a director when the switches 7 are opened. However, for instance, so long as the parasitic element 6 is configured so that its length can be varied, directivity can also be varied by means of adjusting a reactance component of the director. A method for varying the length of the parasitic element 6 may comprise dividing the parasitic element 6 into a plurality of conductor pieces, placing the switches 7 among the conductor pieces, and varying the length of the parasitic element 6 by means of short-circuiting/opening the switches 7, or may comprise adding a variable capacity element, such as a varactor diode, to the parasitic element 6 to thus electrically adjust the length of the parasitic element in accordance with a control voltage.

Figure 6:
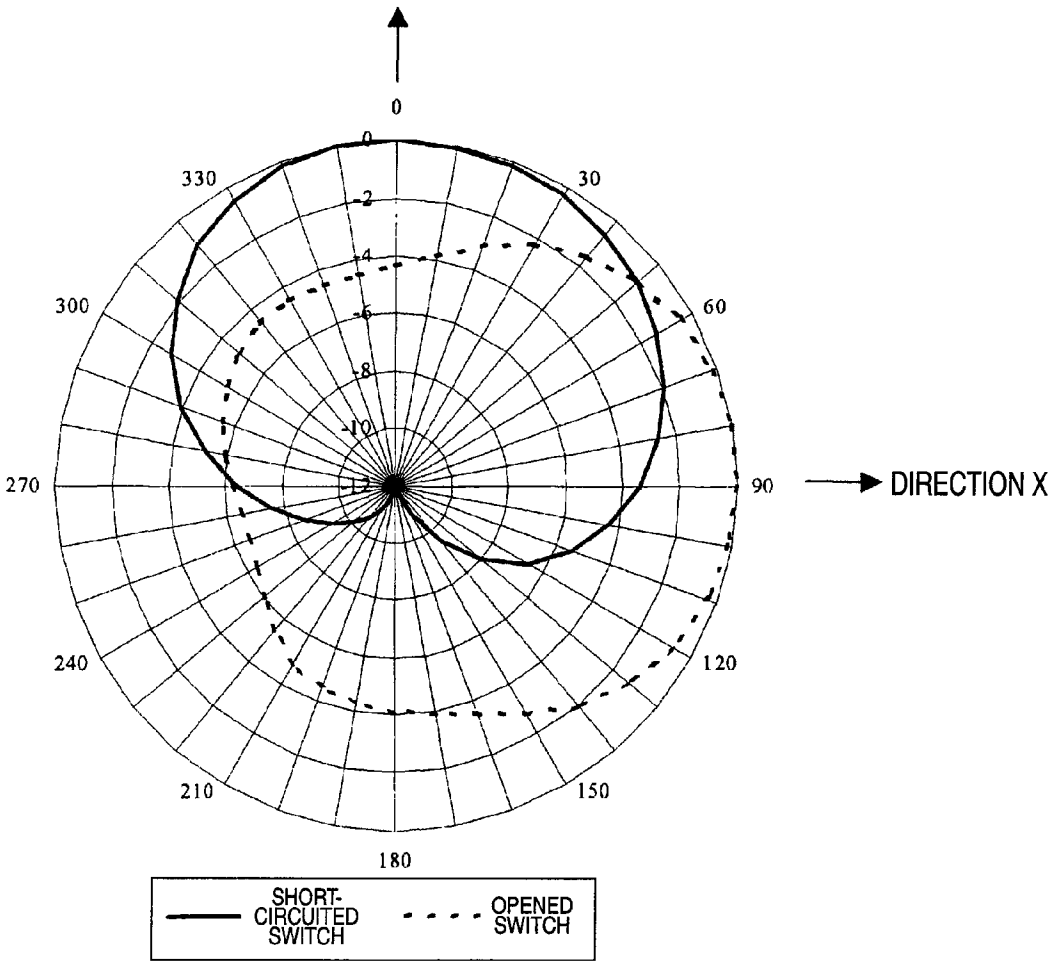
FIG. 6(*a*) is a cross-sectional profile of the directivity switching antenna according to the first embodiment of the present invention achieved when G=D/2; and (b) Directivity of the directivity switching antenna according to the first embodiment of the present invention acquired when the switch is switched at G=D/2.
Figure 6:
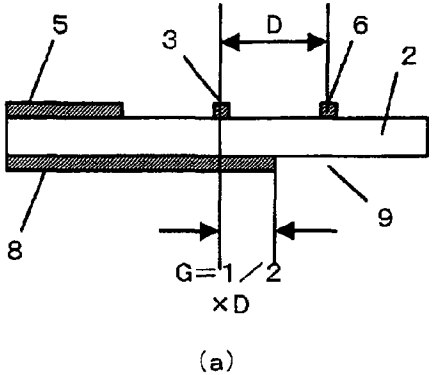
Figure 7:
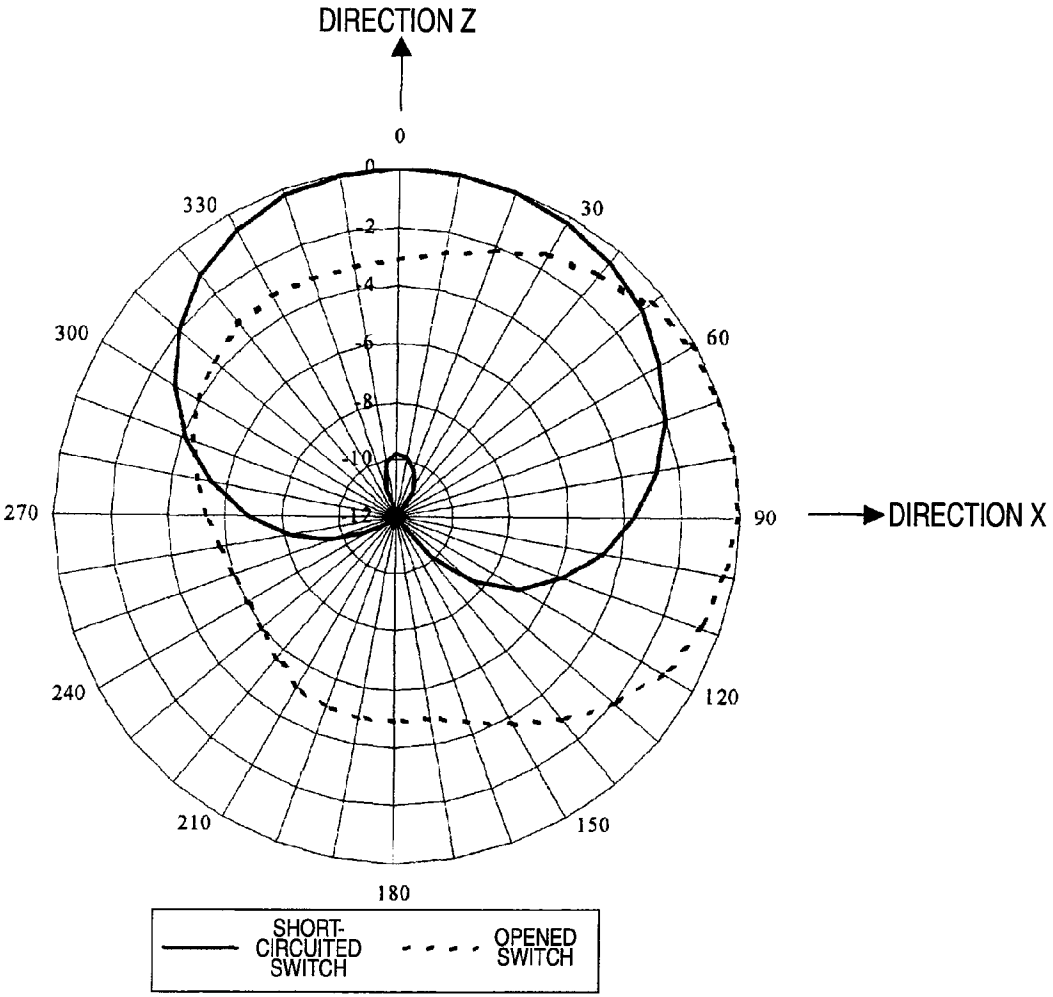
FIG. 7(*a*) is a cross-sectional profile of the directivity switching antenna according to the first embodiment of the present invention achieved when G=3/4×D; and (b) Directivity of the directivity switching antenna according to the first embodiment of the present invention acquired when the switch is switched at G=3/4×D.
Figure 7:
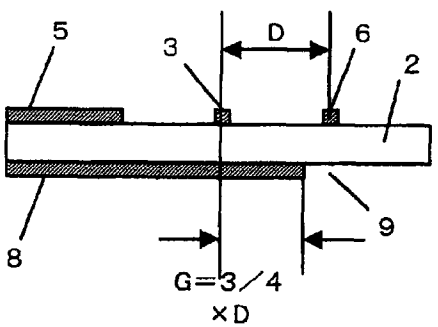
Figure 8:
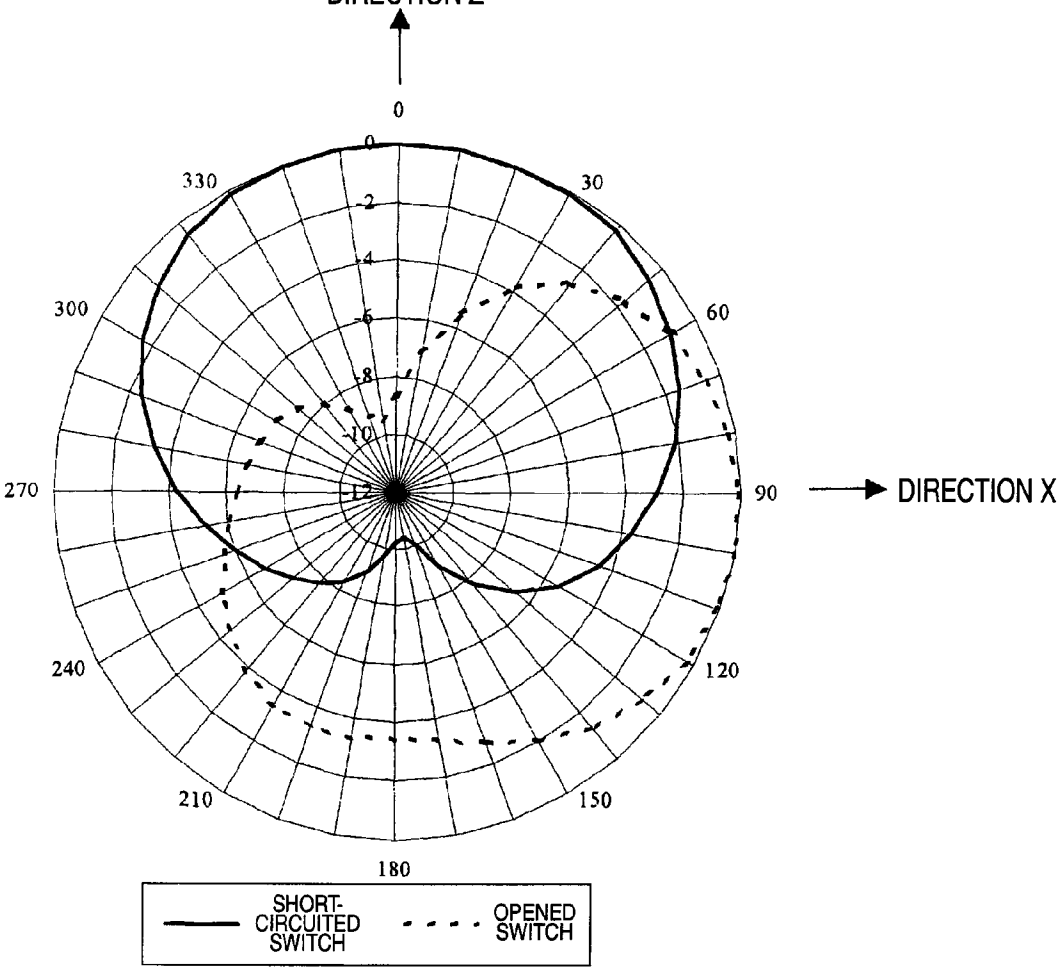
FIG. 8(*a*) is a cross-sectional profile of the directivity switching antenna according to the first embodiment of the present invention achieved when G=19/20×D; and (b) Directivity of the directivity switching antenna according to the first embodiment of the present invention acquired when the switch is switched at G=19/20×D.
Figure 8:
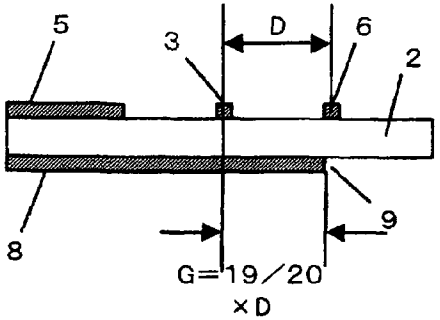

Although FIG. 5(*b*) shows directivity achieved when the switch is switched at interval G=D/4, FIGS. 6 to 8 show another example where the interval G has fulfilled the relational expression of 0≦G<D. FIG. 6(*a*) is a cross-sectional profile of the directivity switching antenna according to the first embodiment of the present invention achieved when G=D/2, and (b) shows directivity of the directivity switching antenna according to the first embodiment of the present invention acquired when the switch is switched at G=D/2. FIG. 7(*a*) is a cross-sectional profile of the directivity switching antenna according to the first embodiment of the present invention achieved when G=3/4×D, and (b) shows directivity of the directivity switching antenna according to the first embodiment of the present invention acquired when the switch is switched at G=3/4×D. FIG. 8(*a*) is a cross-sectional profile of the directivity switching antenna according to the first embodiment of the present invention achieved when G=19/20×D, and (b) shows directivity of the directivity switching antenna according to the first embodiment of the present invention acquired when the switch is switched at G=19/20×D. Numerical values other than the interval G shown in FIGS. 6 through 8 are common to those employed in FIG. 5(*a*). From FIGS. 6(*b*), 7(*b*), and 8(*b*), it can be ascertained that directivity is switched through about 90° by means of toggling actions of the switches 7.

Figure 9:
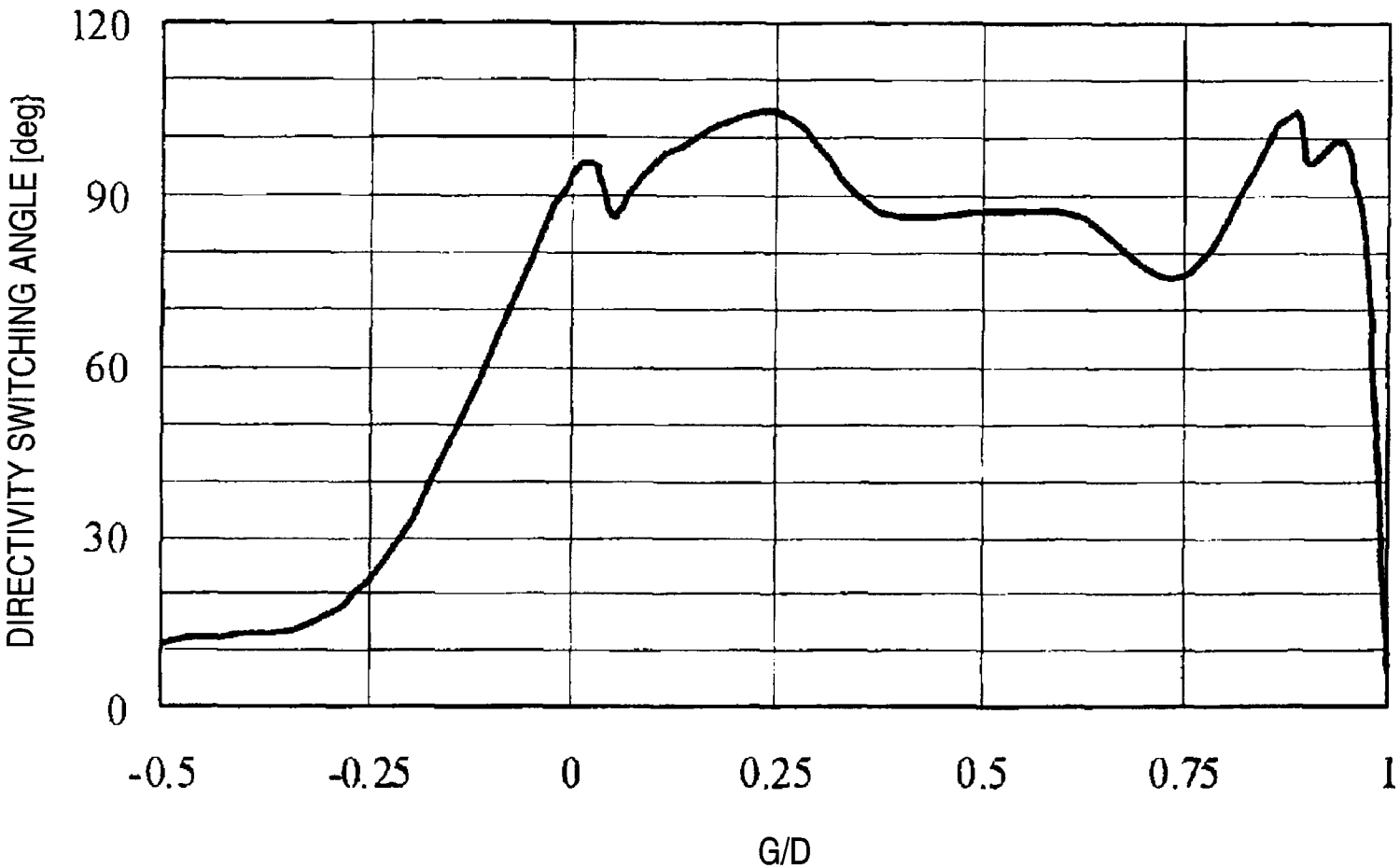
FIG. 9 is a maximum radiation direction switching angle acquired when the switch is switched at 0≦G<D in relation to the directivity switching antenna according to the first embodiment of the present invention.

FIG. 9 shows a directivity switching angle achieved by the directivity switching antenna apparatus according to the first embodiment of the present invention when the switch is switched in a range of −D/2<G<D. The horizontal axis represents a G/D ratio, and the vertical axis represents a directivity switching angle showing a switching angle at which the maximum radiation direction is acquired during switching of the switch. As shown in FIGS. 5 through 8, FIG. 9 shows that the directivity switching angel is in the vicinity of about 90° when G/D varies from 0 to 1 and that directivity can be switched so long as G/D varies from 0 to 1. Meanwhile, it is also ascertained that, as G/D approaches 1, the directivity of the antenna is not switched even when the switches 7 have been toggled. This shows that, as the second ground conductor 8 is placed so as to approach the lower portion of the parasitic element 6, the parasitic element 6 becomes inoperative as a director. Moreover, even when G/D is in the vicinity of 0, the directivity switching angle is in the vicinity of 90°. At this time, as indicated by the directivity achieved when the switch has been short-circuited at G=0 mm shown in FIG. 4(*b*), the radiation field is suppressed when compared with the radiation field in the direction +Z. However, the radiation field is also emitted in the direction −Z, as well. Therefore, setting the interval G within a range of 0<G<D, except a range where the interval comes to 0 or D, is preferable. The drawing shows that, when no consideration is given to emission of the radiation field in the direction −Z, directivity can be switched by means of setting the interval within a range of −D/4<G<D.

Figure 10:
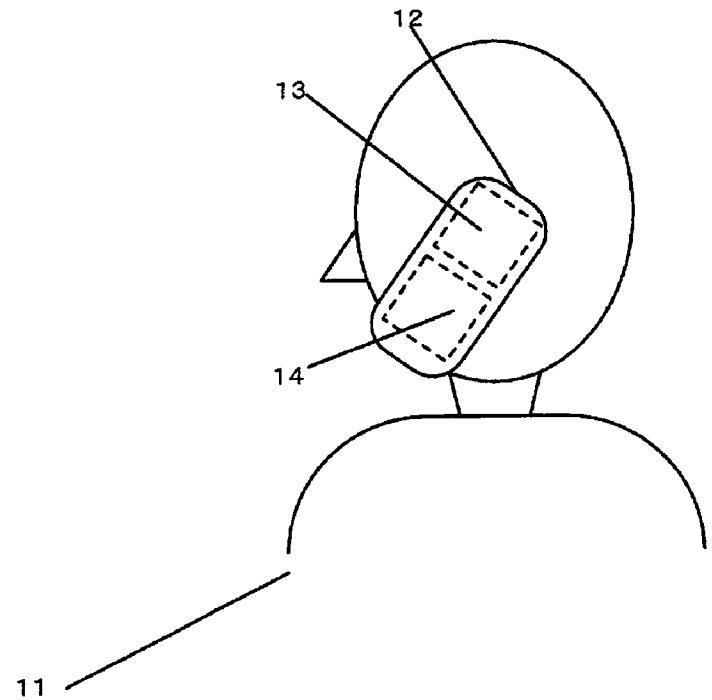
FIGS. 10(*a*) and (*b*) shows a view showing an example positional relationship between a wireless terminal and a user achieved during voice conversation.
Figure 10:
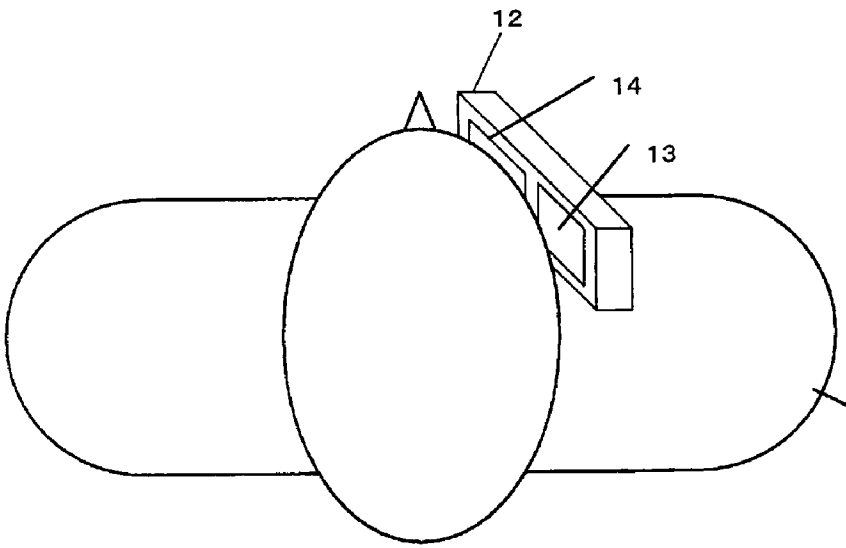
Figure 11:
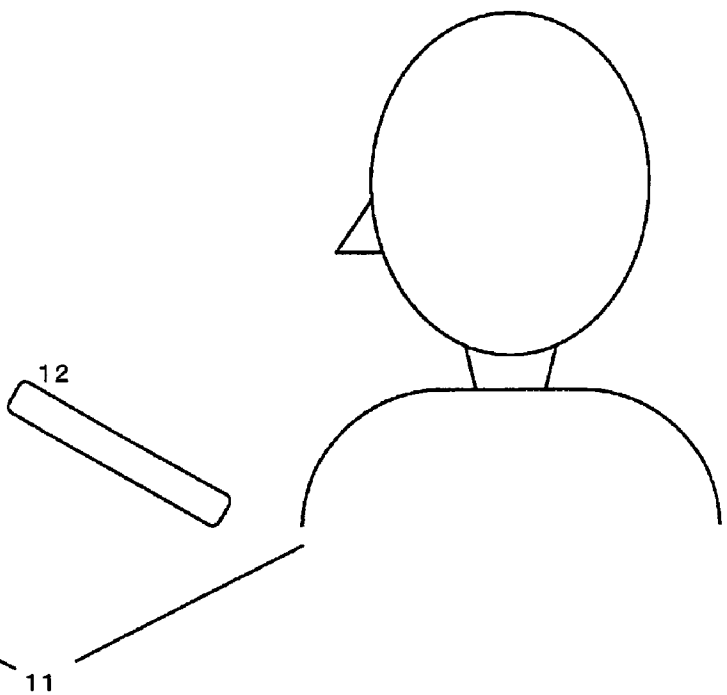
FIGS. 11(*a*) and (*b*) shows a view showing an example positional relationship between a wireless terminal and a user achieved during data communication.
Figure 11:
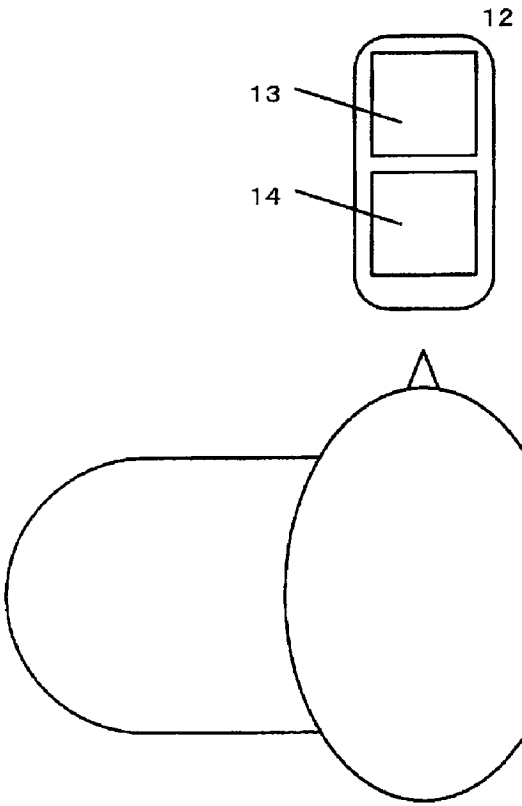

A positional relationship between the user and the wireless terminal achieved during voice conversation and during data communication will now be described in detail. FIG. 10 shows an example positional relationship between the wireless terminal and the user achieved during voice conversation. FIG. 11 show an example positional relationship between the wireless terminal and the user achieved during data communication. When voice conversation is performed, a positional relationship such as that shown in FIG. 10 is assumed to exist between the user 11 and the wireless terminal 12. When data communication is performed, a positional relationship such as that shown in FIG. 11 is assumed to exist between the user 11 and the wireless terminal 12.

Figure 12:
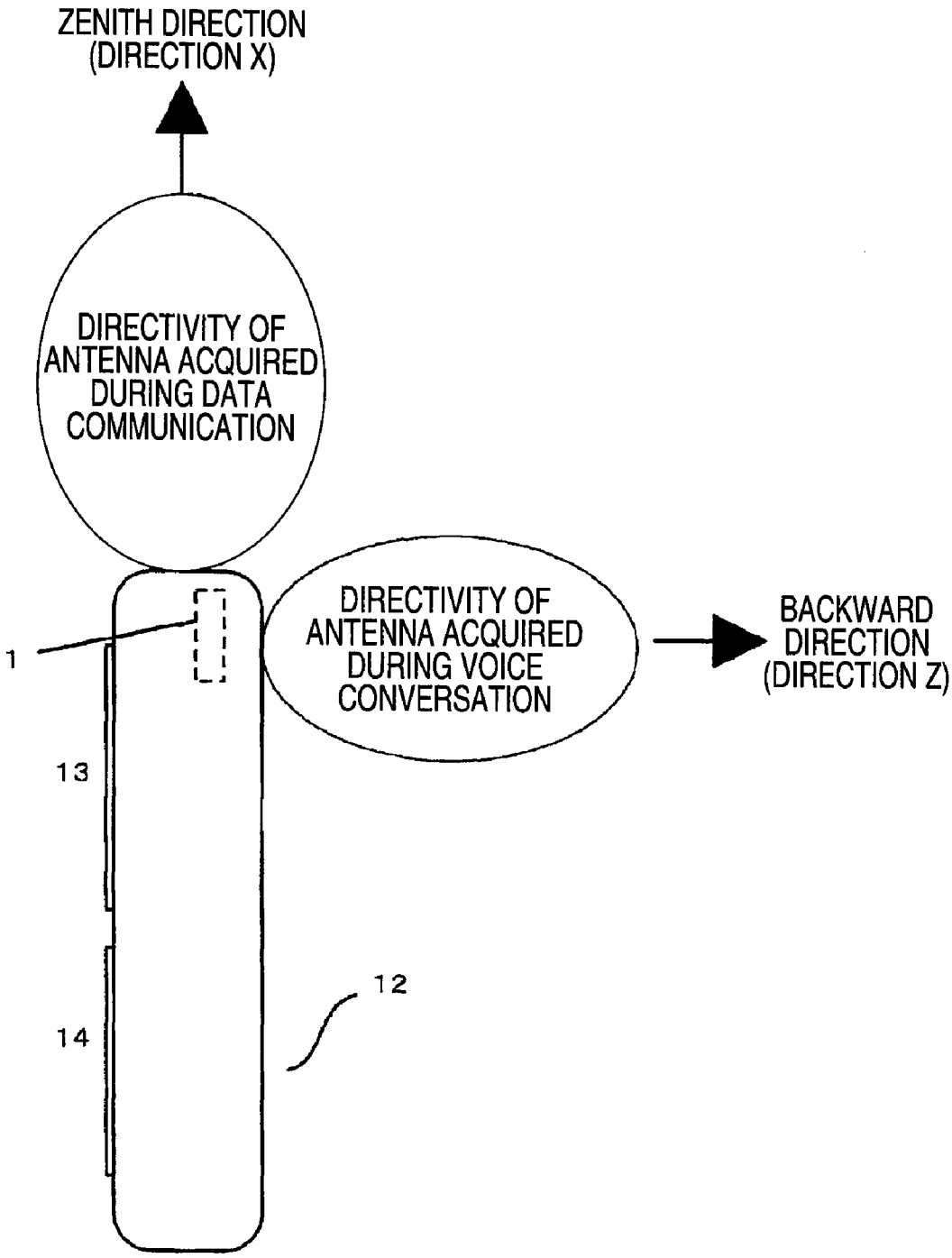
FIG. 12 is a view showing example radiation directivity characteristics of the antenna acquired during voice conversation and data communication.

During voice conversation, the user 11 uses the wireless terminal 12 while placing it adjacent to the side of the user's head. During data communication, the user 11 commonly performs operation by use of the operation section 14 while ascertaining messages appearing on the display section 13 of the wireless terminal 12. Therefore, as shown in FIG. 12, during voice conversation, directivity of the antenna provided in the wireless terminal 12 is preferably switched such that the maximum radiation direction achieved by the directivity of the antenna is oriented toward the back of the wireless terminal 12 (i.e., a direction opposite the display surface of the display section 13). Further, directivity is preferably switched such that, during data communication, the maximum radiation direction achieved by the directivity of the antenna comes to the zenith direction of the wireless terminal 12 (i.e., the horizontal direction with respect to the display surface of the display section 13 and an upper direction with displayed messages).

Since the wireless terminal 12 has such a directivity switching function, the radiation field originating from the antenna is not oriented toward the user 11, which in turn results in improvement in SAR and expectations for improved antenna gains. Consequently, the directivity switching antenna 1 is placed in the wireless terminal 12 such that the zenith direction in FIG. 12 is allocated to the direction X and such that the backward direction is allocated to the direction Z, whereby desired directivity characteristics can be attained during voice conversation and data communication.

As above, the first ground conductor 5 and the parasitic element 6 are provided around the radiating element 3 placed on the dielectric substrate 2 as well as in plane with the same. The switches 7 are interposed between the first ground conductor and the parasitic element 6. The second ground conductor 8 is provided below the radiating element 3 with the dielectric substrate 2 sandwiched therebetween. In such a structure, the end portion 9 of the second ground conductor 8 is placed between the radiating element 3 and the parasitic element 6. Further, the switches 7 are toggled by use of the control circuit 10, thereby switching the directivity of the antenna through about 90°. Therefore, there is yielded an advantage of the ability to realize an antenna apparatus which switches directivity according to a usage pattern of a wireless terminal.

Further, a wireless terminal is configured by use of the directivity switching antenna described in connection with the embodiment. As a result, the directivity of the antenna is switched according to the usage pattern of the wireless terminal, to thus enhance performance of the wireless terminal. Therefore, a highly-reliable wireless communications system can be provided.

The present embodiment has described that the radiating element 3 is formed from the conductor pattern on the dielectric substrate 2. However, the radiating element 3 may also be formed from a linear conductor, such as a wire, or by means of sheeting.

The present embodiment has described that the radiating element 3 is formed into a linear dipole. However, the radiating element 3 is not limited to the linear dipole but may also be formed into, e.g., a meander line.

The present embodiment has described that the radiating element 3, the first ground conductor 5, the parasitic element 6, and the second ground conductor 8 are assumed to be formed on the dielectric substrate 2. However, use of the dielectric substrate is not always required. For instance, the radiating element 3, the parasitic element 6, the ground conductors 5, 8, and the like, are formed by means of sheeting, and the constituent elements may be fixed by means of a foaming agent.

The present embodiment has described that the second ground conductor 8 is formed from a conductor pattern on the side of the dielectric substrate 2 opposite the surface thereof where the radiating element 3 is formed. For instance, the second ground conductor may be provided not on the dielectric substrate 2 but on an enclosure of the wireless terminal 12 that is spaced from the dielectric substrate 2 by a given distance. By means of such a configuration, there is yielded the advantage of the ability to broadly ensure an interval between the radiating element 3 and the second ground conductor 8 and to easily effect matching of the antenna.

The present embodiment has not described particularly the configuration of the switches 7. However, a diode switch, an FET switch, a MEMS switch, or the like, can be used.

SECOND EMBODIMENT

Figure 13:
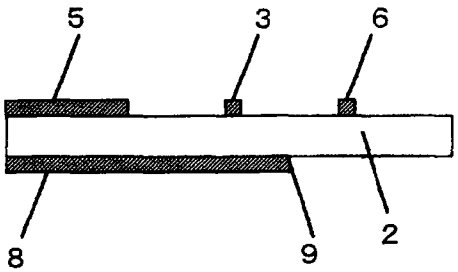
FIGS. 13(*a*) and (*b*) show a schematic view of a directivity switching antenna according to a second embodiment of the present invention.
Figure 13:
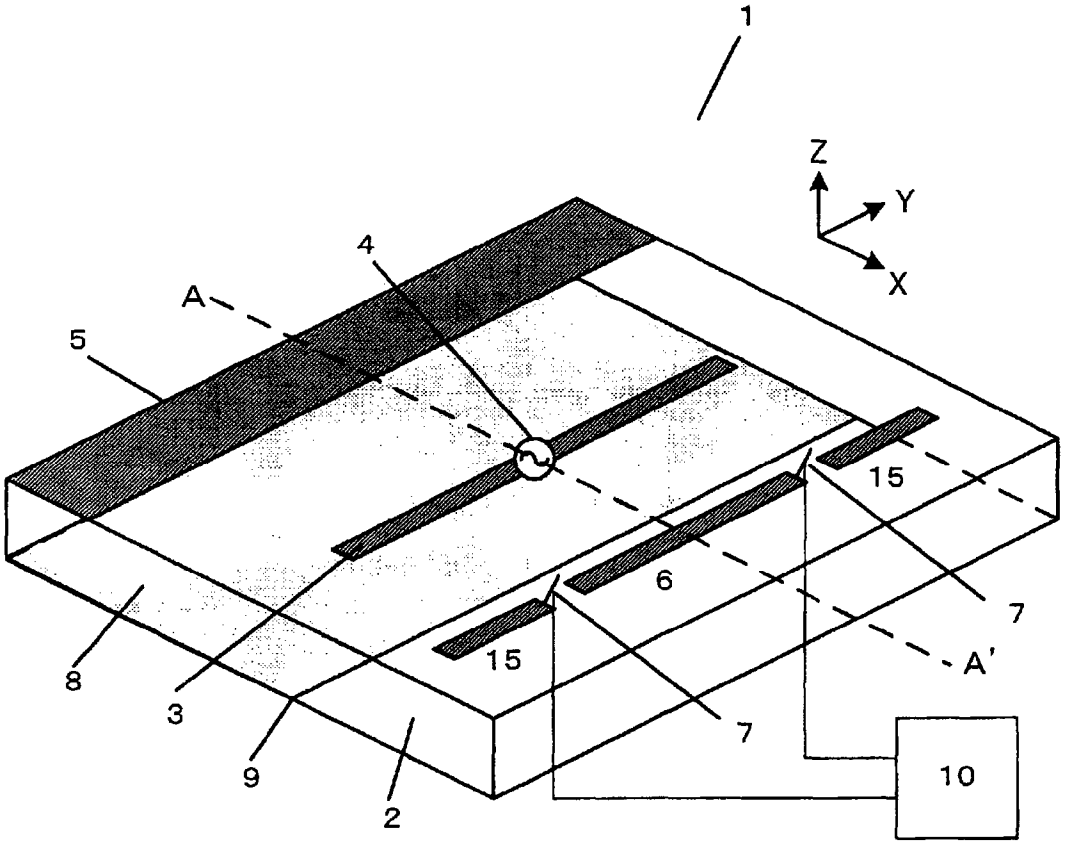

FIG. 13 is a schematic view of a directivity switching antenna according to a second embodiment of the present invention. FIG. 13(*a*) is a perspective view, and FIG. 13(*b*) is a cross-sectional profile taken along line A-A' shown in FIG. 13(*a*). In FIG. 13, the directivity switching antenna apparatus includes auxiliary elements 15. In other respects, the second embodiment is identical with the first embodiment, and hence its explanation is omitted.

Operation of the directivity switching antenna apparatus according to the second embodiment of the present invention will now be described. The basic operation of the antenna apparatus is identical with that described in connection with the first embodiment, and hence its explanation is omitted. The auxiliary elements 15 are provided at both ends of the parasitic element 6, and the switches 7 are interposed between the parasitic element 6 and the auxiliary elements 15. In relation to the auxiliary element 15, a total length of the parasitic element 6 and the auxiliary element 15 acquired when the switches 7 are short-circuited is set such that the parasitic element 6 acts as a reflector with respect to the radiating element 3. By means of such a configuration, when the switches 7 have been opened, the parasitic element 6 acts as a director, and directivity is oriented in the direction +X. When the switches 7 have been short-circuited, the parasitic element 6 acts as a reflector, and directivity is oriented in the direction +Z. Therefore, the advantage acquired when the surroundings of the radiating element 3 are covered with a ground conductor is yielded.

As above, the auxiliary elements 15 are disposed at both ends of the parasitic element 6. The switches 7 are toggled by use of the control circuit 10 to thus switch the parasitic element 6 between the director and the reflector, whereby the directivity of the antenna can be switched through about 90°. Hence, there is yielded the advantage of the ability to realize an antenna apparatus which switches directivity according to a usage pattern.

Moreover, a wireless terminal is configured by use of the directivity switching antenna apparatus described in connection with the present embodiment. Hence, the directivity of the antenna is switched according to the usage pattern, to thus enhance the performance of the wireless terminal. Thus, a highly-reliable wireless communications system can be provided.

The present embodiment has described that the radiating element 3 is formed from a conductor pattern on the dielectric substrate 2. However, the radiating element 3 may also be formed from a linear conductor, such as a wire, or by means of sheeting.

The present embodiment has described that the radiating element 3 is formed into a linear dipole. However, the radiating element 3 is not limited to the linear dipole but may also be formed into, e.g., a meander line.

Figure 14:
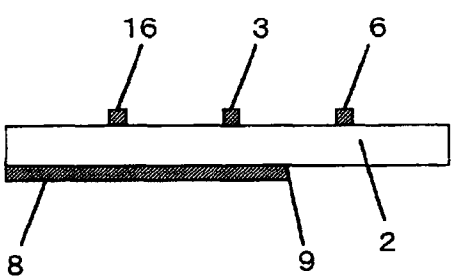
FIGS. 14(*a*) and (*b*) show a schematic view of a directivity switching antenna according to the second embodiment of the present invention.
Figure 14:
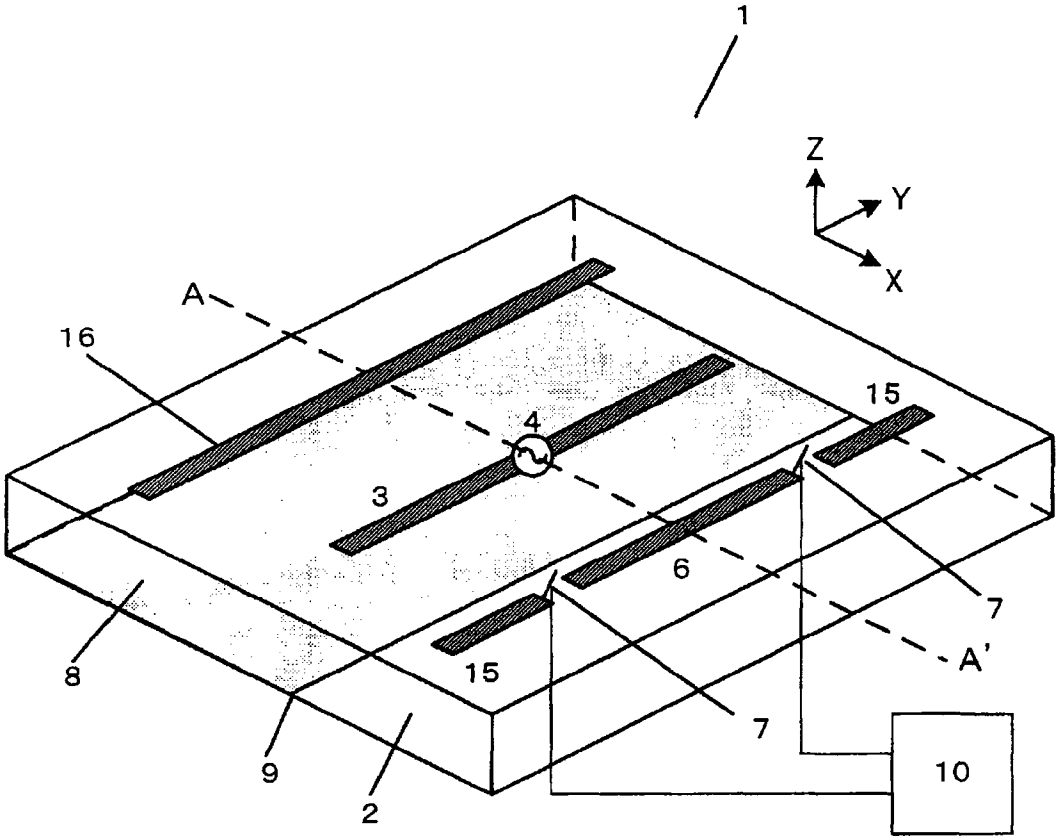

The present embodiment has described that the first ground conductor 5 is placed in the direction −X of the radiating element 3. As shown in FIG. 14, the same advantage is yielded even when the a reflector 16 is used in place of the first ground conductor 5.

The present embodiment has described that the radiating element 3, the first ground conductor 5, the parasitic element 6, the second ground conductor 8, and the auxiliary elements 15 are assumed to be formed on the dielectric substrate 2. However, use of the dielectric substrate is not always required. For instance, the radiating element 3, the parasitic element 6, the ground conductors 5, 8, the auxiliary elements 15, and the like, may be formed by means of sheeting, and the constituent elements fixed by means of a foaming agent.

The present embodiment has described that the second ground conductor 8 is formed from a conductor pattern on the side of the dielectric substrate 2 opposite the surface thereof where the radiating element 3 is formed. For instance, the second ground conductor may be provided not on the dielectric substrate 2 but on an enclosure of the wireless terminal 12 that is spaced from the dielectric substrate 2 by a given distance. By means of such a configuration, there is yielded the advantage of the ability to broadly ensure an interval between the radiating element 3 and the second ground conductor 8 and to easily effect matching of the antenna.

The present embodiment has not described the particular configuration of the switches 7. However, a diode switch, an FET switch, a MEMS switch, or the like, can be used.

THIRD EMBODIMENT

Figure 15:
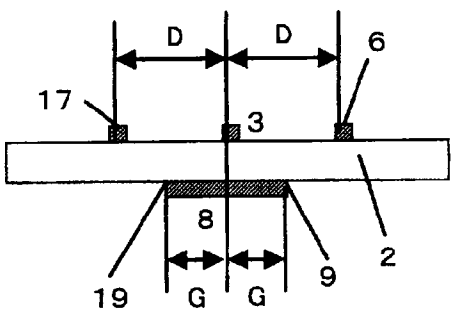
FIGS. 15(*a*) and (*b*) show a schematic view of a directivity switching antenna according to a third embodiment of the present invention.
Figure 15:
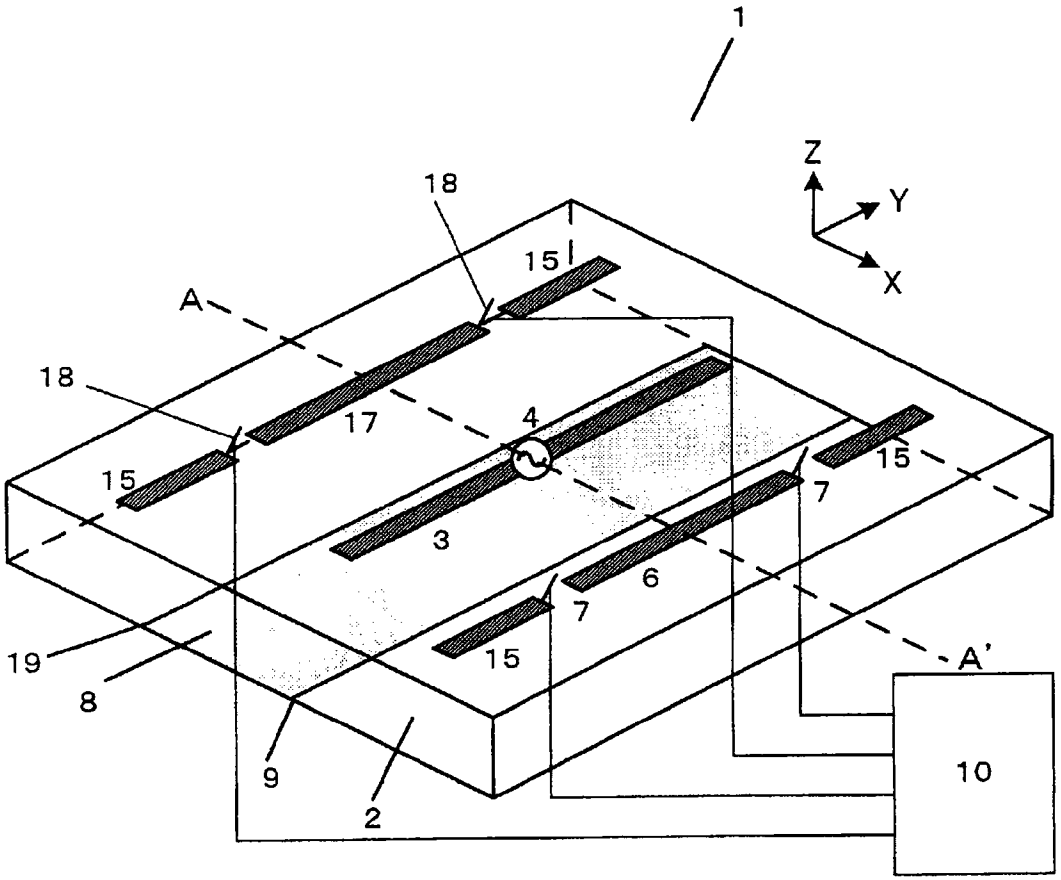

FIG. 15 is a schematic view of a directivity switching antenna according to a third embodiment of the present invention. FIG. 15(*a*) is a perspective view, and FIG. 15(*b*) is a cross-sectional profile taken along line A-A' shown in FIG. 15(*a*). In FIG. 15, the directivity switching antenna apparatus 1 comprises the auxiliary elements 15, a parasitic element 17, switches 18, and the end portion 19 on the part of the second ground conductor 8 facing the parasitic element 17. In other respects, the present embodiment is identical with the first embodiment, and hence its explanation is omitted.

Operation of the directivity switching antenna apparatus 1 according to the third embodiment of the present invention will now be described. The basic operation of the antenna apparatus is identical with that described in connection with the first embodiment, and hence its explanation is omitted. The auxiliary elements 15 are provided at both ends of the parasitic element 6, and the switches 7 are interposed between the parasitic element 6 and the auxiliary elements 15. In relation to the auxiliary element 15, a total length of the parasitic element 6 and the auxiliary elements 15 acquired when the switches 7 are short-circuited is set such that the parasitic element 6 acts as a reflector with respect to the radiating element 3.

In place of the first ground conductor 5, the parasitic element 17, which is equal in length to the parasitic element 6, is provided. The auxiliary elements 15 are provided at both ends of the parasitic element 17, as well. The switches 18 are interposed between the parasitic element 17 and the auxiliary elements 15. An interval between the radiating element 3 and the parasitic element 17 is made equal to the interval D between the radiating element 3 and the parasitic element 6. Moreover, the interval G between the radiating element 3 and the end portion 19 on the part of the second ground conductor 8, facing the parasitic element 17, in the direction of the +X axis is also made equal to the interval G between the radiating element 3 and the end portion 9 on the part of the second ground conductor 8, facing the parasitic element 6, in the direction of the +X axis. Specifically, a symmetrical structure is obtained within the YZ plane including the radiating element 3.

At this time, the switches 7, 18 are controlled by use of the control circuit 10, to thus switch directivity. Detailed descriptions will be provided in this respect. FIG. 16 shows a relationship between short-circuiting/opening actions of the switches 7, 18 and directivity of the antenna. When the switches 7, 18 have been short-circuited, the parasitic elements 6, 17 operate as reflectors. Hence, the directivity of the antenna is oriented to the direction +Z in FIG. 11.

Next, when the switch 7 is short-circuited and the switch 18 is opened, the parasitic element 6 operates as a reflector, and the parasitic element 17 operates as a director. Hence, the directivity of the antenna is oriented in the direction −X shown in FIG. 15. Next, the switch 7 is opened to thus short-circuit the switch 18, so that the parasitic element 6 operates as a director, and the parasitic element 17 operates as a reflector. Accordingly, the directivity of the antenna is oriented in the direction +X in FIG. 15. When both the switches 7, 18 are opened, the parasitic elements 6, 17 operate as directors. In relation to the directivity of the antenna, the maximum radiation direction is in the direction +Z. However, a substantially omnidirectional characteristic is obtained.

As mentioned above, the auxiliary elements 15 are provided at both ends of each of the parasitic elements 6, 17. Further, the parasitic elements 6, 17 are controlled by the control circuit 10 such that, by means of switching actions of the switches 7, 18, the parasitic element 6 is switched to the director and the parasitic element 17 is switched to the reflector, whereby the directivity of the antenna can be switched at intervals of 90° in the direction ±X and the direction ±Z. There is yielded the advantage of the ability to embody an antenna apparatus which, according to the usage pattern of the wireless terminal, selects the direction ±X opposite the direction toward the user even when the wireless terminal is disposed such that the radiation direction is toward the user during, e.g., data communication, thereby switching directivity.

By means of configuring a wireless terminal by use of the directivity switching antenna described in the embodiment, the performance of the wireless terminal can be enhanced by means of switching the directivity of the antenna according to a usage pattern. Thus, a highly-reliable wireless communications system can be provided.

The present embodiment has described that the radiating element 3 is formed from a conductor pattern on the dielectric substrate 2. However, the radiating element 3 may also be formed from a linear conductor, such as a wire, or by means of sheeting.

The present embodiment has described that the radiating element 3 is formed into a linear dipole. However, the radiating element 3 is not limited to the linear dipole but may also be formed into, e.g., a meander line.

The present embodiment has described that the radiating element 3, the parasitic elements 6 and 17, the second ground conductor 8, and the auxiliary elements 19 are assumed to be formed on the dielectric substrate 2. However, use of the dielectric substrate is not always required. For instance, the radiating element 3, the parasitic elements 6 and 17, the ground conductor 8, the auxiliary elements 19, and the like, may be formed by means of sheeting, and the constituent elements fixed by means of a foaming agent.

The present embodiment has described that the second ground conductor 8 is formed from a conductor pattern on the side of the dielectric substrate 2 opposite the surface thereof where the radiating element 3 is formed. For instance, the second ground conductor may be provided not on the dielectric substrate 2 but on an enclosure of the wireless terminal 12 that is spaced a given distance from the dielectric substrate 2. By means of such a configuration, there is yielded the advantage of the ability to broadly ensure an interval between the radiating element 3 and the second ground conductor 8 and to easily effect matching of the antenna.

The present embodiment has not described the particular configuration of the switches 7. However, a diode switch, an FET switch, a MEMS switch, or the like, can be used.

FOURTH EMBODIMENT

Figure 17:
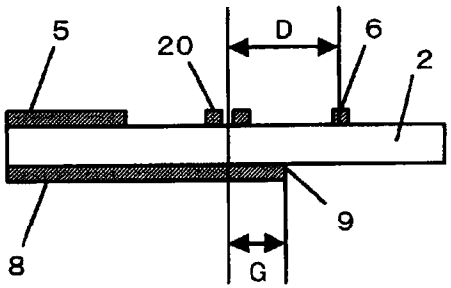
FIGS. 17(*a*) and (*b*) shows a schematic view showing a directivity switching antenna according to a fourth embodiment of the present invention.
Figure 17:
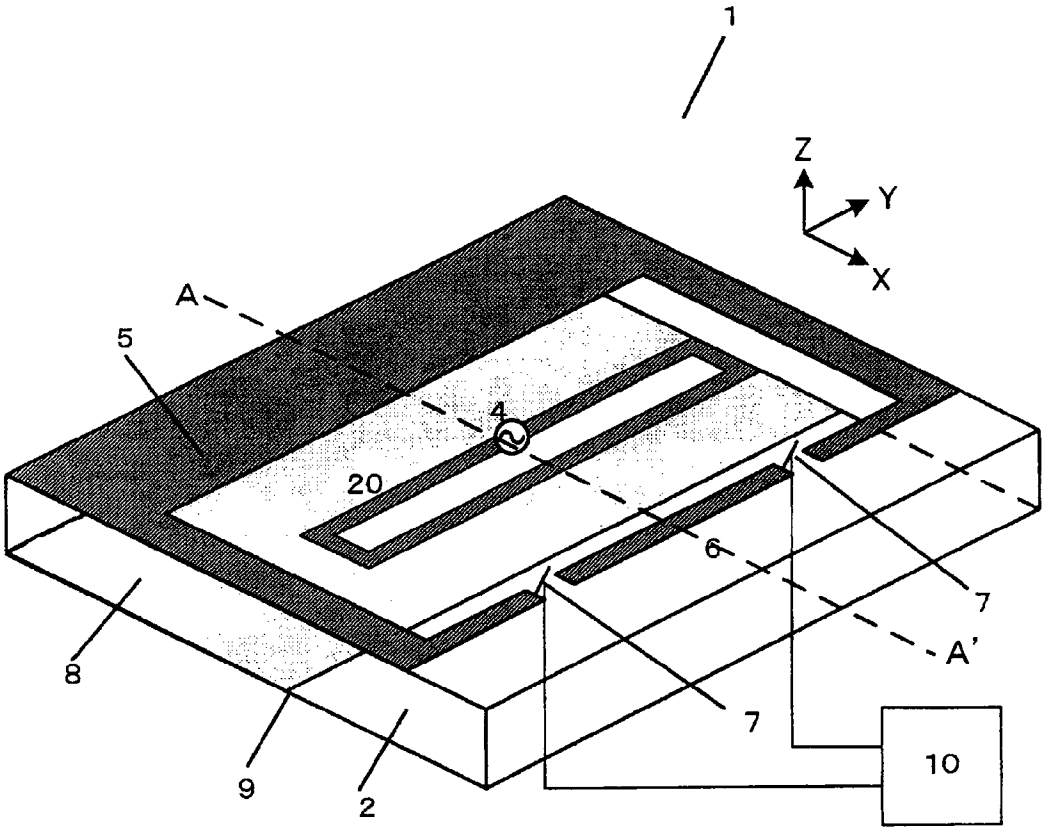

FIG. 17 is a schematic view of a directivity switching antenna according to a fourth embodiment of the present invention. FIG. 17(*a*) is a perspective view, and FIG. 17(*b*) is a cross-sectional profile taken along line A-A' shown in FIG. 17(*a*). In FIG. 17, the directivity switching antenna apparatus 1 comprises a radiating element 20 having a folded structure. In other respects, the present embodiment is identical with the first embodiment, and hence its explanation is omitted.

Operation of the directivity switching antenna apparatus according to the fourth embodiment of the present invention will now be described. For instance, in FIG. 1, the radiating element 3 and the second ground conductor 8 are separated from each other by the thickness "t" of the dielectric substrate 2; namely, 0.008λ. When the ground conductor 8 is placed in the vicinity of the pole of the radiating element 3 as mentioned above, input impedance of the radiating element 3 becomes drastically smaller than in the case where the ground conductor 8 is not provided in the vicinity of the poles of the radiating element 3.

Figure 18:
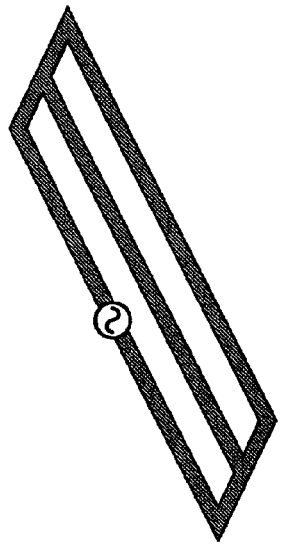
FIGS. 18(*a*) to (*c*) shows a view showing an example configuration of a radiating element having structures folded within an X-Y plane according to the fourth embodiment of the present invention.
Figure 18:
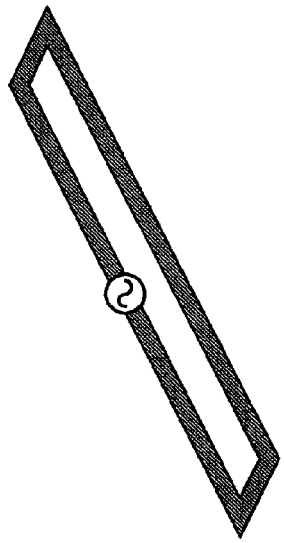
Figure 18:
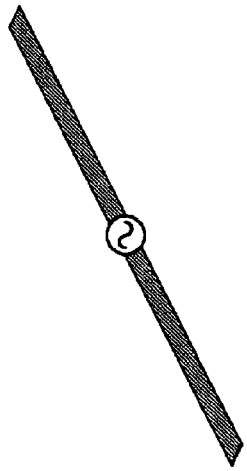

By means of providing the radiating element 3 with a folded structure as in the case of the radiating element 20, the input impedance of the radiating element can be increased. For instance, the input impedance of a double-folded dipole antenna shown in FIG. 18(*b*) is quadruple the input impedance of a common dipole antenna shown in FIG. 18(*a*). The input impedance of a triple-folded dipole antenna shown in FIG. 18(*c*) is eight times the input impedance of the common dipole antenna. As a result of use of the radiating element 20 having a folded structure as shown in FIG. 17, input impedance of the antenna acquired at the feeding point 4 can be increased, which facilitates matching of the antenna with a 50Ω-based microstrip line or coaxial line.

As above, the radiating element 20 is provided with a folded structure, and the switches 7 are toggled by use of the control circuit 10. As a result, there is yielded the advantage of the ability to realize an antenna apparatus which increases input impedance of the antenna, to thus facilitate matching while switching the directivity of the antenna through about 90° and which switches directivity according to a usage pattern of the wireless terminal.

Moreover, the wireless terminal is configured by use of the directivity switching antenna apparatus described in connection with the present embodiment. Hence, the directivity of the antenna is switched according to the usage pattern, to thus enhance the performance of the wireless terminal. Thus, a highly-reliable wireless communications system can be provided.

The present embodiment has described that the radiating element 20 is formed from a conductor pattern on the dielectric substrate 2. However, the radiating element 20 may also be formed from a linear conductor, such as a wire, or by means of sheeting.

The present embodiment has described that the radiating element 20 is formed into a linear dipole. However, the radiating element 20 is not limited to the linear dipole and may also be formed into, e.g., a meander line.

The present embodiment has described that the radiating element 20, the first ground conductor 5, the parasitic element 6, and the second ground conductor 8 are assumed to be formed on the dielectric substrate 2. However, use of the dielectric substrate is not always required. For instance, the radiating element 20, the parasitic element 6, the ground conductors 5, 8, and the like, may be formed by means of sheeting, and the constituent elements fixed by means of a foaming agent.

The present embodiment has described that the second ground conductor 8 is formed from a conductor pattern on the side of the dielectric substrate 2 opposite the surface thereof where the radiating element 20 is formed. For instance, the second ground conductor may be provided not on the dielectric substrate 2 but on an enclosure of the wireless terminal 12 that is spaced a given distance from the dielectric substrate 2. By means of such a configuration, there is yielded the advantage of the ability to broadly ensure an interval between the radiating element 20 and the second ground conductor 8 and to easily effect matching of the antenna.

In the present embodiment, the radiating element 3, 20 is formed into a two-dimensional structure within the XY plane. However, the radiating element 20 is not limited to this structure. As shown in, e.g., FIGS. 19(*a*) and (*b*), the radiating element 3, 20 may be formed into a structure where ends of the radiating element are folded. By means of such a folded structure, the antenna length can be shortened, and the antenna can be miniaturized.

Figure 19:
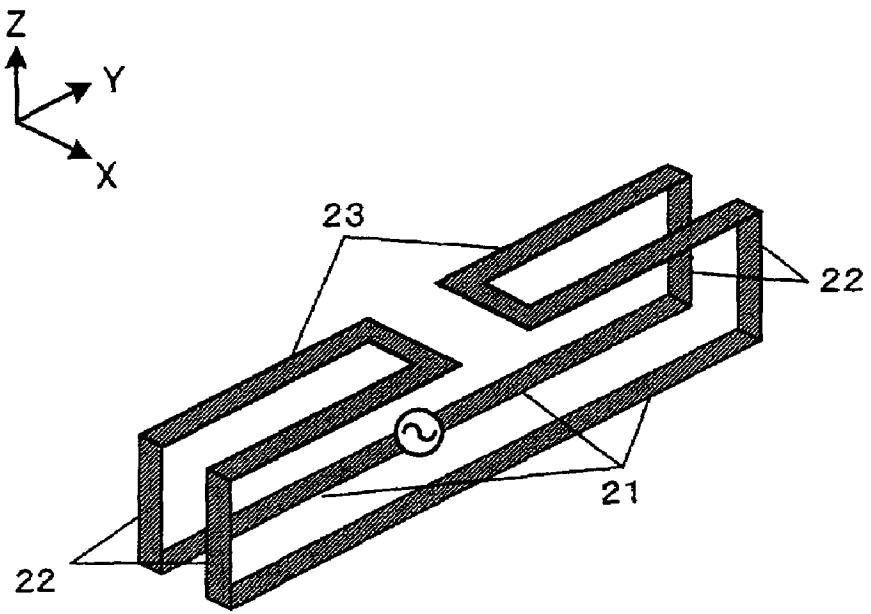
FIGS. 19(*a*) and (*b*) shows a view showing an example configuration of a radiating element having structures folded within a Y−Z plane according to the fourth embodiment of the present invention.
Figure 19:
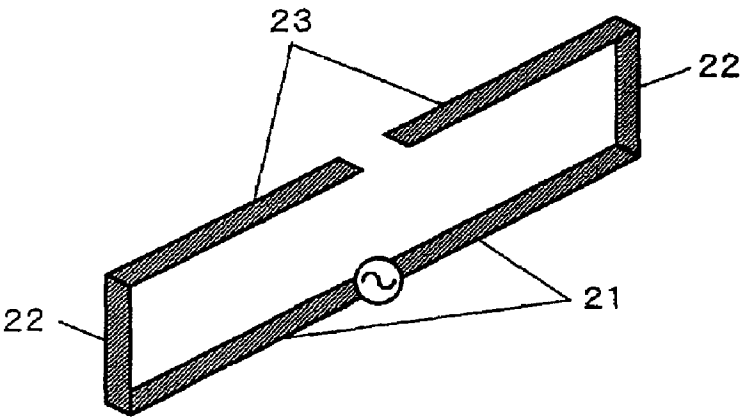
Figure 20:
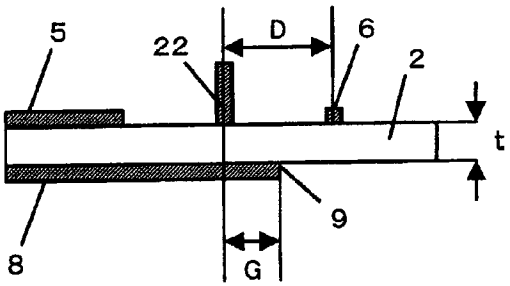
FIGS. 20(*a*) and (*b*) shows a schematic view of the directivity switching antenna using the radiating element having one of the folded structures of the fourth embodiment of the present invention.
Figure 20:
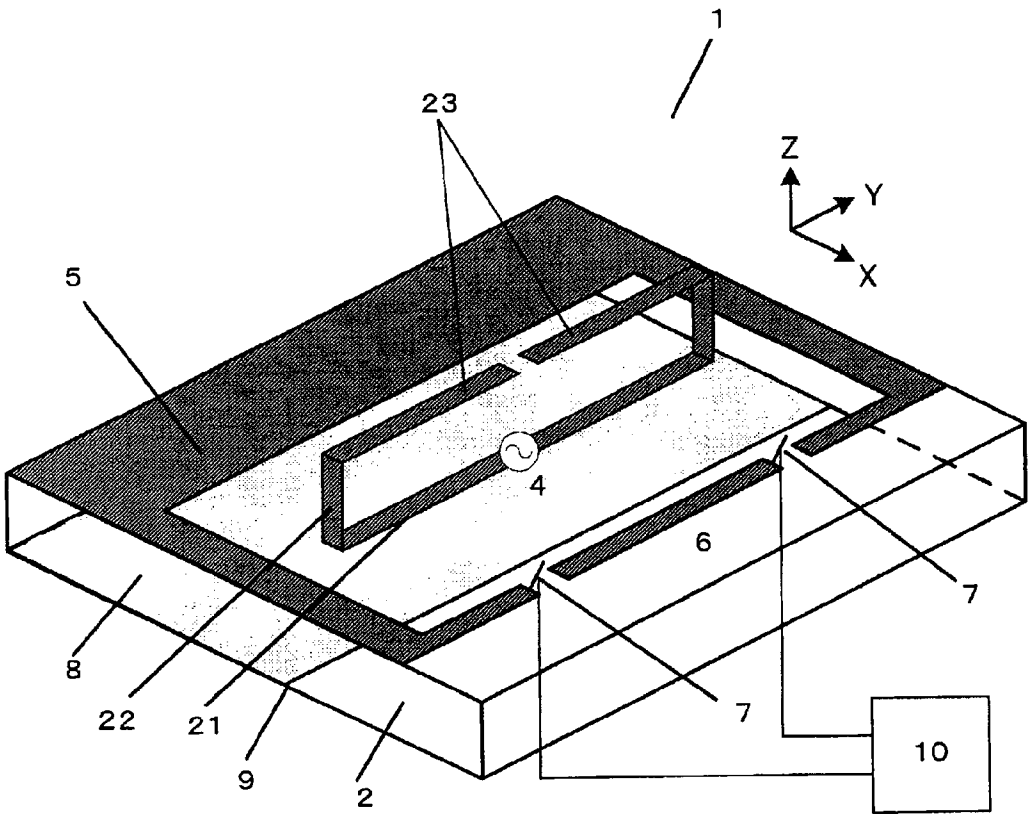

A method for manufacturing an antenna folded within a YZ plane as shown in FIGS. 19(*a*), (*b*) will now be described. As shown in FIG. 20, a method for manufacturing an antenna in the simplest manner is to manufacture an antenna by sheeting. A lower conductor 21, a folded section 22, and an upper conductor 23, all of which constitute a radiating element, may be integrally formed by means of sheeting. Alternatively, the lower conductor 21 may have been formed beforehand on the dielectric substrate 2 from a conductor pattern, and only the folded section 22 and the upper conductor 23 may be formed by means of sheeting.

Figure 21:
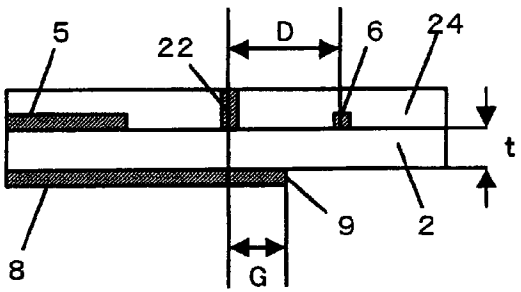
FIGS. 21(*a*) and (*b*) shows a schematic view of the directivity switching antenna using a dielectric substrate of multilayer structure according to the fourth embodiment of the present invention.
Figure 21:
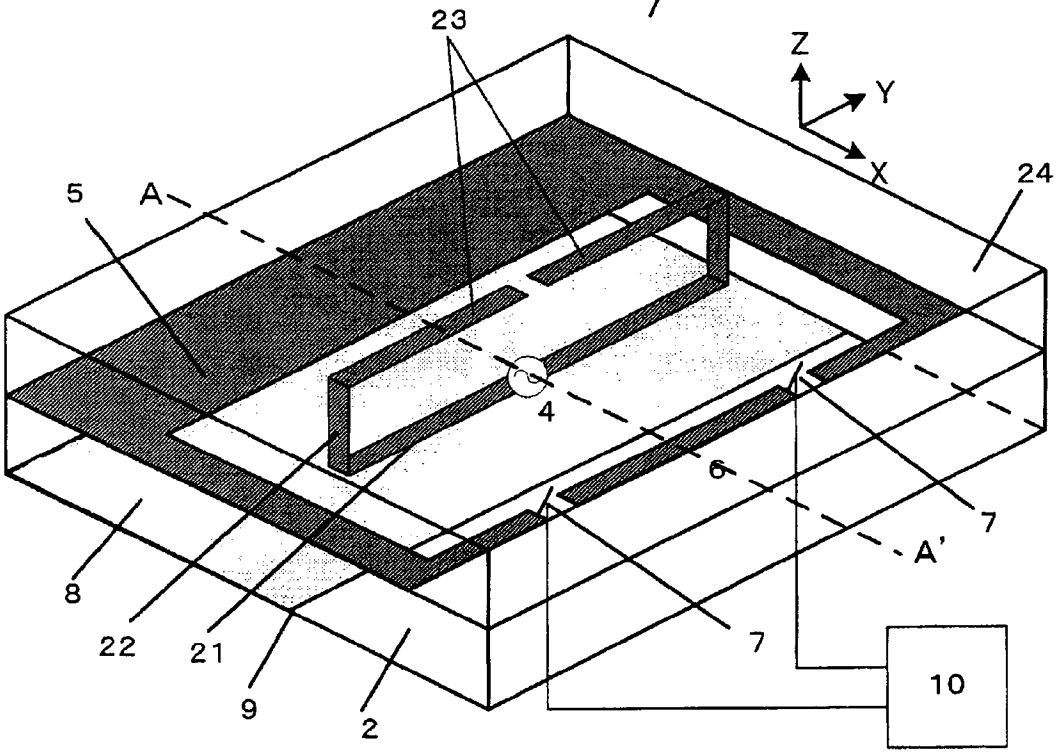

In addition to sheeting, as shown in FIG. 21, another manufacturing method may also be adopted; for instance, newly placing a dielectric substrate 24 on the dielectric substrate 2; forming the lower conductor 21 from a planer conductor pattern sandwiched between the dielectric substrates 2, 24; forming the upper conductor 23 from the conductor pattern on a surface of the dielectric substrate 24 opposite the surface thereof that faces the dielectric substrate 2; forming the folded section 22 from a through hole, or the like, passing through the dielectric substrate 24; and electrically connecting the lower conductor 21 to the upper conductor 23.

Figure 22:
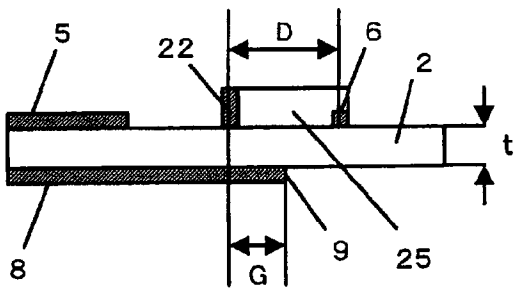
FIGS. 22(*a*) and (*b*) shows a schematic view of a directivity switching antenna using a dielectric block according to the fourth embodiment of the present invention.
Figure 22:
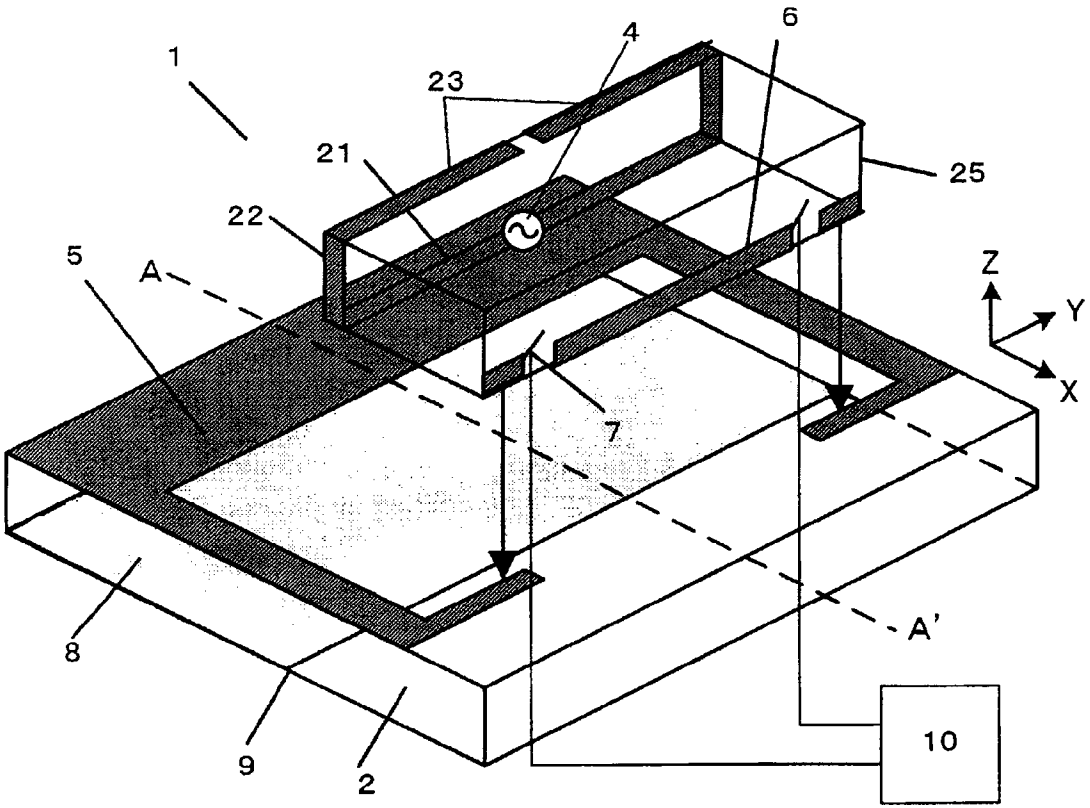

By means of adoption of such a configuration, the directivity switching antenna apparatus can be manufactured from a multilayer substrate. As shown in FIG. 22, each of the lower conductor 21, the folded section 22, and the upper conductor 23 may be formed from a pattern on a dielectric block 25 made of a highly-dielectric material such as ceramic or the like. By means of the configuration, the antenna apparatus can be miniaturized to a great extent. Further, the parasitic element 6 and the ground conductor 5 are formed from a pattern on the dielectric block 25, whereby a dielectric antenna having a directivity switching function can be manufactured.

FIFTH EMBODIMENT

Figure 23:
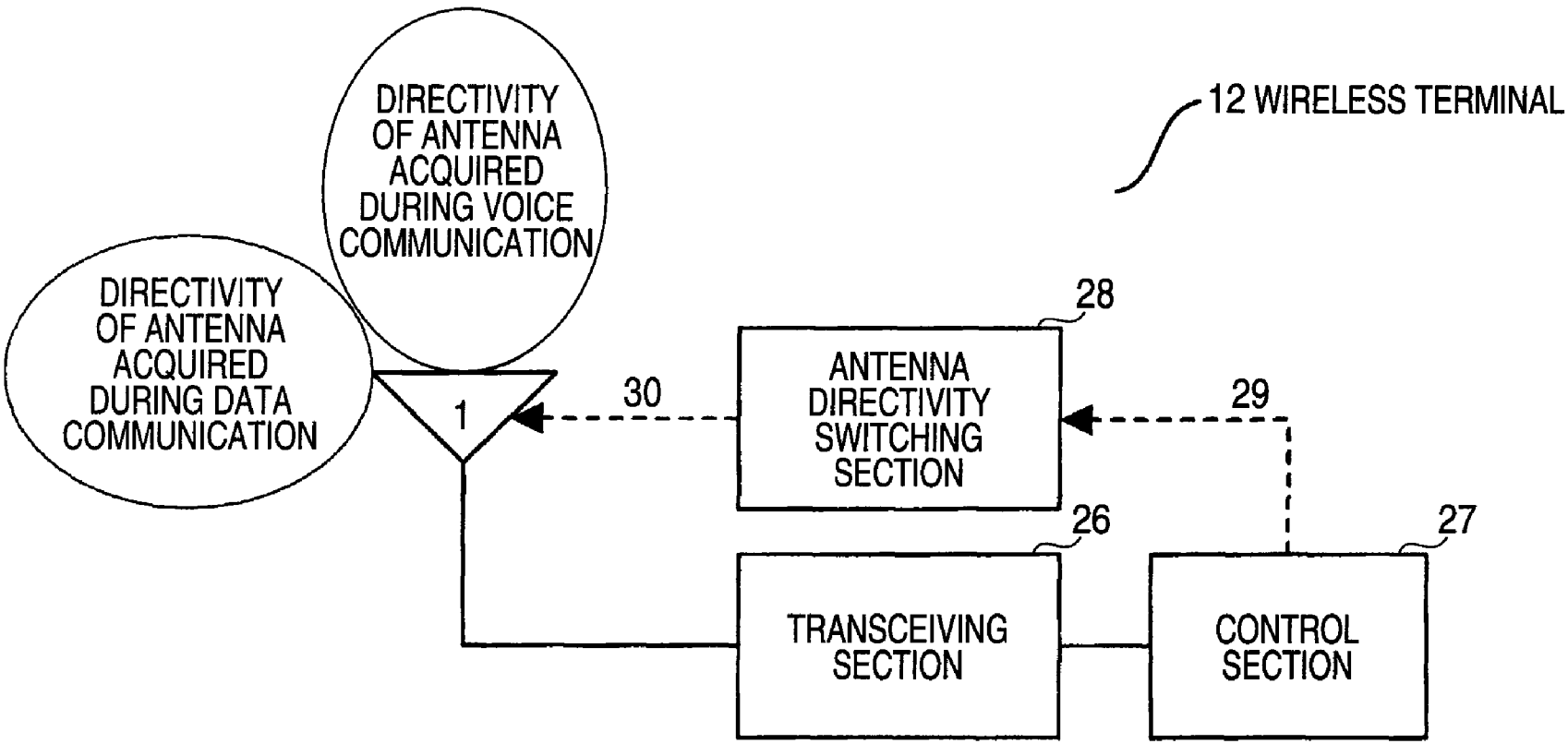
FIG. 23 A schematic view of a wireless terminal according to a fifth embodiment of the present invention.

FIG. 23 is a schematic view of a wireless terminal of a fifth embodiment of the present invention. In FIG. 23, the wireless terminal 12 comprises a transceiving section 26 set to a frequency range where data communication and voice conversation are carried out, a control section 27, and an antenna directivity switching section 28.

Operation of the wireless terminal according to the present embodiment of the present invention will now be described. For instance, when the wireless terminal is used indoors, a multipath environment is presumed to arise for reasons of obstacles such as walls. Under such circumstances, the antenna can address the multipath environment by means of diversity receiving operation. Common diversity receiving operation is achieved by means of placing a plurality of antennas in a spatially-separated manner. However, use of the plurality of antennas results in an increase in the area required to mount the antenna, as well as a necessity for an area required to mount an antenna switch, because the antenna switch is used for selecting any one of the plurality of antennas.

By use of the directivity switching antennas 1 described in connection with the first through fourth embodiments, directional diversity receiving can be effected while the area required to mount the antenna is maintained to that required to mount a single antenna. Detailed descriptions are given in this regard.

In FIG. 23, the wireless terminal 12 is formed from the directivity switching antenna 1, the transceiving section 26, the control section 27, and the antenna directivity switching section 28. With such a configuration, during receiving operation, the high-frequency signal received by the directivity switching antenna 1 is subjected to frequency conversion and demodulation in the transceiving section 26, and the thus-converted demodulated signal is transmitted to the control section 27. At this time, the control section 27 monitors received power gained as a result of the directivity of the directivity switching antenna 1 having been switched, and a control signal 29 is sent to the antenna directivity switching section 28 such that the directivity of the antenna, at which the greatest received power is attained, is acquired. On the basis of the control signal 29 output from the control section 27, the antenna directivity switching section 28 determines directivity at which superior receiving sensitivity is achieved; and transmits a control signal 30 in order to switch the directivity of the directivity switching antenna 1 such that superior receiving sensitivity is achieved. By means of the control signal 30, the directivity switching antenna 1 is switched so as to acquire desired directivity. In the meantime, during transmission operation, the signal transmitted from the control section 27 is subjected to modulation and frequency conversion at the transceiving section 26, and the thus-modulated converted signal is transmitted from the directivity switching antenna 1. At this time, the directivity selected during receiving operation is used as the directivity of the directivity switching antenna 1.

As above, the wireless terminal is formed from the directivity switching antenna 1, the transceiving section 26, the control section 27, and the antenna directivity switching section 28. Diversity receiving can be performed by a single antenna, and therefore there is yielded the advantage of the ability to implement a compact, high-performance wireless terminal.

The present embodiment has described that, during transmission operation, the directivity switching antenna 1 is used at the same directivity as that employed during receiving operation. However, the present invention is not limited to this embodiment. During receiving operation, diversity receiving is performed by use of the directivity switching antenna 1. During transmission, the radiation field originating from the directivity switching antenna may be set so as not to propagate toward the user 11 who uses the wireless terminal 12. For example, there may be adopted a configuration of: fixing the directional maximum emission direction of the directivity switching antenna 1 in the backward direction of the wireless terminal 12 during transmission; and fixing, at the time of transmission, the directional maximum emission direction of the directivity switching antenna 1 in the zenith direction of the wireless terminal 12 during data communication.

The present embodiment has described the wireless terminal 12 using the directivity switching antennas 1 described in connection with the first through fourth embodiments. However, the present invention is not limited to the embodiments. An antenna apparatus of any configuration may be used, so long as the directivity of the antenna can be switched between the zenith direction (i.e., the horizontal direction with respect to the display surface of the display section 13 and the upward direction with reference to displayed messages) and the backward direction (the direction opposite the display surface of the display section 13) with respect to the wireless terminal 12 through about 90°.

SIXTH EMBODIMENT

Figure 24:
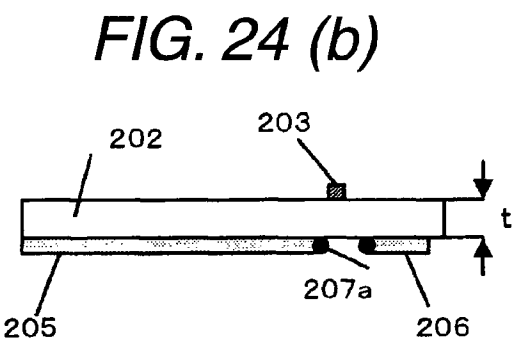
FIGS. 24(*a*) and (*b*) shows a schematic view of a directivity switching antenna according to a sixth embodiment of the present invention.
Figure 24:
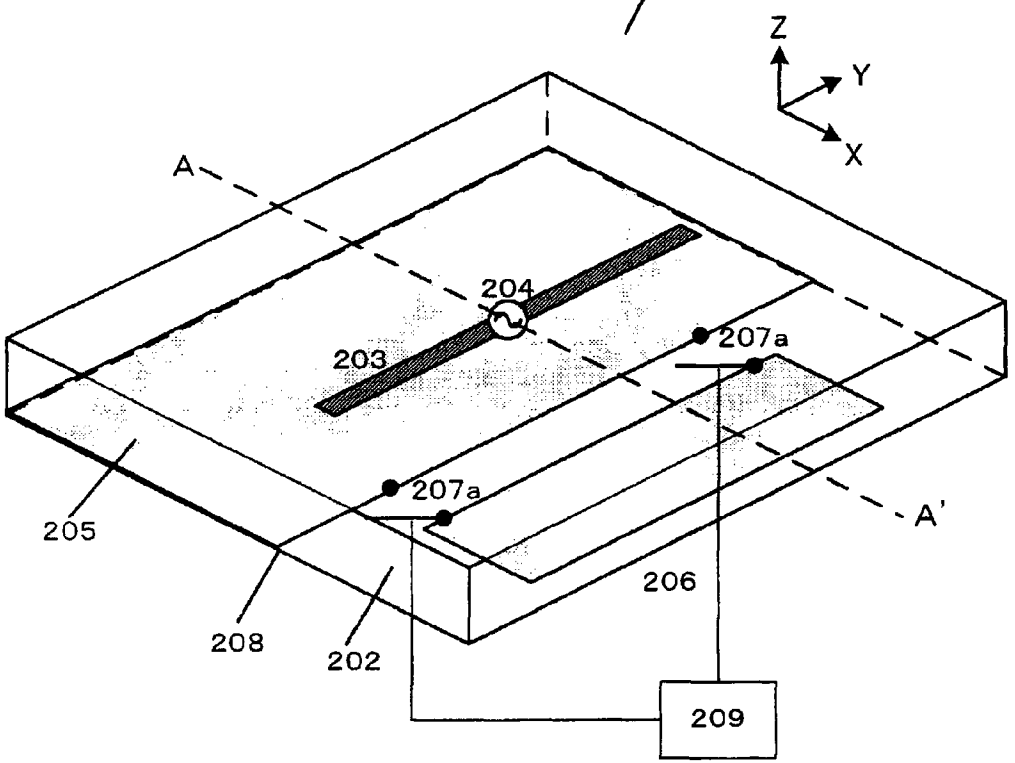

FIG. 24 is a schematic view of a directivity switching antenna according to a sixth embodiment of the present invention. FIG. 24(*a*) is a perspective view, and FIG. 24(*b*) is a cross-sectional profile taken along line A-A' shown in FIG. 24(*a*). In FIG. 24, a directivity switching antenna apparatus comprises a directivity switching antenna 201; a dielectric substrate 202 of thickness "t"; a radiating element 203 which is formed from a linear conductor provided on the dielectric substrate 202 and has a length of L; a feeding point 204; a ground conductor 205 provided on a surface of the dielectric substrate 202 opposite the surface thereof on which the radiating element 203 is provided; a first metal conductor 206 which is provided on the dielectric substrate 202 in plane with the ground conductor 205 and in parallel to the radiating element 203 and which is electrically insulated from the ground conductor 205 and has a length Lm and a width Wm; switches 207*a* interposed between the ground conductor 205 and the first metal conductor 206; an end portion 208 on the part of the ground conductor 205 facing the first metal conductor 206; and a control circuit 209 for controlling short-circuit and opening of the switches 207*a*.

Descriptions will now be provided on the assumption that the radiating element 203, the ground conductor 205, and the first metal conductor 206 are formed on the dielectric substrate 202 from a conductor pattern. Forming these elements on the dielectric substrate 202 leads to the advantage of the ability to miniaturize the antenna apparatus by virtue of shortening a wavelength by means of a dielectric constant and the advantage of the antenna apparatus becoming inexpensive, easily mass-produced, and stable in terms of an antenna characteristic.

Figure 25:
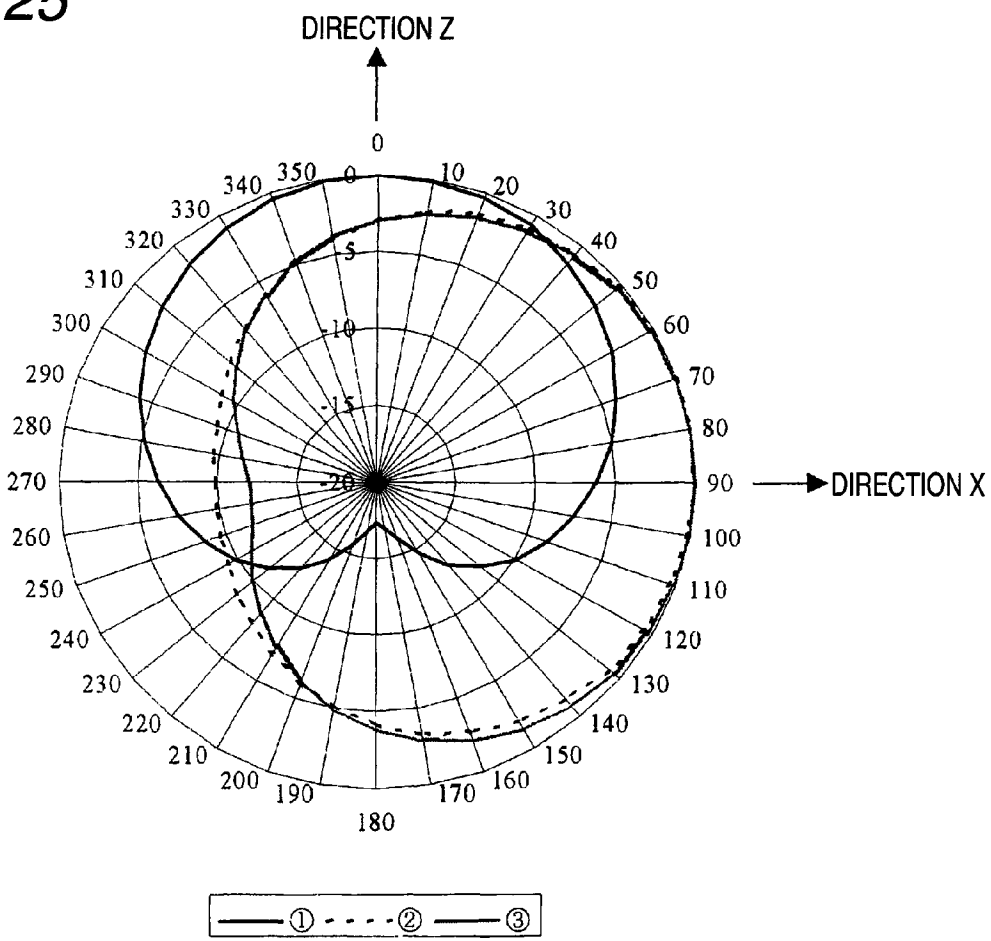
FIG. 25 is the principle of operation for switching directivity of the directivity switching antenna according to the sixth embodiment of the present invention.
Figure 25:
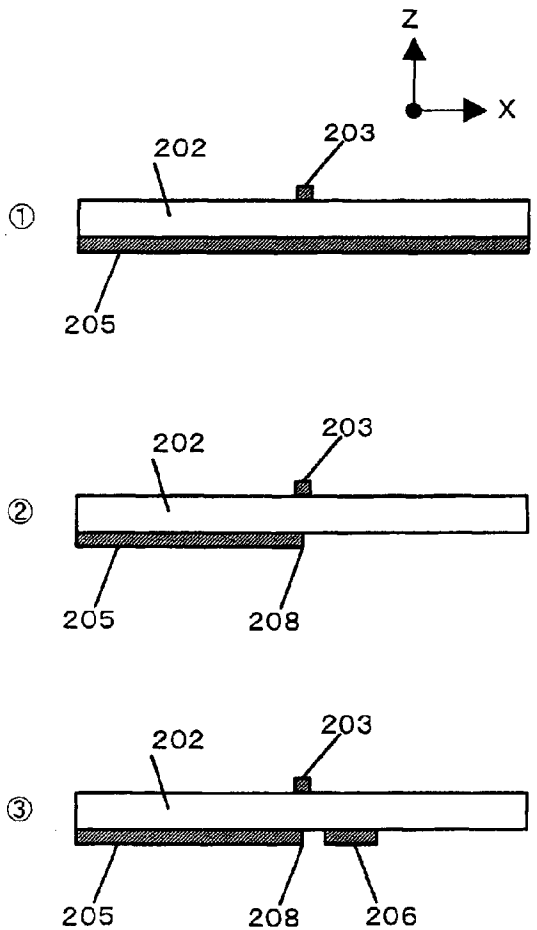

Operation of the directivity switching antenna apparatus according to the sixth embodiment of the present invention will now be described. A high-frequency signal fed from the feeding point 204 is radiated in the air from the radiating element 203. In the present embodiment, the radiating element 203 is described as having the configuration of a dipole. FIG. 25 shows the principle of directivity switching operation of the present invention.

As shown in (1) of FIG. 25(*a*), when the ground conductor 205 is present beneath the radiating element 203, the directivity of the antenna becomes unidirectional and exhibits the maximum radiation direction in the direction +Z direction as shown in (1) of FIG. 25(*b*). Next, as shown in (2) of FIG. 25(*b*), when the ground conductor 205 is not present in an area in the direction +X with reference to the radiating element 203, the antenna becomes unidirectional and exhibits the maximum radiation direction in the direction +X. As shown in (3) of FIG. 25(*a*), even when the first metal conductor 206 is arranged in the direction +X with respect to the radiating element 203 while being electrically isolated from the ground conductor 205, the directivity of the antenna becomes unidirectional and exhibits the maximum radiation direction in the direction +X by means of appropriately adjusting the length Lm and the width Wm of the first metal conductor 206, substantially in the same manner as in the case of (2) of FIG. 25(*b*).

When the ground conductor 205 and the first metal conductor 206 are connected together by means of switches 207*a* and the switches 207*a* are short-circuited, the first metal conductor 206 operates as the ground conductor 205, to thus exhibit directivity where the maximum radiation direction appears in the direction +Z as in the case of (1) of FIG. 25(*b*). Further, when the switches 207*a* are opened, the first metal conductor 206 operates as a director with regard to the radiating element 203. As shown in (3) of FIG. 25(*b*), the antenna exhibits directivity where the maximum radiation direction appears in the direction +X. Therefore, the directivity of the antenna can be switched through about 90° by means of switching actions of the switches 207*a*. In order to switch the directivity of the antenna, the size of the ground conductor 205, the size of the first metal conductor 206, a relative positional relationship between the radiating element 203 and the ground conductor 205, and a relative positional relationship between the radiating element 203 and the first metal conductor 206 become important. Detailed descriptions are given in this regard.

Figure 26:
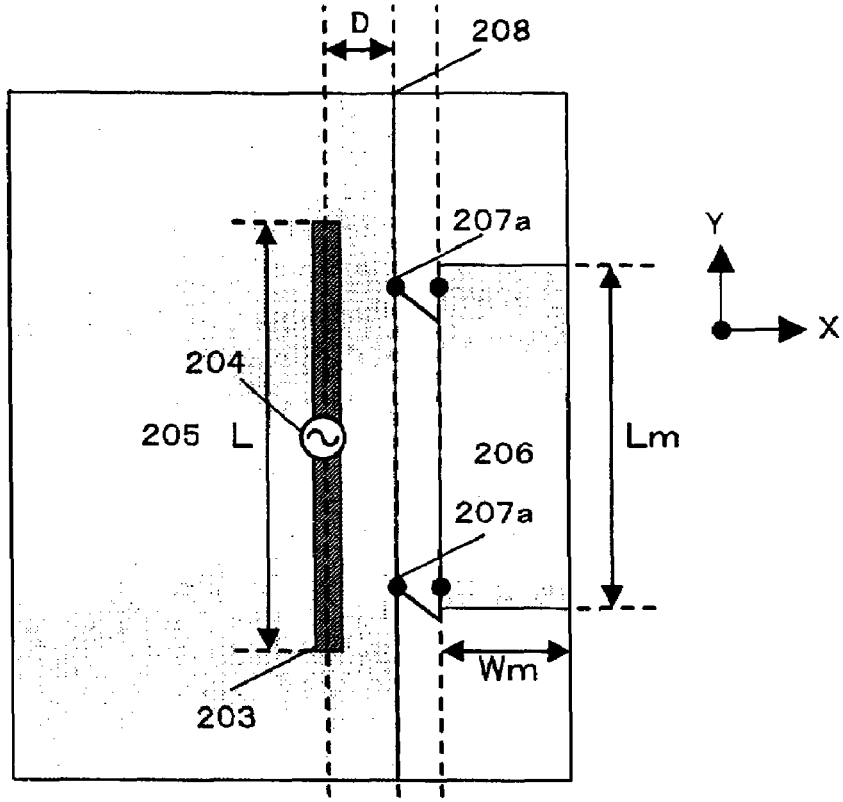
FIGS. 26(*a*) and (*b*) shows an example configuration of the directivity switching antenna according to the sixth embodiment of the present invention.
Figure 26:
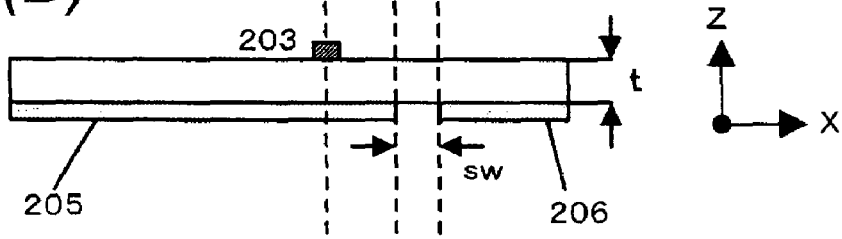

As can be seen from an example configuration of the directivity switching antenna according to the sixth embodiment of the present invention shown in FIG. 26, the length of the radiating element 203 is assumed to be L; the length of the first metal conductor 206 in the direction Y is assumed to be Lm; the width of the same in the direction X is assumed to be Wm; an interval between the radiating element 203 and the end portion 208 on the part of the ground conductor 205, facing the first metal conductor 206, in the direction X is assumed to be D (the direction +X is positive); and an interval between the ground conductor 205 and the first metal conductor 206 is assumed to be sw. At this time, operation of the antenna apparatus varies between the case where the interval D between the radiating element 203 and the end portion 208 on the part of the ground conductor 205, facing the first metal conductor 206, in the direction X is positive or negative. Each of the cases will now be described.

First, consideration is given to the case where the interval D is positive. As shown in FIG. 26, the ground conductor 205 is present beneath the radiating element 203. Hence, when switches 207*a* are short-circuited to thus activate the first metal conductor 206 as a ground conductor, the antenna becomes unidirectional to thus exhibit, in unmodified form, the maximum radiation direction in the direction +Z. In the meantime, in order to orient the maximum radiation direction of the antenna in the direction +X when the switches 207*a* are opened to thus disconnect the first metal conductor 206 from the ground conductor, Lm is set such that the first metal conductor 206 operates as a director with respect to the radiating element 203

Figure 27:
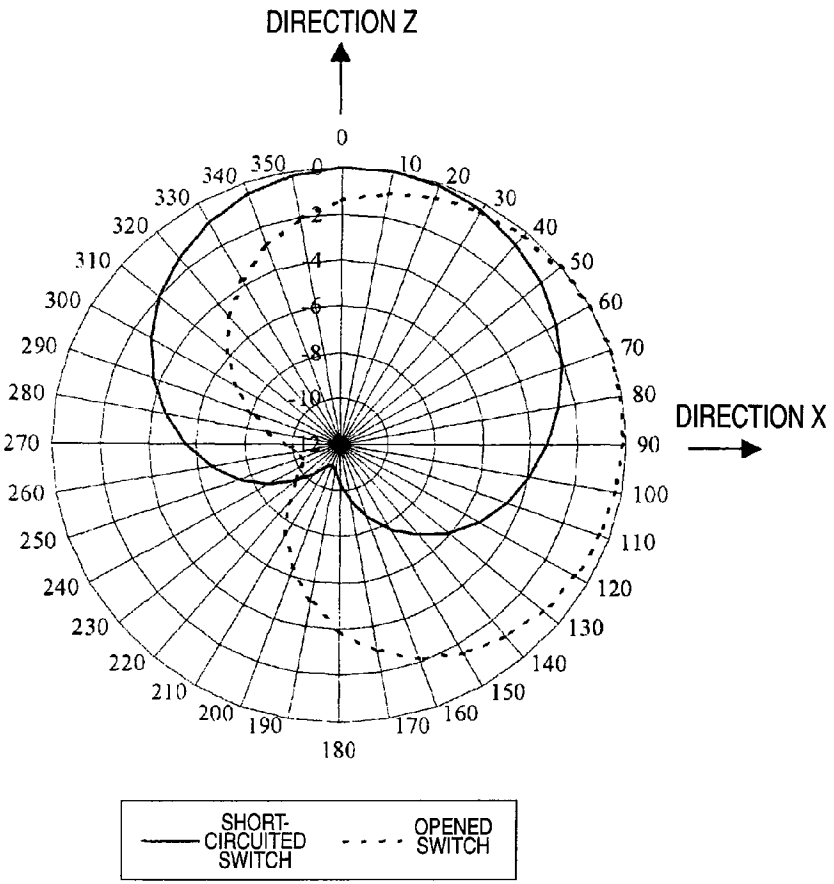
FIG. 27(*a*) is the directivity of the directivity switching antenna of the sixth embodiment of the present invention achieved when the switch is switched; and (b) A view showing example directivity acquired when the length of a first metal conductor of the directivity switching antenna according to the sixth embodiment of the present invention is changed.
Figure 27:
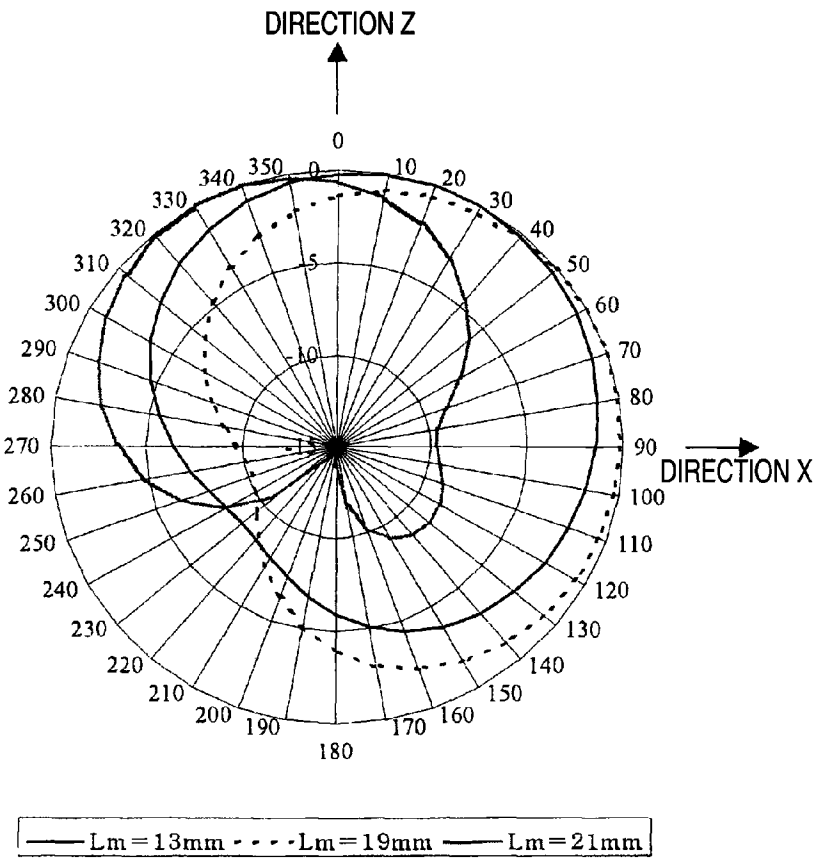

FIG. 27 shows directivity of the directivity switching antenna of the sixth embodiment of the present invention. FIG. 27(*a*) is a view showing directivity acquired when the switches 207*a* are toggled with the radiating element 203 of L=16.5 mm (0.54λ) being provided on the dielectric substrate 202 having a dielectric constant of 3.8 and a thickness t=0.5 mm (0.02λ); the interval D being 2 mm (0.06λ); the length Lm of the first metal conductor 206 being 19 mm (0.62λ); the width Wm of the same being 2 mm (0.06λ); and the interval sw between the ground conductor 205 and the first metal conductor 206 being 1 mm (0.03λ).

Further, FIG. 27(*b*) is a view showing directivity acquired when the switches 207*a* are opened with the length Lm of the first metal conductor 206, among the above parameters, being set to 13 mm (0.42λ) and 21 mm (0.68λ). From FIG. 27(*a*), when the length Lm of the first metal conductor 206 is 19 mm, the directivity of the antenna is switched through about 90° by means of switching action of the switches 207*a*. It is understood that directivity can be switched by the first metal conductor 206 set to a length at which the first metal conductor acts as a director. When the length Lm of the first metal conductor 206 is set to 13 mm and 21 mm as shown in FIG. 27(*b*), the maximum radiation direction of the antenna can be ascertained not to face the direction +X during opening of the switches 207*a*.

Specifically, when the length Lm of the first metal conductor 206 is 13 mm, the length is too short to cause the first metal conductor to sufficiently operate as a director.

Conversely, when the length Lm of the first metal conductor 206 is 21 mm, the first metal conductor 206 is understood to act as a reflector and suppress radiation in the direction +X. This shows that, when the first metal conductor 206 is used as a director, the length thereof must be set so as to fall within a range from about 0.42λ to 0.68λ.

Figure 28:
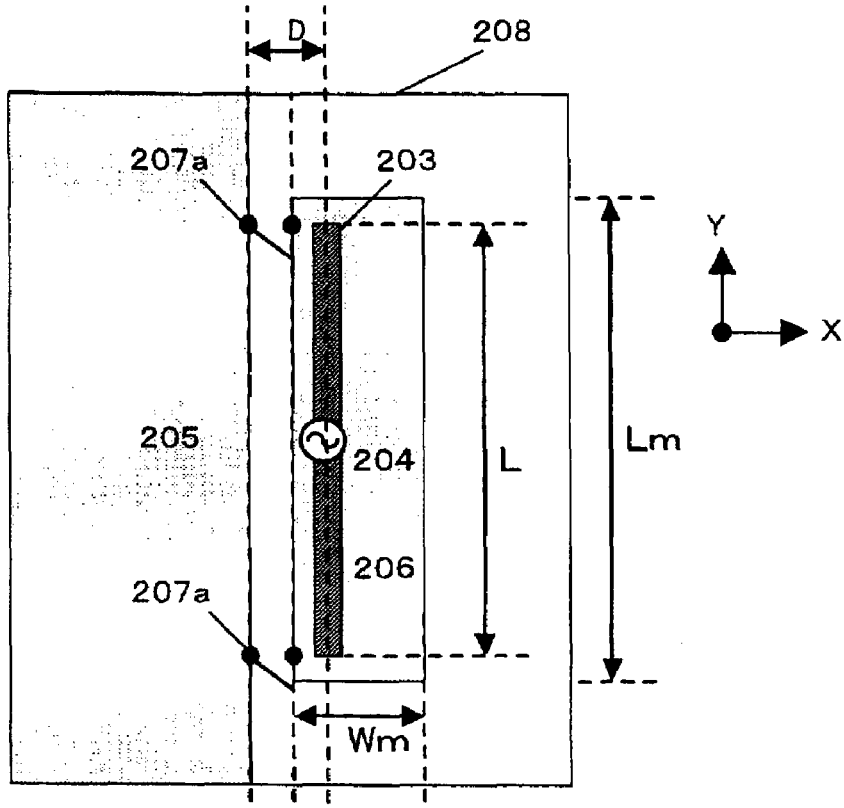
FIGS. 28(*a*) and (*b*) shows an example configuration of the directivity switching antenna according to the sixth embodiment of the present invention.
Figure 28:
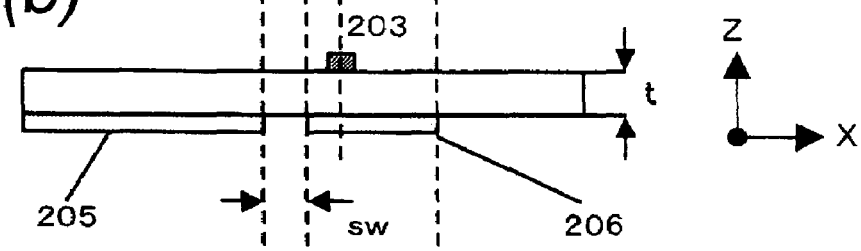

Next, consideration is given to the case where the interval D is negative. As indicated by an example configuration of the directivity switching antenna according to the sixth embodiment of the present invention shown in FIG. 28, the ground conductor 205 is not present beneath the radiating element 203. In order to orient the maximum radiation direction to the direction +Z when the switches 207*a* are short-circuited, there must be adopted a configuration where the first metal conductor 206 is present beneath the radiating element 203. Namely, the sum of the interval sw between the ground conductor 205 and the first metal conductor 206 and the width Wm of the first metal conductor 206 is made greater than the interval D, whereby the first metal conductor 206 can be disposed beneath the radiating element 203.

Figure 29:
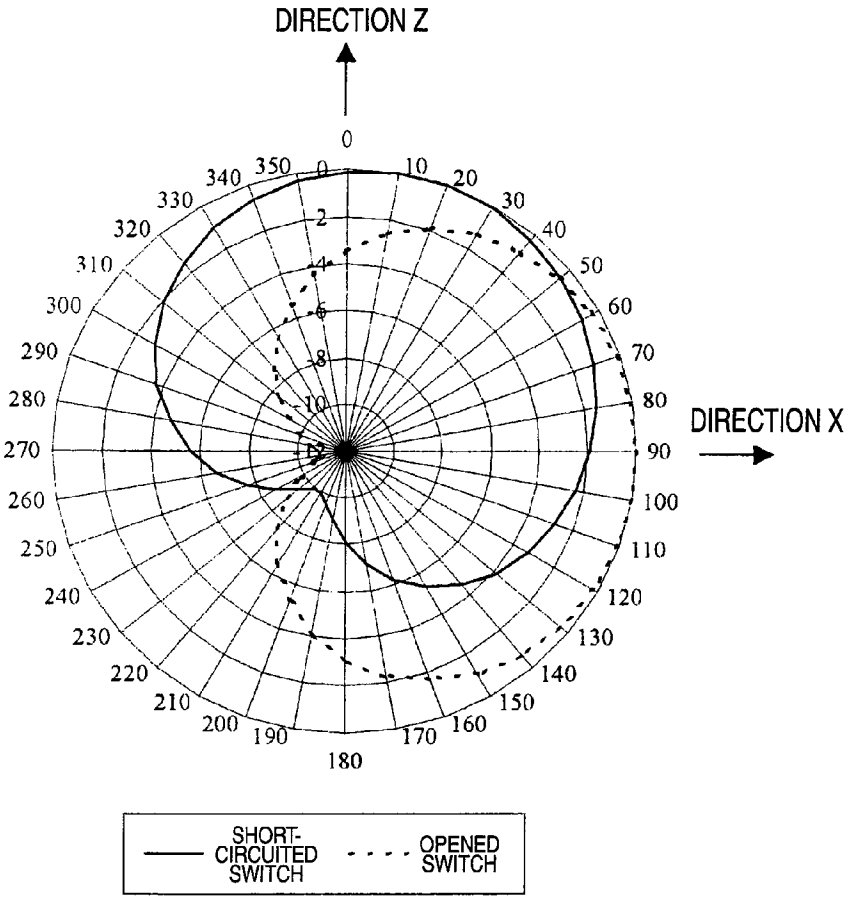
FIG. 29(*a*) Directivity of the directivity switching antenna of the sixth embodiment of the present invention achieved when the switch is switched; and (b) A view showing example directivity acquired when the length of a first metal conductor of the directivity switching antenna according to the sixth embodiment of the present invention is changed.
Figure 29:
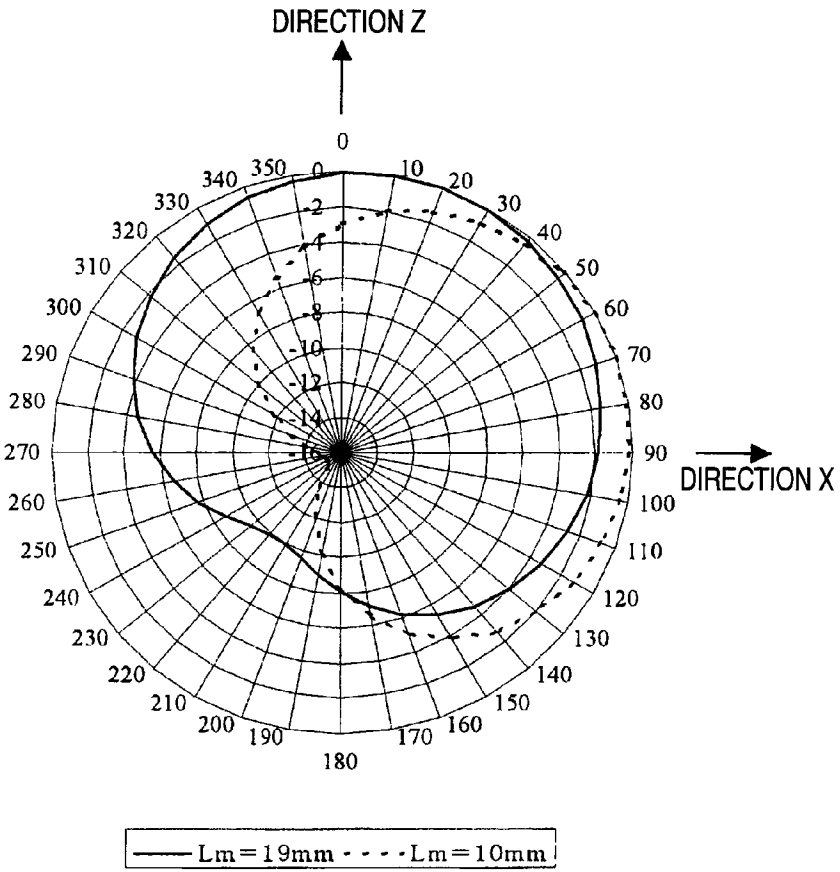

FIG. 29 shows directivity of the directivity switching antenna of the sixth embodiment of the present invention. FIG. 29(*a*) is a view showing directivity acquired when the switches 207*a* are toggled with the radiating element 203 of L=16.5 mm (0.54λ) being provided on the dielectric substrate 202 having a dielectric constant of 3.8 and a thickness t=0.5 mm (0.02λ); the interval D being −2 mm (−0.06λ); the length Lm of the first metal conductor 206 being 19 mm (0.62λ); the width Wm of the same being 4 mm (0.12λ); and the interval sw between the ground conductor 205 and the first metal conductor 206 being 1 mm (0.03λ). Further, FIG. 29(*b*) is a view showing directivity acquired when the switches are short-circuited with the length Lm of the first metal conductor 206, among the parameters, being set to 10 mm (0.32λ) which is shorter than the length L of the radiating element 203.

From FIG. 29(*a*), when the length Lm of the first metal conductor 206 is 19 mm, the directivity of the antenna is understood to have been switched through about 90° by means of switching actions of the switches 207*a*. In the meantime, as shown in FIG. 29(*b*), when the length Lm of the first metal conductor 206 is 10 mm, which is shorter than the radiating element 203, the maximum radiation direction of the antenna can be ascertained not to face the direction +Z during the short-circuiting of the switches 207*a*. Specifically, when the length Lm of the first metal conductor 206 is shorter than the length L of the radiating element 203, the first metal conductor 206 is understood not to sufficiently operate as a ground conductor during the short-circuiting of the switches 207*a*. Consequently, the length Lm of the first metal conductor 206 is preferably longer than the length L of the radiating element 203.

Figure 30:
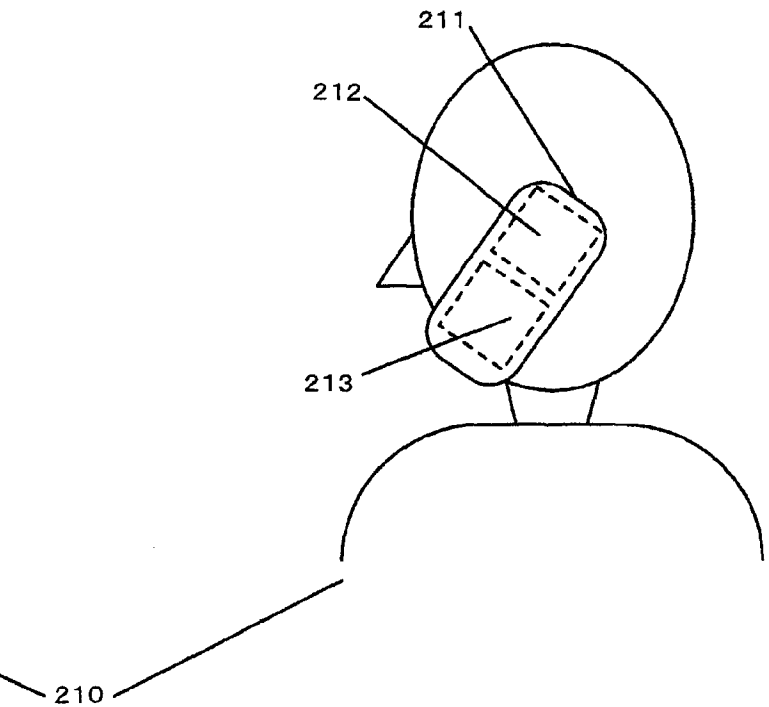
FIGS. 30(*a*) and (*b*) shows a view showing an example positional relationship between a wireless terminal and a user acquired during voice conversation.
Figure 30A:
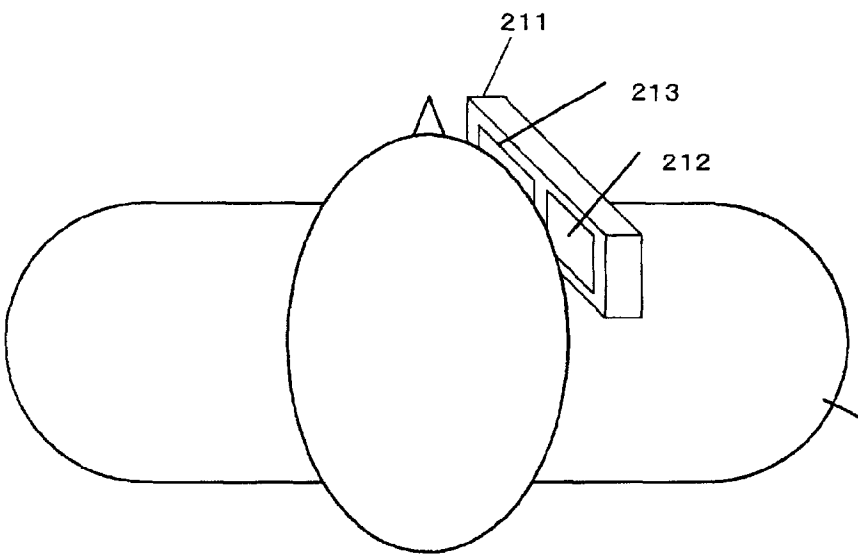
Figure 31:
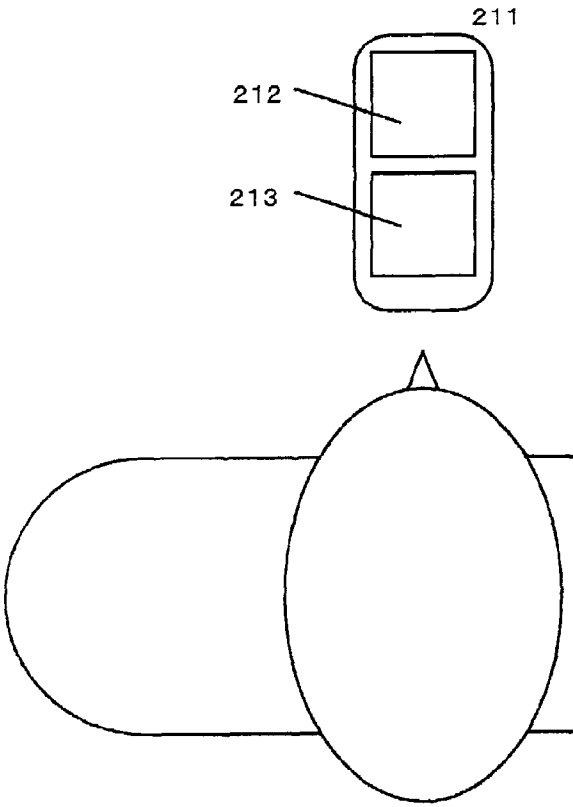
FIGS. 31(*a*) and (*b*) shows a view showing an example positional relationship between a wireless terminal and a user acquired during data communication.
Figure 31:
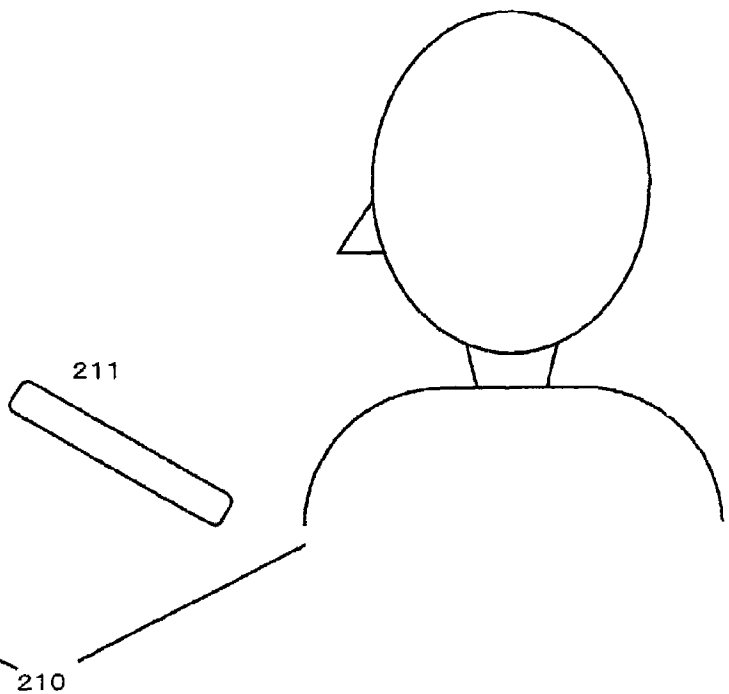

A positional relationship between the user and the wireless terminal achieved during voice conversation and data communication will now be described in detail. FIG. 30 shows an example positional relationship between the wireless terminal and the user achieved during voice conversation. FIG. 31 shows an example positional relationship between the wireless terminal and the user achieved during data communication. When voice conversation is performed, a positional relationship such as that shown in FIG. 30 is assumed to exist between a user 210 and a wireless terminal 211. When data communication is performed, a positional relationship such as that shown in FIG. 31 is assumed to exist between the user 210 and the wireless terminal 211.

Figure 32:
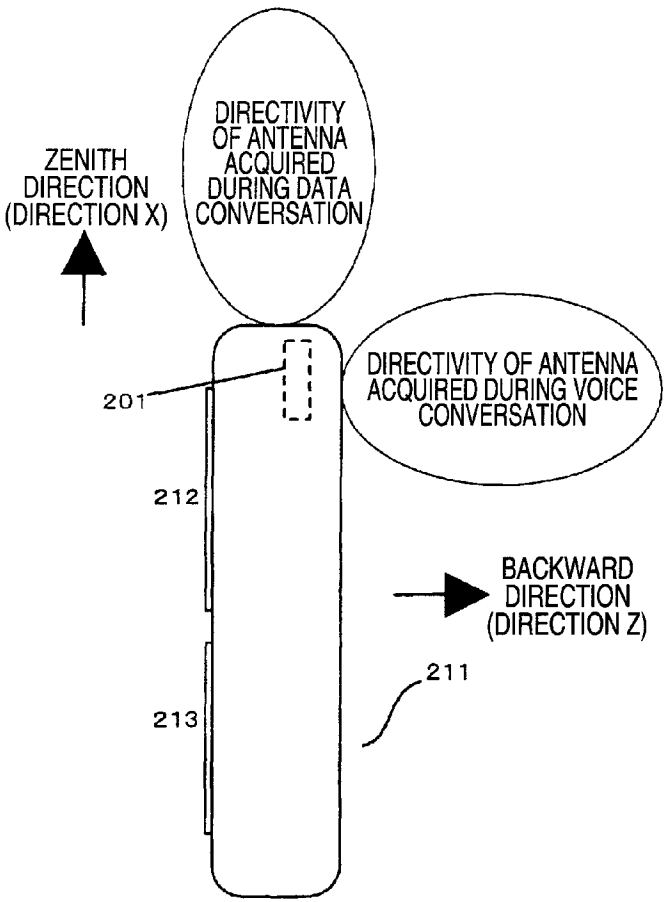
FIG. 32 is a view showing example radiation directivity characteristics of the antenna acquired during voice conversation and data communication.

During voice conversation, the user 210 uses the wireless terminal 211 while placing it adjacent to the side of the user's head. During data communication, the user 210 commonly performs operation by use of an operation section 213 while ascertaining messages appearing on a display section 212 of the wireless terminal 211. Therefore, as shown in FIG. 32, during voice conversation, directivity of the antenna provided in the wireless terminal 211 is preferably switched such that the maximum radiation direction achieved by the directivity of the antenna is oriented toward the back of the wireless terminal 211 (i.e., a direction opposite the display surface of the display section 212). Directivity is also preferably switched such that, during data communication, the maximum radiation direction achieved by the directivity of the antenna comes to the zenith direction of the wireless terminal 211 (i.e., the horizontal direction with respect to the display surface of the display section 212 and an upper direction with displayed messages).

Since the wireless terminal 211 has such a directivity switching function, the radiation field originating from the antenna is not oriented toward the user 210, which in turn results in improvement in SAR and expectations for improved antenna gains. Consequently, a directivity switching antenna 201 is placed in the wireless terminal 212 such that the zenith direction in FIG. 32 is allocated to the direction X and such that the backward direction is allocated to the direction Z, whereby desired directivity characteristics can be attained during voice conversation and data communication.

As above, the directivity switching antenna comprises the radiating element 203 provided on the dielectric substrate 202; the ground conductor 205 disposed on a surface of the dielectric substrate 202 opposite the surface thereof on which the radiating element 203 is provided; the first metal conductor which is provided on the dielectric substrate 202 in plane with the ground conductor 205 and in parallel to the radiating element 203 and is electrically insulated from the ground conductor 205; and the switches 207*a* interposed between the ground conductor 205 and the first metal conductor 206. The switches 207*a* are switched between the short-circuit position and the open position by use of the control circuit 209, so that the directivity of the antenna can be switched through about 90°. There is yielded the advantage of the ability to implement an antenna whose directivity is switched according to a usage pattern of the wireless terminal.

Further, a wireless terminal is configured by use of the directivity switching antenna described in connection with the embodiment. As a result, the directivity of the antenna is switched according to the usage pattern of the wireless terminal, to thus enhance performance of the wireless terminal. Therefore, a highly-reliable wireless communications system can be provided.

The present embodiment has described that the radiating element 203 is formed from the conductor pattern on the dielectric substrate 202. However, the radiating element 203 may also be formed from a linear conductor, such as a wire, or by means of sheeting.

The present embodiment has described that the radiating element 203 is formed into a linear dipole. However, the radiating element 203 is not limited to the linear dipole and may also be formed into, e.g., a meander line.

The present embodiment has described that the radiating element 203, the ground conductor 205, and the first metal conductor 206 are assumed to be formed on the dielectric substrate 202. However, use of the dielectric substrate 202 is not always required. For instance, the radiating element 203, the ground conductor 205, and the first metal conductor 206 may be formed by means of sheeting, and the constituent elements may be fixed by means of a foaming agent.

The length of the first metal conductor 206 is set to a length at which the first metal conductor operates as a director when the switches 207*a* are opened. However, for instance, so long as there is adopted a configuration where the length of the first metal conductor 206 can be changed, directivity can also be changed by means of adjusting a reactance component of the director.

The method for changing the length of the first metal conductor 206 may include dividing the first metal conductor 206, in the lengthwise direction thereof, into a plurality of conductor pieces; placing the switches 207*a* among the respective conductor pieces; and short-circuiting/opening the switches 207*a* to thus change the lengths of the conductor pieces. Alternatively, the method may include adding a variable capacitance element, such as a varactor diode, to the first metal conductor 206, and electrically adjusting the length of the first metal conductor 206 in accordance with the control voltage.

In the present embodiment, the ground conductor 205 and the first metal conductor 206 are formed from a conductor pattern on the side of the dielectric substrate 202 opposite the surface thereof on which the radiating element 203 is provided. However, for instance, the ground conductor 205 and the first metal conductor 206 may be provided not on the dielectric substrate 202 but on the enclosure of the wireless terminal 211 spaced a given distance from the dielectric substrate 202. By adoption of such a configuration, the interval between the radiating element 203 and the ground conductor 205 can be broadly ensured, and there is yielded the advantage of the ability to facilitate matching of the antenna when the ground conductor 205 is present beneath the radiating element 203.

Figure 33:
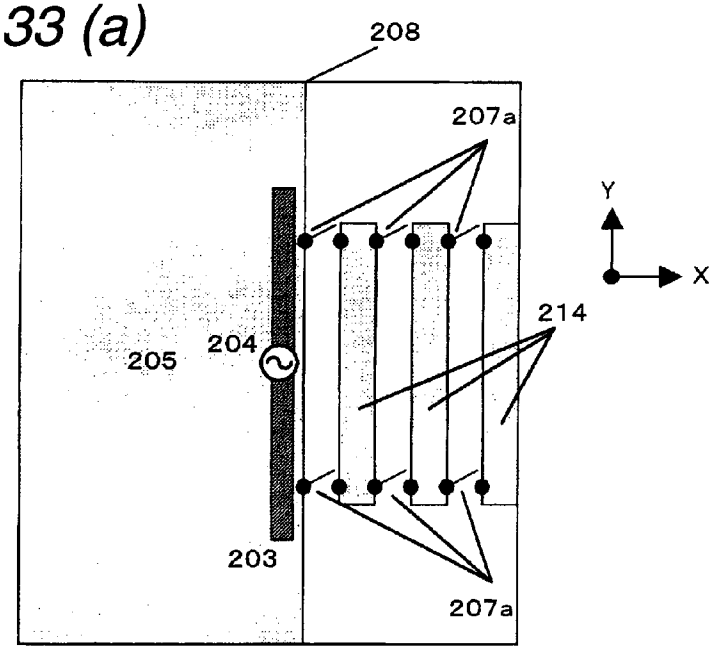
FIGS. 33(*a*) and (*b*) shows an example configuration of the directivity switching antenna according to the sixth embodiment of the present invention.
Figure 33:
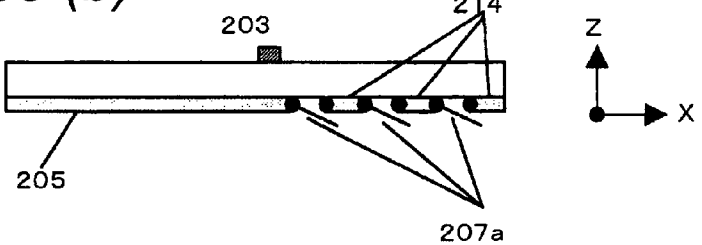

By utilization of the fact that a change arises in directivity during short-circuiting of the switches 207*a* by means of changing the width Wm of the first metal conductor 206, the directivity switching angle of the antenna, which has been switched by means of short-circuiting and opening of the switches 207*a*, can be adjusted. For instance, as illustrated by the example configuration of the directivity switching antenna according to the sixth embodiment of the present invention shown in FIG. 33, there may be adopted a configuration of dividing the first metal conductor 206 into a plurality of conductor pieces 214 with respect to the direction of the X axis and connecting the conductor pieces together by means of the switches 207*a*.

SEVENTH EMBODIMENT

Figure 34:
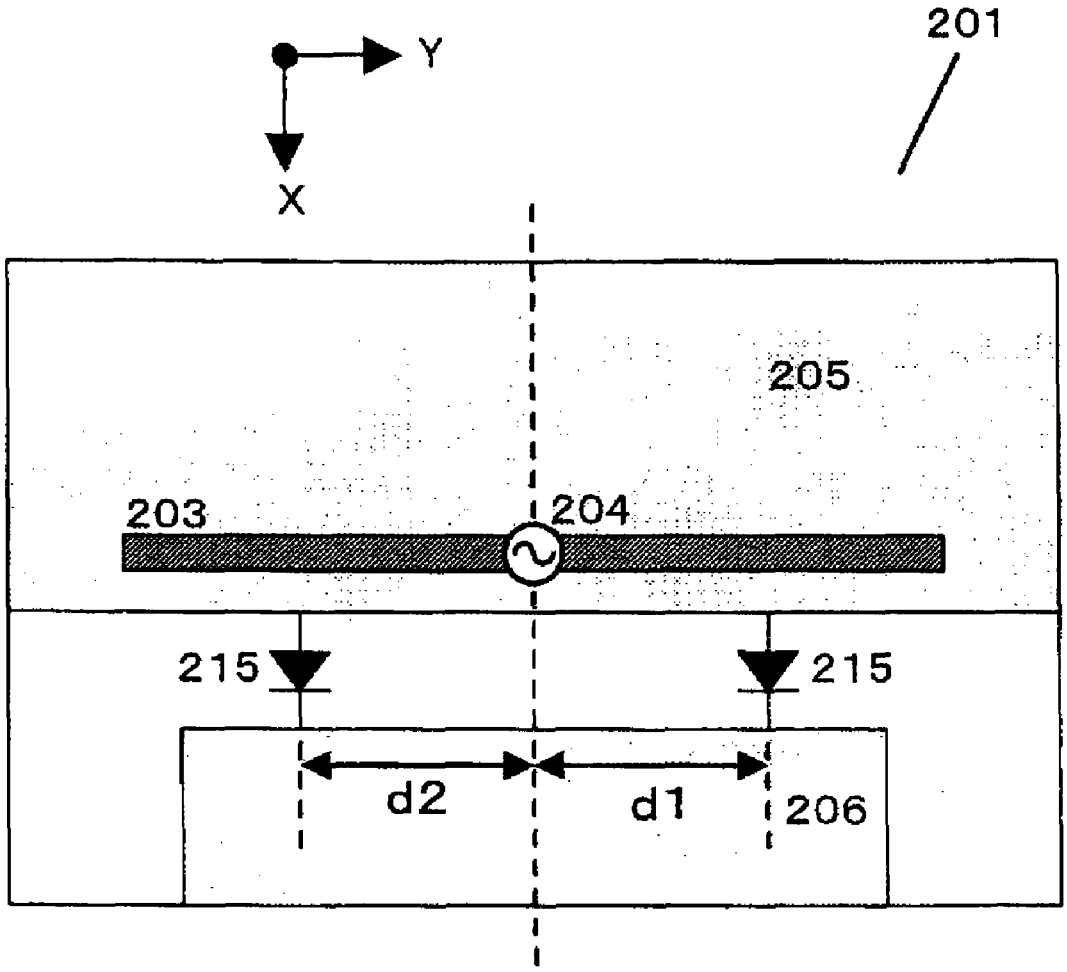
FIG. 34 is a schematic view of a directivity switching antenna according to a seventh embodiment of the present invention.

FIG. 34 is a schematic view of a directivity switching antenna according to a seventh embodiment of the present invention. In FIG. 34, the directivity switching antenna includes diode switches 215. The remainder of the configuration is identical with that of the sixth embodiment, and hence its explanation is omitted.

Operation of the directivity switching antenna according to the seventh embodiment of the present invention will be described hereinbelow. Since the basic operation of the antenna is the same as that described in connection with the sixth embodiment, its explanations are omitted. As shown in FIG. 34, the ground conductor 205 and the first metal conductor 206 are connected at a plurality of locations by means of the diode switches 215.

By means of such a configuration, when the diode switches 215 are short-circuited, the first metal conductor 206 operates as the ground conductor 205, and directivity of the antenna is oriented in the direction +Z. When the diode switches 215 are opened, the first metal conductor 206 operates as a director with respect to the radiating element 203, and the directivity of the antenna is oriented in the direction +X. The directivity of the antenna can be changed through about 90° by means of switching actions of the diode switches 215. However, at this time, the directivity characteristic is affected by the positions where the diode switches 215 are mounted. Detailed descriptions are given in this regard.

Figure 35:
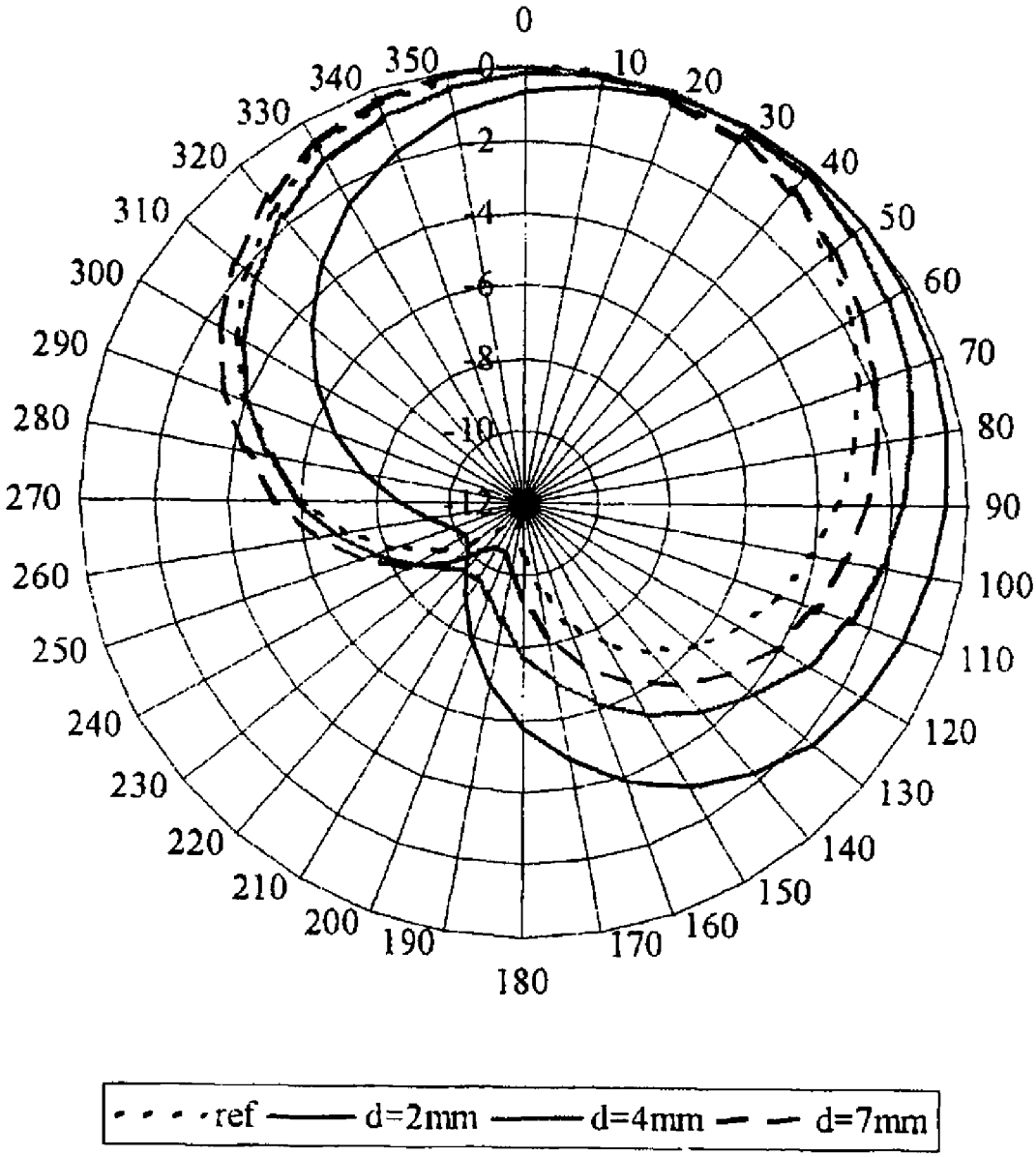
FIG. 35 is a directivity of switches disposed symmetrically with respect to the lengthwise direction of a radiating element in the directivity switching antenna according to the seventh embodiment of the present invention.

Consideration is given to a case where the two diode switches 215 are mounted while being displaced from the feeding point 204 in the respective directions ±Y by d1, d2. FIG. 35 is a view showing that, on condition that the radiating element 203 of L=16.5 mm (0.54λ) is provided on the dielectric substrate 202 having a dielectric constant of 3.8 and a thickness t=0.5 mm (0.02λ); the first metal conductor 206 has a length Lm=19 mm (0.62λ) and a width Wm=4 mm (0.12λ); and the interval sw between the ground conductor 205 and the first metal conductor 206 is 1 mm (0.03λ) and that mount positions of the diode switches 215 are set to d1=d2=d and "d" is changed, directivity acquired when the diode switches 215 are short-circuited.

In FIG. 35, ref shows a state where the ground conductor 205 and the first metal conductor 206 are in complete electrical connection with each other in an ideal manner. When d=2 mm, directivity is not oriented in the direction +Z. Even when the diode switches 215 are short-circuited, the first metal conductor 206 is understood not to operate as the ground conductor 205. However, when "d" is increased to d=7 mm where the mount positions of the diode switches 215 come substantially to locations beneath the respective ends of the radiating element 203, directivity becomes substantially equivalent to ref. It can be ascertained that a unidirectional characteristic exhibiting the maximum radiation direction in the direction +Z has been acquired.

Both ends of the radiating element 203 are located at an area where the highest electrical potential is achieved. By means of electrically connecting the ground conductor 205 to the first metal conductor 206 in the vicinity of this area, there is achieved a state substantially equivalent to an ideal, complete electrical connection. Hence, the mount positions of the diode switches 205 are desirably set to locations below the high electrical potential area of the radiating element 203.

As above, the two diode switches 215 are interposed between the ground conductor 205 and the first metal conductor 206, and the mount positions of the diode switches 215 are set in the vicinity of the high potential area of the radiating element 203, whereby the directivity of the antenna can be switched through about 90° by means of short-circuiting and opening the switches. Accordingly, there is yielded an advantage of the ability to implement an antenna whose directivity is switched according to the usage pattern of the wireless terminal.

Moreover, as a result of the wireless terminal being constituted by use of the directivity switching antenna described in connection with the present embodiment, the wireless terminal is configured by use of the directivity switching antenna described in connection with the embodiment. Directivity of the antenna is switched according to a usage pattern of the wireless terminal, whereby the performance of the wireless terminal can be enhanced. There can be provided a highly-reliable wireless communications system.

The present embodiment has described that the radiating element 203 is formed from the conductor pattern on the dielectric substrate 202. However, the radiating element 203 may also be formed from a linear conductor, such as a wire, or by means of sheeting.

The present embodiment has described that the radiating element 203 is formed into a linear dipole. However, the radiating element 203 is not limited to the linear dipole but may also be formed into, e.g., a meander line.

The present embodiment has described that the radiating element 203, the ground conductor 205, and the first metal conductor 206 are assumed to be formed on the dielectric substrate 202. However, use of the dielectric substrate is not always required. For instance, the radiating element 203, the ground conductor 205, the first metal conductor 206, and the like, may be formed by means of sheeting, and the constituent elements fixed by means of a foaming agent.

The present embodiment has described that the ground conductor 205 is formed from a conductor pattern on the side of the dielectric substrate 202 opposite the surface thereof where the radiating element 203 is formed. For instance, the ground conductor 205 may be provided on an enclosure of the wireless terminal 211 that is spaced from the dielectric substrate 202 by a given distance. By means of such a configuration, there is yielded the advantage of the ability to broadly ensure an interval between the radiating element 203 and the ground conductor 205 and to easily effect matching of the antenna when the ground conductor 205 is present beneath the radiating element 203.

In the present embodiment, the diode switches 215 are used as switching elements. However, the switching elements are not limited to the diode switches. Other switches, such as FET switches or switches using the MEMS technique, or other switching circuits may alternatively be used.

Figure 36:
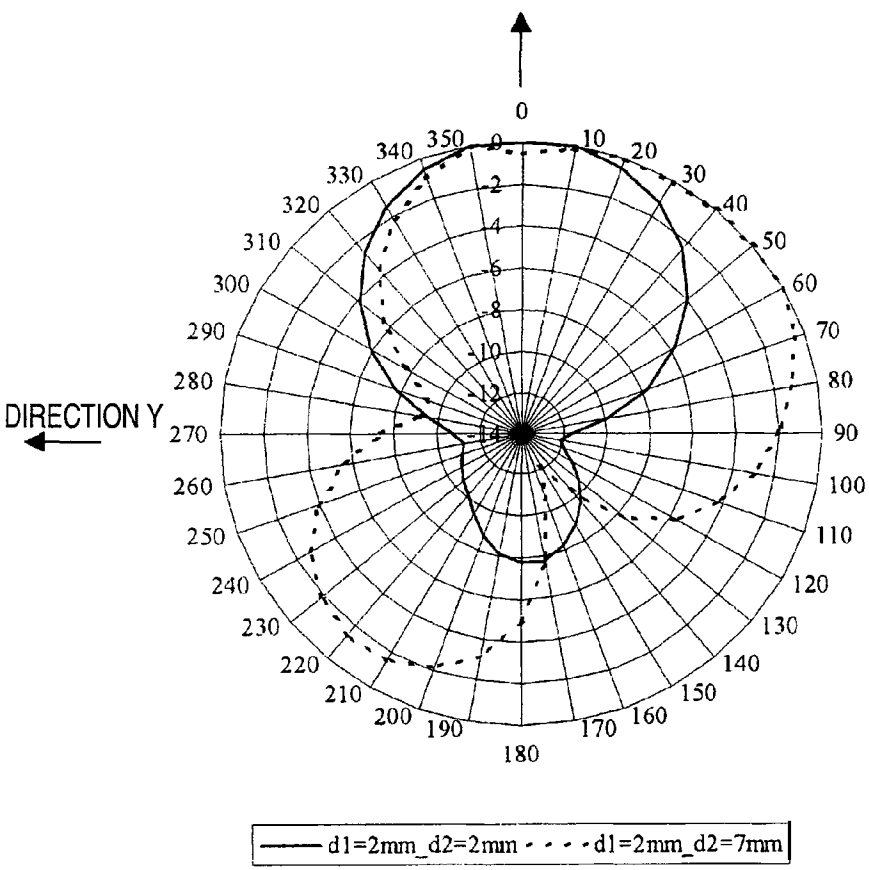
FIGS. 36(*a*) and (*b*) shows the directivity of switches disposed asymmetrically with respect to the lengthwise direction of a radiating element in the directivity switching antenna according to the seventh embodiment of the present invention.
Figure 36:
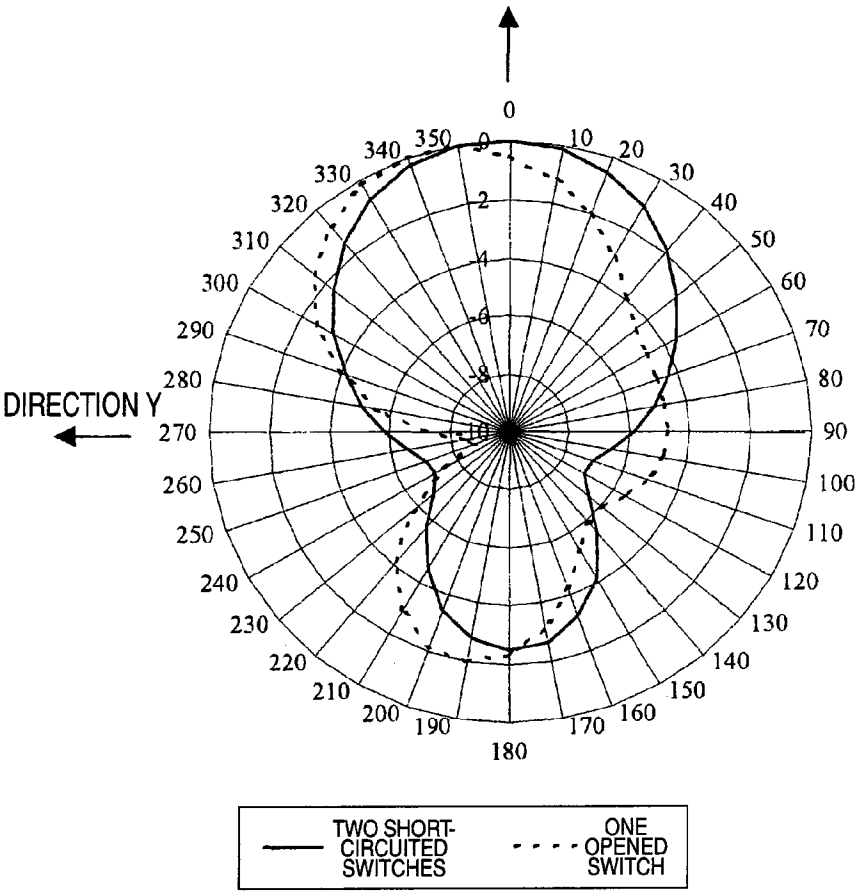

The present embodiment has described a case where the two diode switches 215 are arranged so as to become symmetrical about the lengthwise direction of the radiating element 203, but d1 and d2 may be arranged in different lengths. FIG. 36(*a*) shows directivities acquired within the plane XY when d2 is set to 2 mm and 7 mm, respectively, on condition that d1 is equal to 2 mm.

As can be seen from FIG. 36(*a*), directivity within the plane XY can be adjusted by means of changing the distance between d1 and d2. Further, even when one of the diode switches 215 is short-circuited and the other is opened, directivity within the plane XY can be adjusted. FIG. 36(*b*) is a view showing directivity within the plane XY acquired when d1=d2=7 mm is set in FIG. 34; when one of the diode switches 215 is short-circuited; and when the other diode switch is opened. From FIG. 36(*b*), it is understood that one of the diode switches 215 is opened, whereby the electromagnetic field becomes asymmetrical with respect to the lengthwise direction of the radiating element 203; and that the maximum radiating direction of directivity is displaced from the direction of the X axis within the plane XY. Directivity can be three-dimensionally adjusted by utilization of these facts.

The present embodiment has described the case where the two diode switches 215 are used. However, the number of diode switches is not necessarily limited to two. Needless to say, there may be adopted a configuration where two or more diode switches are interposed between the ground conductor 205 and the first metal conductor 206. Directivity within the plane XY can be controlled more accurately by means of increasing the number of switches.

By means of changing the width Wm of the first metal conductor 206, the directivity switching angle of the antenna, which is acquired when the diode switches 215 are switched by means of short-circuiting or opening, can be adjusted. For instance, there may be adopted a configuration where the first metal conductor 206 is divided into a plurality of conductor pieces 214 with respect to the direction of the X axis and the conductor pieces are connected together by means of switches 207*a*.

EIGHTH EMBODIMENT

Figure 37B:
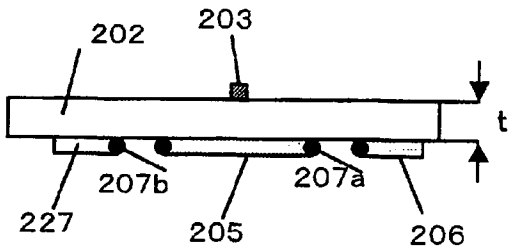
FIGS. 37(*a*) and (*b*) shows a schematic view of a directivity switching antenna according to an eighth embodiment of the present invention.
Figure 37A:
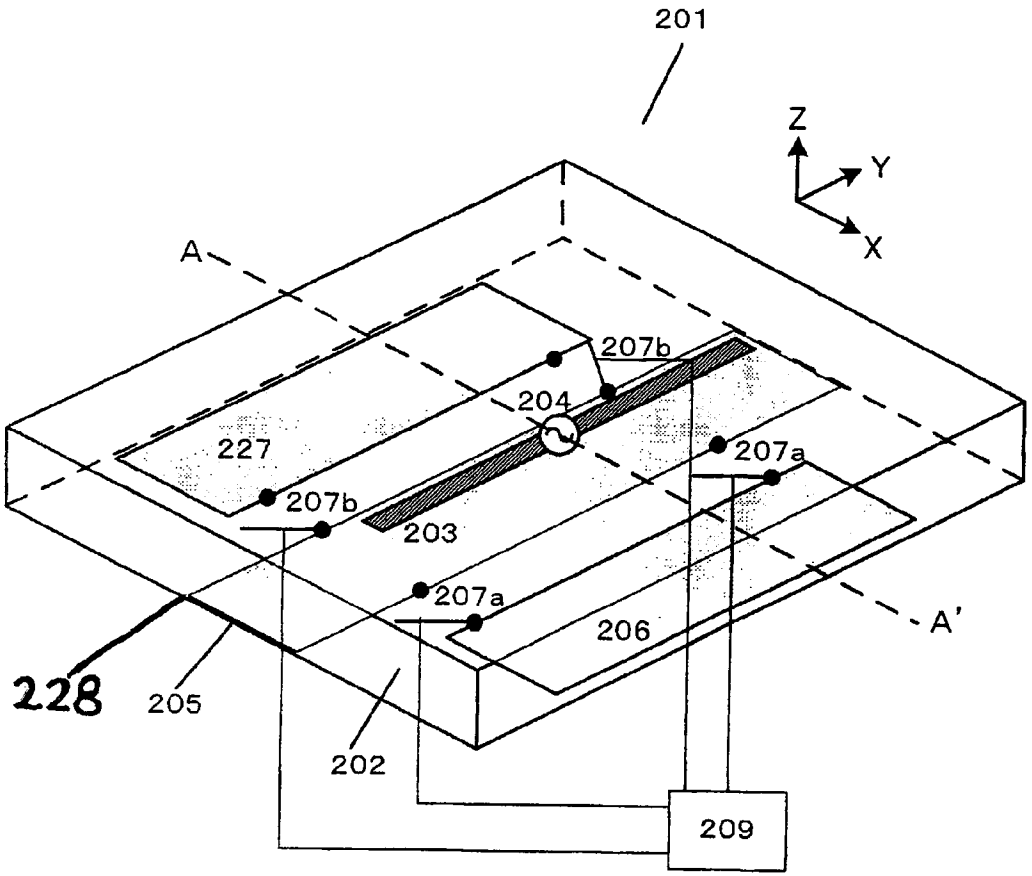

FIG. 37 is a schematic view of a directivity switching antenna according to an eighth embodiment of the present invention. FIG. 37(*a*) is a perspective view, and FIG. 37(*b*) is a cross-sectional profile taken along line A-A' shown in FIG. 37(*a*). In FIG. 37, a second metal conductor 227 is placed in plane with the ground conductor 205 on the dielectric substrate 202. The second metal conductor 227 is formed so as to assume a length Lm and a width Wm and to be electrically insulated from the ground conductor 205 such that the second metal conductor is placed in parallel to the radiating element 203 and symmetrical with the first metal conductor 206 with respect to the Y axis. The second metal conductor 227 includes switches 207*b* which are interposed between the second metal conductor 227 and the end portion 228 of the ground conductor 205 facing the second metal conductor 227. In other respects, the present embodiment is identical with the sixth embodiment, and hence its explanation is omitted here for brevity.

Operation of the directivity switching antenna apparatus according to the eighth embodiment of the present invention will be described hereunder. Since the basic operation is the same as that described in connection with the first embodiment, its explanation is omitted. The second metal conductor 227 is arranged, with respect to the ground conductor 205 and symmetrically to the first metal conductor with respect to the Y axis.

At this time, the switches 207*a*, 207*b* are controlled by use of the control circuit 209, to thus switch directivity. Detailed descriptions are given in this regard.

FIG. 38 shows a relationship between operation for short-circuiting and opening the switches 207*a*, 207*b* and the directivity of the antenna. When both the switches 207*a*, 207*b* are short-circuited, the first metal conductor 206 and the second metal conductor 227 constitute a portion of the ground conductor 205. Hence, the directivity of the antenna is oriented in the direction +Z in FIG. 37. Next, when the switch 207*b* is short-circuited and the switch 207*a* is opened, the first metal conductor 206 acts as a director, and the second metal conductor 227 operates as a part of the ground conductor 205. Accordingly, the directivity of the antenna is oriented in the direction +X in FIG. 37.

When the switch 207*a* is short-circuited and the switch 207*b* is opened, the first metal conductor 206 constitutes a part of the ground conductor 205, and the second metal conductor 227 operates as a director. Hence, the directivity of the antenna is oriented in the direction −X shown in FIG. 37. When both the switches 207*a*, 207*b* are opened, the metal conductors 206, 227 operate as directors. However, a substantially omnidirectional characteristic is acquired as the directivity of the antenna.

As above, the second metal conductor 227 is provided symmetrical with the first metal conductor 206 with respect to the Y axis. The first metal conductor 206 and the second metal conductor 227 are controlled by use of the control circuit 209 such that the metal conductors are switched between the director and the ground conductor by means of switching actions of the switches 207*a*, 207*b*. Thereby, the directivity of the antenna can be switched at intervals of 90° in the directions ±X and the direction +Z. Hence, there is yielded the advantage of the ability to implement an antenna apparatus which switches directivity by means of selecting the direction ±X opposite the direction toward the user even when, e.g., the wireless terminal is arranged such that the radiation direction is oriented to the user according to the usage pattern of the wireless terminal during data communication.

Further, so long as the antenna of such a configuration is provided on a car, directivity can be switched back and forth even when the direction of the car has changed. Hence, there is yielded the advantage of the ability to receive a terrestrial digital broadcast.

Moreover, the wireless terminal is configured by use of the directivity switching antenna described in connection with the embodiment, so that the performance of the wireless terminal can be enhanced by means of switching the directivity of the antenna according to the usage pattern of the wireless terminal. A highly-reliable wireless communications system can be provided.

The present embodiment has described that the radiating element 203 is formed from the conductor pattern on the dielectric substrate 202. However, the radiating element 3 may also be formed from a linear conductor, such as a wire, or by means of sheeting.

The present embodiment has described that the radiating element 203 is formed into a linear dipole. However, the radiating element 203 is not limited to the linear dipole but may also be formed into, e.g., a meander line.

The present embodiment has described that the radiating element 203, the ground conductor 205, the first metal conductor 206, and the second metal conductor 227 are assumed to be formed on the dielectric substrate 202. However, use of the dielectric substrate is not always required. For instance, the radiating element 203, the ground conductor 205, the first metal conductor 206, the second metal conductor 227, and the like, may be formed by means of sheeting, and the constituent elements fixed by means of a foaming agent.

The present embodiment has described that the ground conductor 205 is formed from a conductor pattern on the side of the dielectric substrate 202 opposite the surface thereof where the radiating element 203 is formed. For instance, the ground conductor 205 may be provided on an enclosure of the wireless terminal 211 that is spaced from the dielectric substrate 202 by a given distance. By means of such a configuration, there is yielded the advantage of the ability to broadly ensure an interval between the radiating element 203 and the ground conductor 205 and to easily effect matching of the antenna when the ground conductor 205 is present beneath the radiating element 203.

In the present embodiment, the diode switches 215 are used as switching elements. However, the switching elements are not limited to the diode switches. Other switches, such as FET switches or switches using the MEMS technique, or other switching circuits may also be used.

The first metal conductor 206 and the second metal conductor 227 are set to a length at which the first and second metal conductors operate as a director when the switches 207*a*, 207*b* are opened. However, for instance, so long as there is adopted a configuration where the length of the first metal conductor 206 and that of the second metal conductor 227 can be changed, directivity can also be changed by means of adjusting a reactance component of the director.

The method for changing the length of the first metal conductor 206 and the length of the second metal conductor 227 may include dividing the first and second metal conductors 206 and 227, in the lengthwise direction thereof, into a plurality of conductor pieces; placing the switches 207*a*, 207*b* among the respective plurality of conductor pieces; and short-circuiting/opening the switches 207*a*, 207*b* to thus change the lengths of the conductor pieces. Alternatively, the method may include adding a variable capacitance element, such as a varactor diode, to the first and second metal conductors 206, 227, and electrically adjusting the lengths of the first and second metal conductors 206, 207 in accordance with the control voltage.

By utilization of the phenomenon of directivity achieved at the time of short-circuiting of the switches 207*a*, 207*b* being changed by means of changing the width Wm of the first and second metal conductors 206, 227, the directivity switching angle of the antenna, which has been acquired by means of toggling the switches 207*a*, 207*b* through short-circuiting and opening operations, can be adjusted.

NINTH EMBODIMENT

Figure 39:
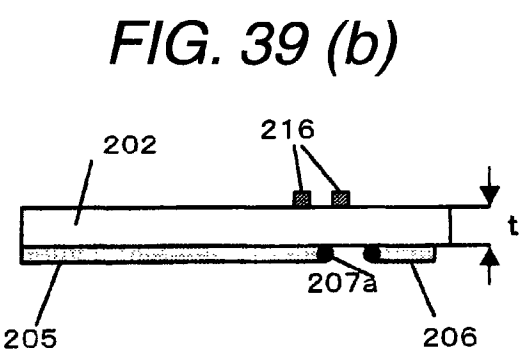
FIGS. 39(*a*) and (*b*) shows a schematic view of a directivity switching antenna according to a ninth embodiment of the present invention.
Figure 39:
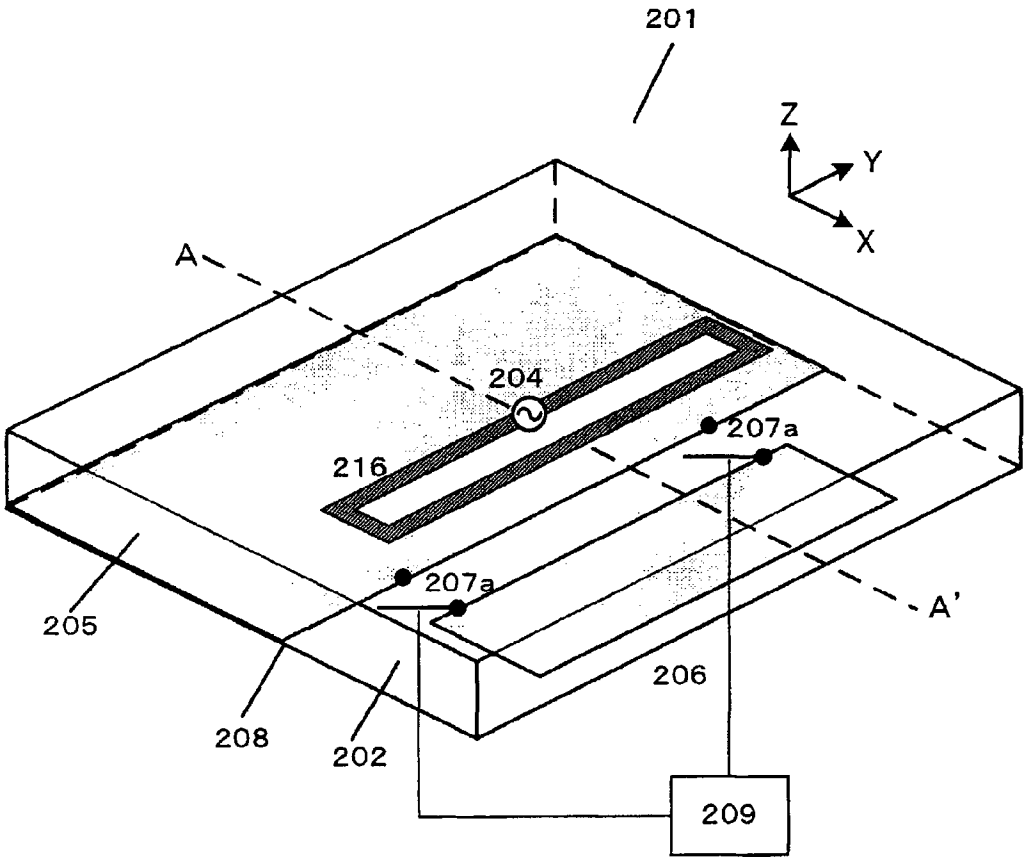

FIG. 39 is a schematic view of a directivity switching antenna according to a ninth embodiment of the present invention. FIG. 39(*a*) is a perspective view, and FIG. 39(*b*) is a cross-sectional profile taken along line A-A' shown in FIG. 39(*a*). In FIG. 39, the directivity switching antenna includes a radiating element 216 having a folded structure. In other respects, the present embodiment is identical with the sixth embodiment, and hence its explanation is omitted here for brevity.

Operation of the directivity switching antenna apparatus according to the ninth embodiment of the present invention will now be described. For instance, in FIG. 24, the dielectric substrate 202 having a thickness of "t"=0.016λ is interposed between the radiating element 203 and the ground conductor 205 such that the radiating element 203 and the ground conductor 205 are separated from each other by the amount corresponding to a thickness "t"=0.016λ. Thus, when the ground conductor 205 is placed in the vicinity of the radiating element 203, the input impedance of the radiating element 203 has become drastically smaller than that achieved in a state where the ground conductor 205 is not provided.

Figure 40:
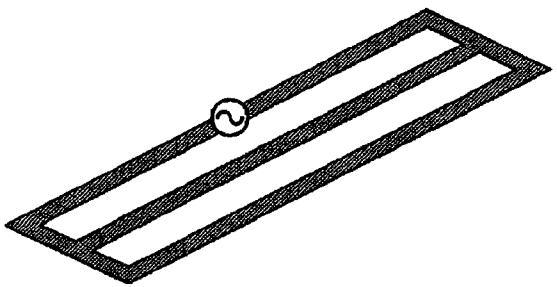
FIGS. 40(*a*) to (*c*) shows a view showing an example configuration of a radiating element having structures folded within an X-Y plane in the directivity switching antenna according to the ninth embodiment of the present invention.
Figure 40:
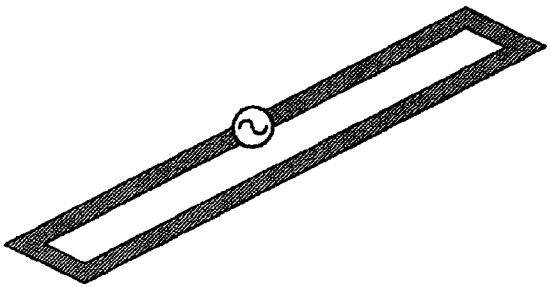
Figure 40:
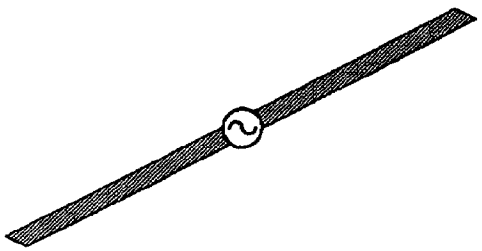

When the radiating element 203 is configured to have such a folded structure as that of the radiating element 216, the input impedance of the radiating element can be increased. For instance, the input impedance of a double folded dipole such as that shown in FIG. 40(*b*) becomes quadruple the input impedance of a common dipole antenna shown in FIG. 40(*a*). The input impedance of a triple-folded dipole antenna shown in FIG. 40(*c*) becomes eight times the input impedance of the common dipole antenna. As a result of use of the radiating element 216 having a folded structure as shown in FIG. 39, input impedance of the antenna acquired at the feeding point 204 can be increased, thereby facilitating matching of the antenna with a 50Ω-based microstrip line or coaxial line.

As above, the radiating element 216 is provided with a folded structure, and the switches 207*a* are toggled by use of the control circuit 209. As a result, there is yielded the advantage of the ability to realize an antenna apparatus which increases input impedance of the antenna to thus facilitate matching while switching the directivity of the antenna through about 90° and which switches directivity according to a usage pattern of the wireless terminal.

Moreover, a wireless terminal is configured by use of the directivity switching antenna apparatus described in connection with the present embodiment. Hence, the directivity of the antenna is switched according to the usage pattern of the wireless terminal, to thus enhance the performance of the wireless terminal. Thus, a highly-reliable wireless communications system can be provided.

The present embodiment has described that the radiating element 216 is formed from a conductor pattern on the dielectric substrate 202. However, the radiating element 216 may also be formed from a linear conductor, such as a wire, or by means of sheeting.

The present embodiment has described that the radiating element 216 is formed into a linear dipole. However, the radiating element 216 is not limited to the linear dipole but may also be formed into, e.g., a meander line.

The present embodiment has described that the radiating element 216, the ground conductor 205, and the first metal conductor 206, are assumed to be formed on the dielectric substrate 202. However, use of the dielectric substrate is not always required. For instance, the radiating element 216, the ground conductor 205, the first metal conductor 206, and the like, may be formed by means of sheeting, and the constituent elements fixed by means of a foaming agent.

In the present embodiment, the ground conductor 205 is formed from a conductor pattern on the side of the dielectric substrate 202 opposite the surface thereof where the radiating element 216 is formed. For instance, the ground conductor 205 may be provided not on the dielectric substrate 202 but on an enclosure of the wireless terminal 211 that is spaced from the dielectric substrate 202 by a given distance. By means of such a configuration, there is yielded the advantage of the ability to broadly ensure an interval between the radiating element 216 and the ground conductor 205 and to easily effect matching of the antenna.

In the present embodiment, the radiating elements 203 216 are formed into a two-dimensional structure within the XY plane. However, the radiating elements 203, 216 are not limited to this structure. As shown in, e.g., FIGS. 41(*a*), (*b*), the radiating element 203, 216 may be formed into a structure where ends of the radiating elements 203, 216 are folded. By means of such a folded structure, the antenna length can be shortened, and the antenna can be miniaturized.

Figure 41:
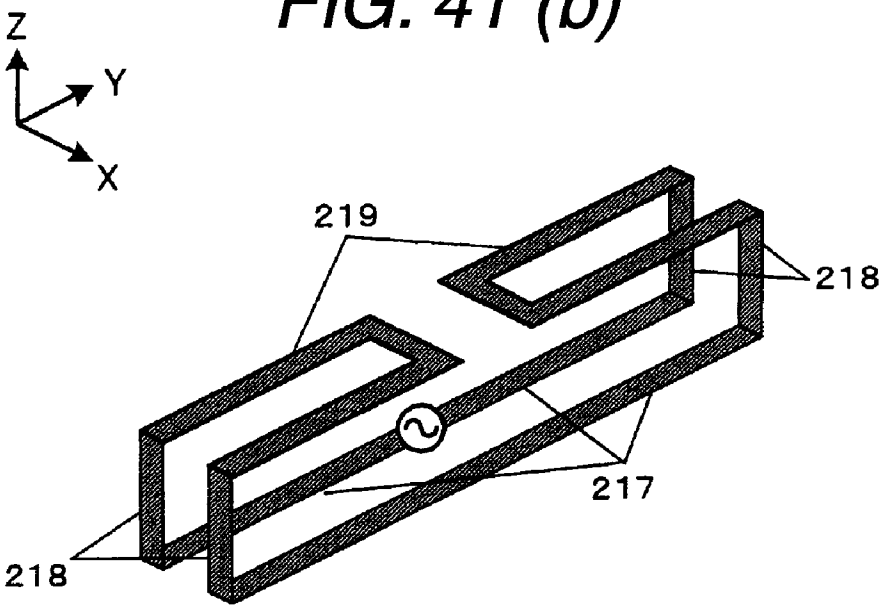
FIGS. 41(*a*) and (*b*) shows a view showing an example configuration of a radiating element having structures folded within a Y−Z plane in the directivity switching antenna according to the ninth embodiment of the present invention.
Figure 41:
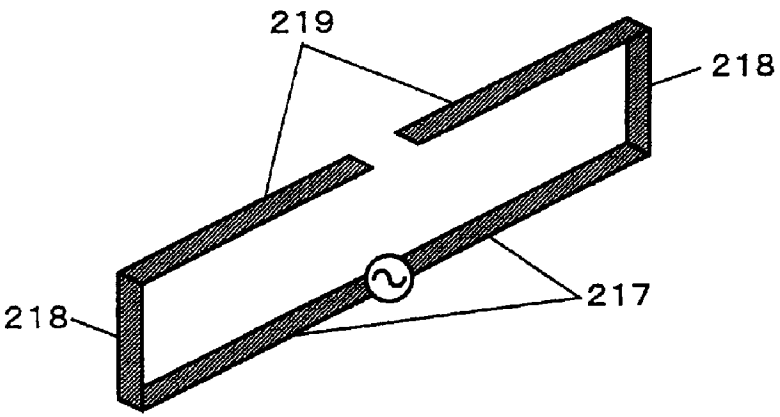
Figure 42:
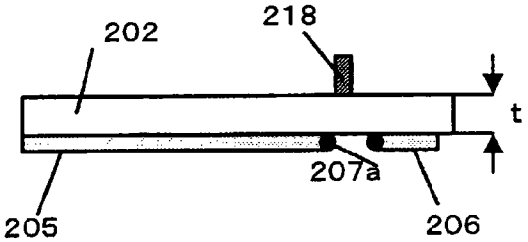
FIGS. 42(*a*) and (*b*) shows a schematic view showing the directivity switching antenna, according to the ninth embodiment of the present invention, which uses a radiating element having structures folded within a Y−Z plane.
Figure 42:
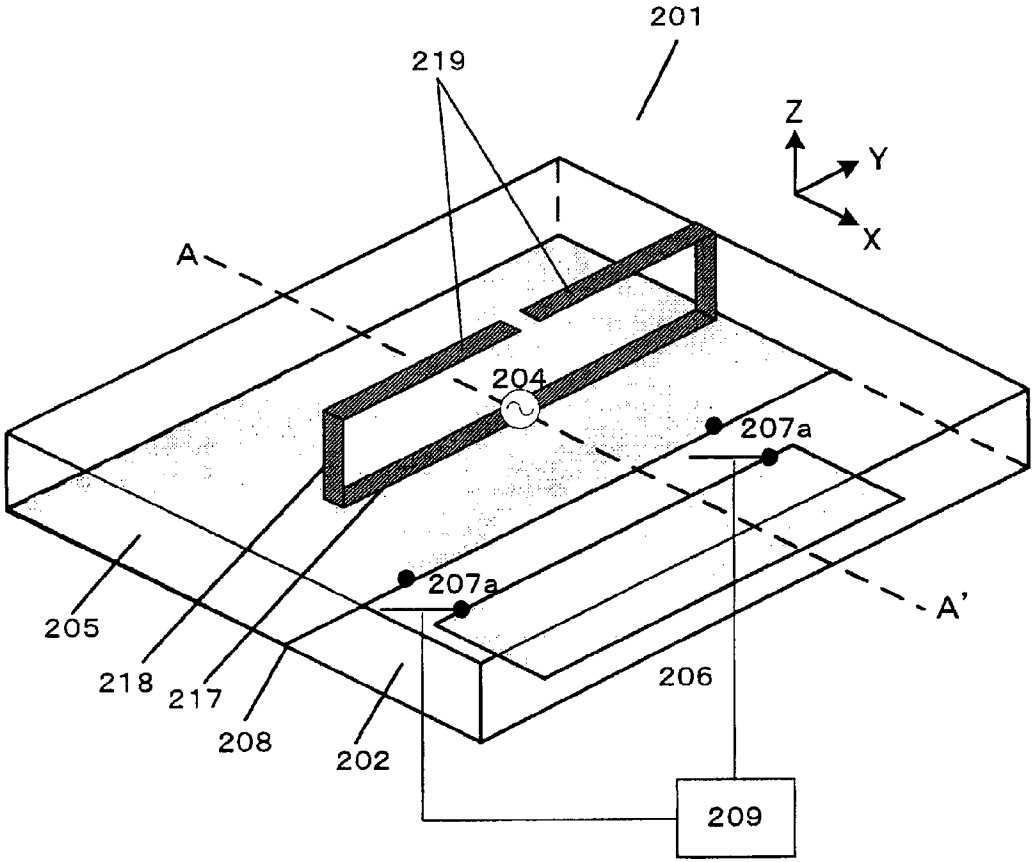

A method for manufacturing an antenna folded within a YZ plane as shown in FIGS. 41(*a*), (*b*) will now be described. As shown in FIG. 42, a method for manufacturing an antenna in the simplest manner is to manufacture an antenna by sheeting. At this time, a lower conductor 217, a folded section 218, and an upper conductor 219, all of which constitute a radiating element, may be integrally formed by means of sheeting. Alternatively, the lower conductor 217 may have been formed beforehand on the dielectric substrate 202 from a conductor pattern, and only the folded section 218 and the upper conductor 219 formed by means of sheeting.

Figure 43:
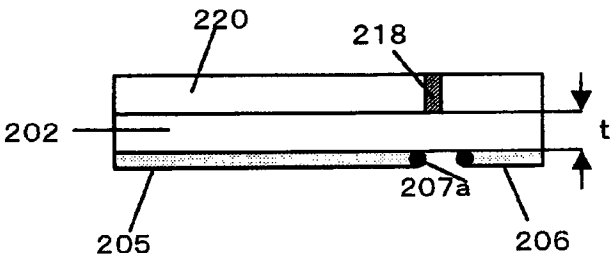
FIGS. 43(*a*) and (*b*) shows a schematic view of the directivity switching antenna using a dielectric substrate of multilayer structure according to the ninth embodiment of the present invention.
Figure 43:
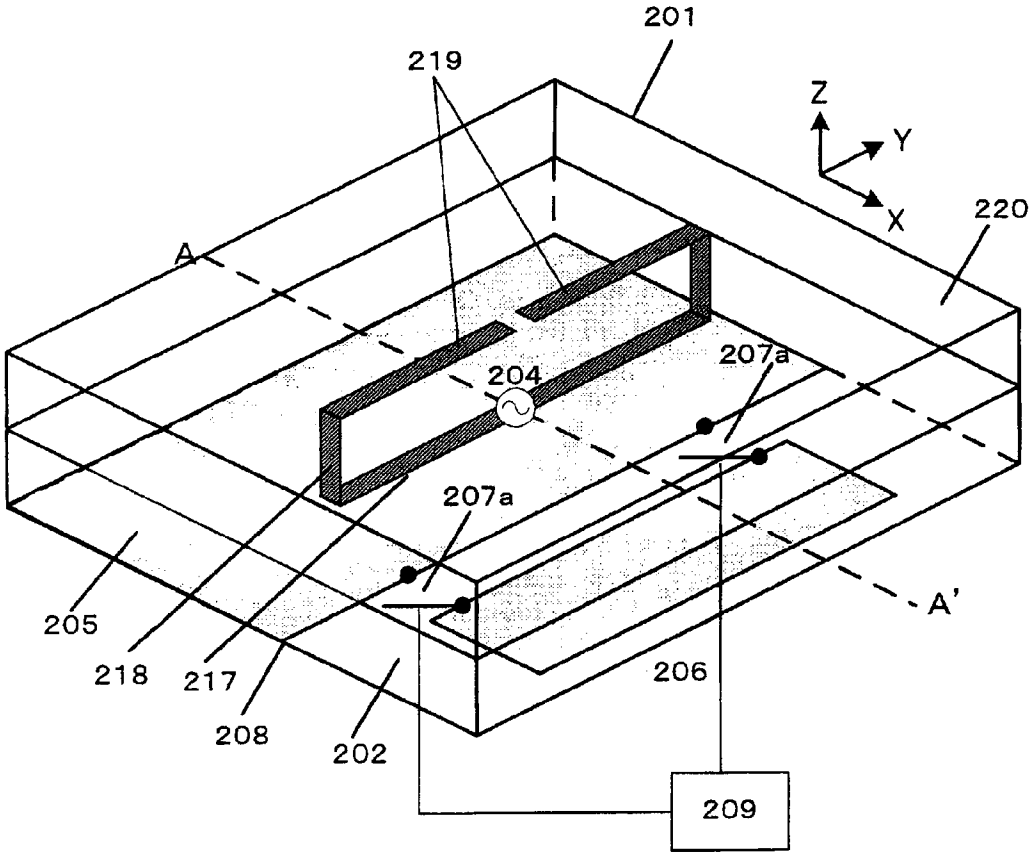

In addition to sheeting, as shown in FIG. 43, another manufacturing method may also be adopted; for instance, placing a second dielectric substrate 220 on the dielectric substrate 202; forming the lower conductor 217 from a planer conductor pattern sandwiched between the dielectric substrates 202, 220; forming the upper conductor 219 from the conductor pattern on a surface of the second dielectric substrate 220 opposite the surface thereof that faces the dielectric substrate 202; forming the folded section 218 from a through hole, or the like, passing through the second dielectric substrate 220; and electrically connecting the lower conductor 217 to the upper conductor 219.

Figure 44:
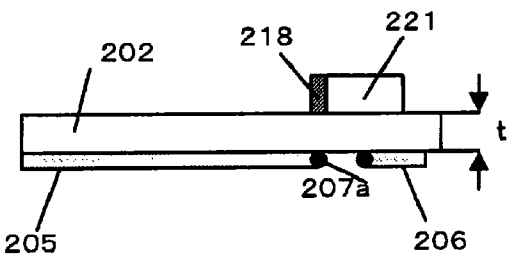
FIGS. 44(*a*) and (*b*) shows a schematic view of the directivity switching antenna using a dielectric block according to the ninth embodiment of the present invention.
Figure 44:
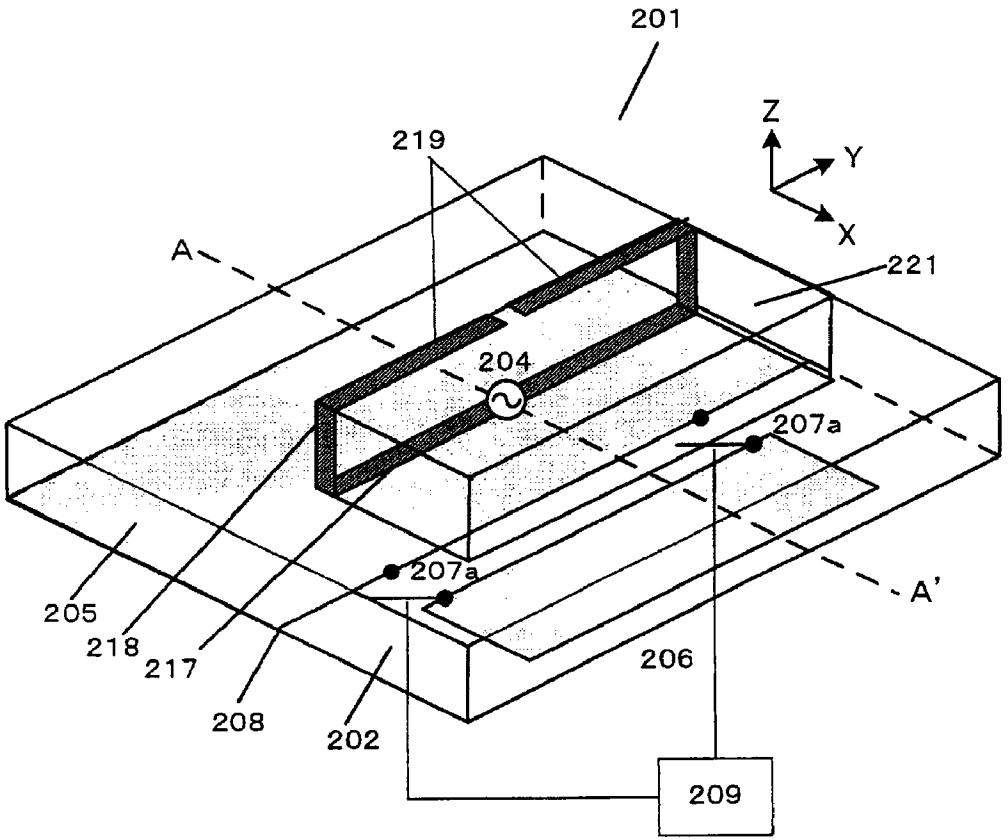

By means of adoption of such a configuration, the directivity switching antenna apparatus can be manufactured through use of a multilayer substrate. As shown in FIG. 44, each of the lower conductor 217, the folded section 218, and the upper conductor 219 may be formed from a pattern on a dielectric block 221 made of a highly-dielectric material such as ceramic or the like. By means of the configuration, the antenna apparatus can be miniaturized to a great extent.

TENTH EMBODIMENT

Figure 45:
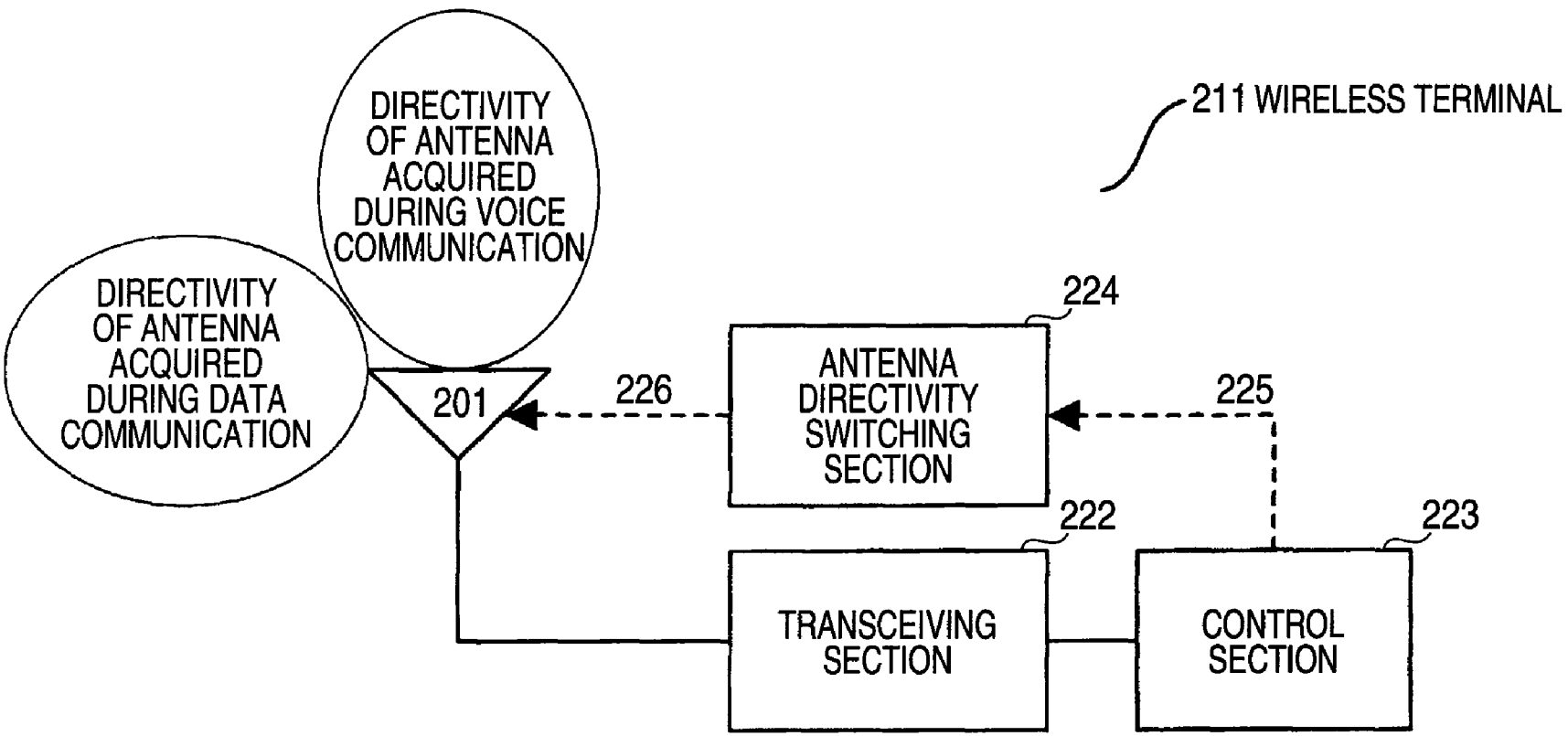
FIG. 45 is a schematic view of a wireless terminal according to a tenth embodiment of the present invention.
Figure 46:
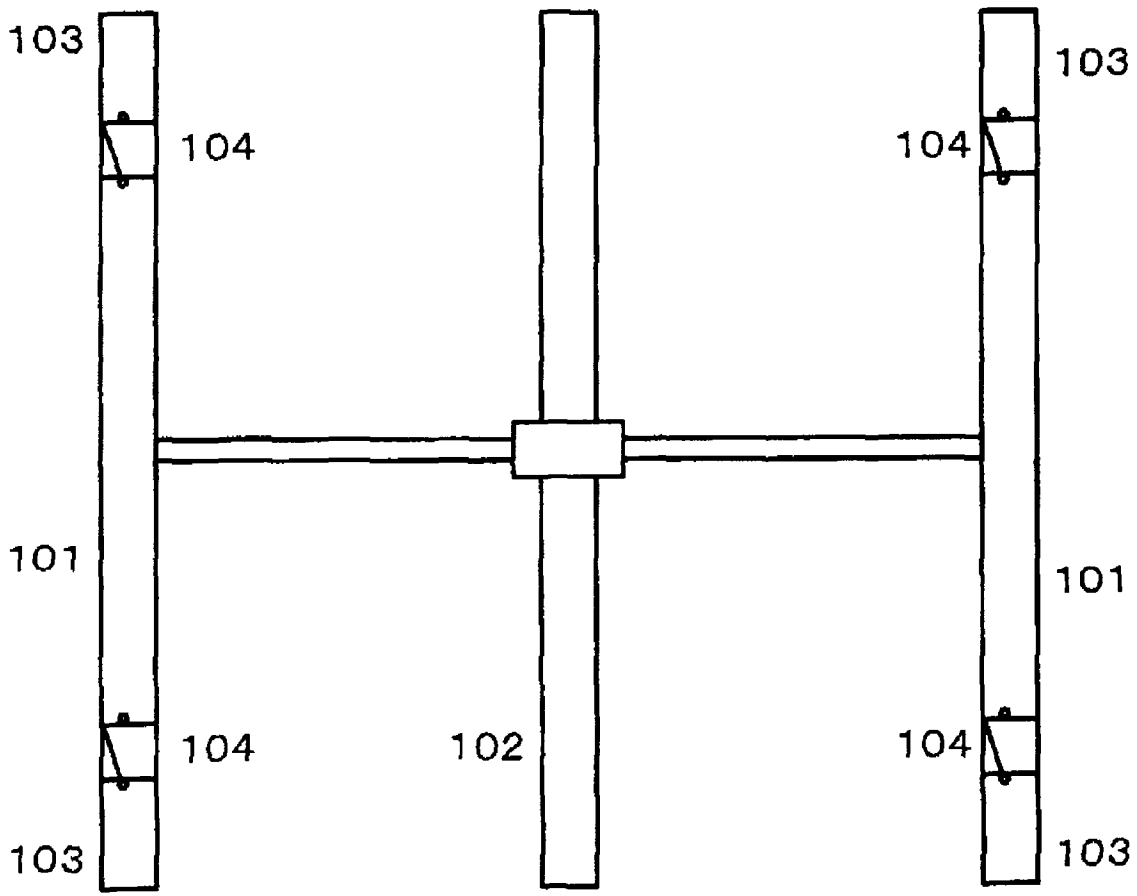
FIG. 46 is a schematic view of a related-art directivity switching antenna of Patent Document 1.
Figure 47:
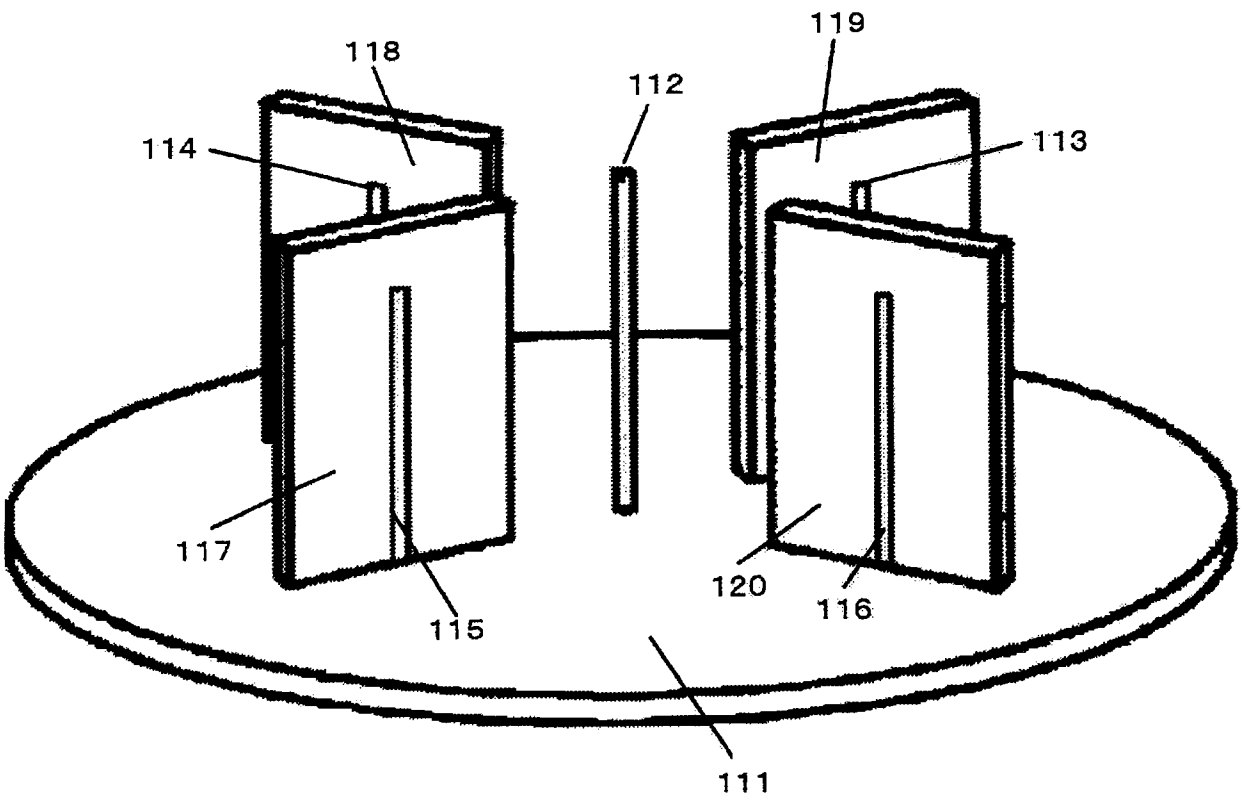
FIG. 47 is a schematic view of a related-art directivity switching antenna of Patent Document 2.
Figure 48:
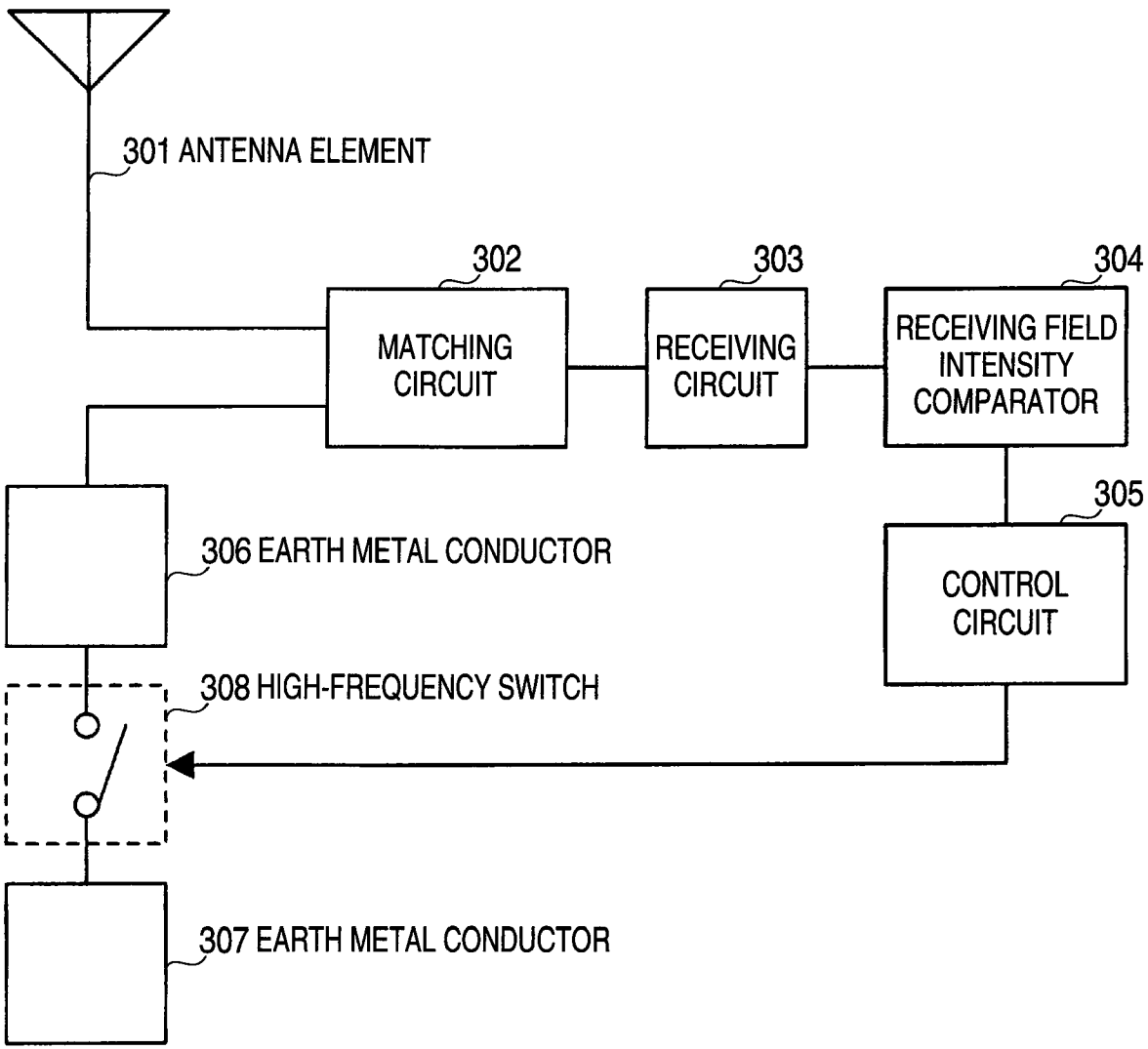
FIG. 48 is a schematic view of a related-art directivity switching antenna of Patent Document 3.
Figure 49:
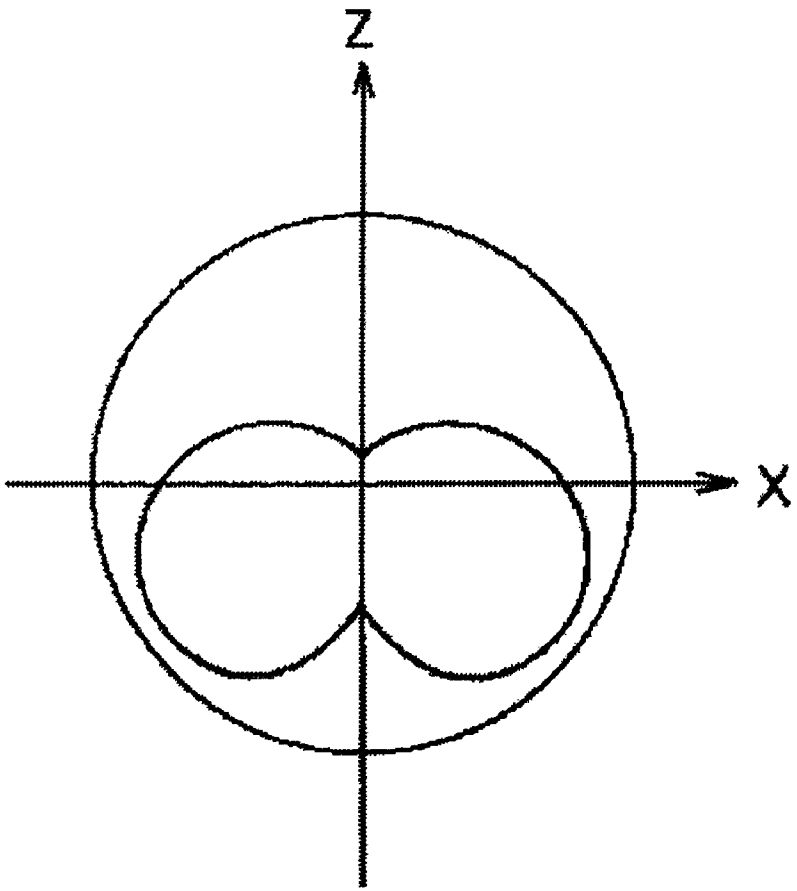
FIGS. 49(*a*) and (*b*) shows the directivity of the related-art directivity switching antenna of Patent Document 3.
Figure 49:
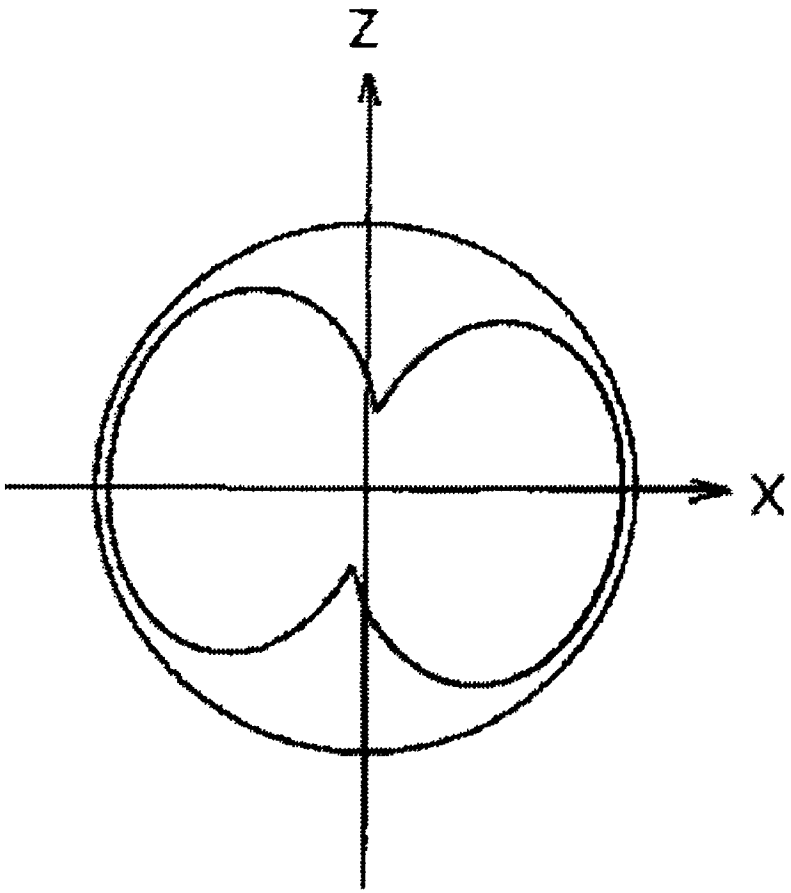
Figure 50:
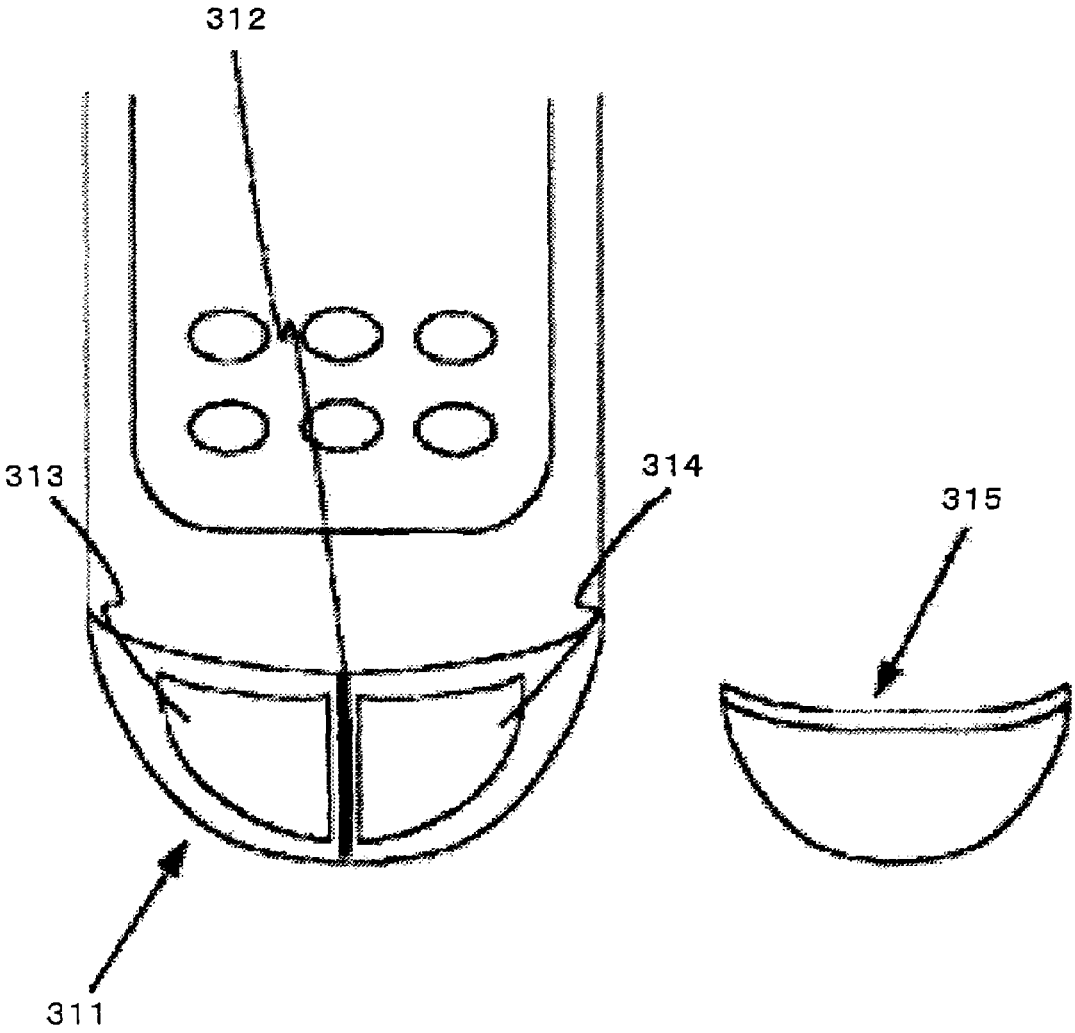
FIG. 50 is a schematic view of a related-art directivity switching antenna of Patent Document 4.
Figure 51:
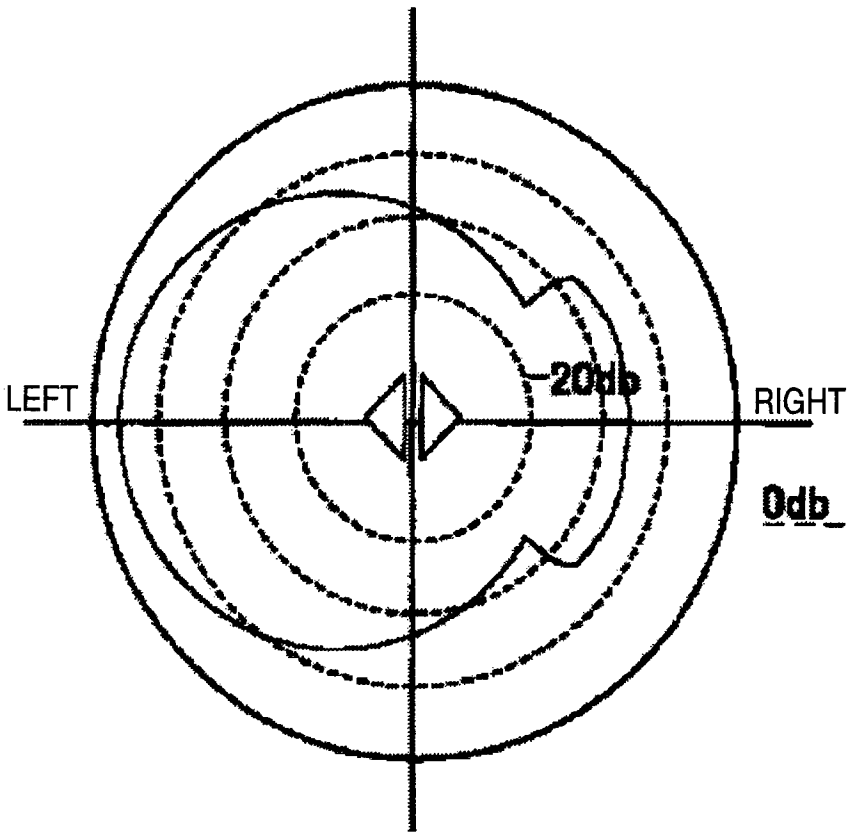
FIGS. 51(*a*) and (*b*) shows the directivity of the related-art directivity switching antenna of Patent Document 4.
Figure 51:
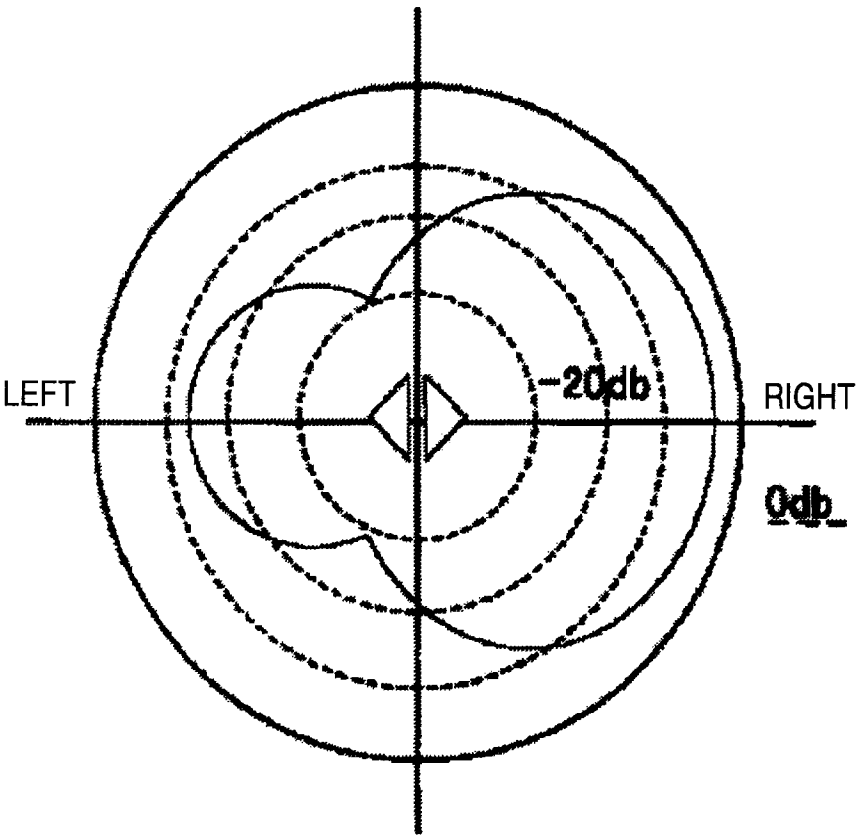

FIG. 45 is a diagrammatic representation of a wireless terminal according to a tenth embodiment of the present invention. In FIG. 45, the wireless terminal comprises a transceiving section 222 set to frequency bands used for data communication and voice conversation; a control section 223; and an antenna directivity switching section 224.

Operation of the wireless terminal according to the tenth embodiment of the present invention will now be described. For instance, when the wireless terminal is used indoors, a multipath environment is presumed to arise for reasons of obstacles such as walls. Under such circumstances, the antenna can address the multipath environment by means of diversity receiving operation. Common diversity receiving operation is achieved by means of placing a plurality of antennas in a spatially-separated manner. However, use of the plurality of antennas results in an increase in the area required to mount the antenna, as well as a necessity for an area required to mount an antenna switch, because the antenna switch is used for selecting any one of the plurality of antennas.

By use of the directivity switching antennas described in connection with the sixth through ninth embodiments, directional diversity receiving can be effected while the area required to mount the antenna is maintained to that required to mount a single antenna. Detailed descriptions are given in this regard.

In FIG. 45, the wireless terminal 211 is formed from the directivity switching antenna 201, the transceiving section 222, the control section 223, and the antenna directivity switching section 224. With such a configuration, during receiving operation, the high-frequency signal received by the directivity switching antenna 201 is subjected to frequency conversion and demodulation in the transceiving section 222, and the thus-converted demodulated signal is transmitted to the control section 223. At this time, the control section 223 monitors received power gained as a result of the directivity of the directivity switching antenna 201 having been switched, and a control signal 225 is sent to the antenna directivity switching section 224 such that the directivity of the antenna, at which the greatest received pattern is attained, is acquired.

On the basis of the control signal 225 output from the control section 223, the antenna directivity switching section 224 determines directivity at which superior receiving sensitivity is achieved; and transmits a control signal 226 in order to switch the directivity of the directivity switching antenna 201 such that superior receiving sensitivity is achieved. By means of the control signal 226, the directivity switching antenna 201 is switched so as to acquire desired directivity. In the meantime, during transmission operation, the signal transmitted from the control section 223 is subjected to modulation and frequency conversion at the transceiving section 222, and the thus-modulated converted signal is transmitted from the directivity switching antenna 201. At this time, the directivity selected during receiving operation is used as the directivity of the directivity switching antenna 201.

As above, the wireless terminal is formed from the directivity switching antenna 201, the transceiving section 222, the control section 223, and the antenna directivity switching section 224. Diversity receiving can be performed by a single antenna, and therefore there is yielded the advantage of the ability to implement a compact, high-performance wireless terminal.

The present embodiment has described that, during transmission operation, the directivity switching antenna 201 is used at the same directivity as that employed during receiving operation. However, the present invention is not limited to this embodiment. During receiving operation, diversity receiving is performed by use of the directivity switching antenna 201. During transmission, the radiation field originating from the directivity switching antenna may be set so as not to propagate toward the user 210 who uses the wireless terminal 211. For example, there may be adopted a configuration of: fixing the directional maximum emission direction of the directivity switching antenna 201 in the backward direction of the wireless terminal 211 during voice conversation; and fixing, at the time of transmission, the directional maximum emission direction of the directivity switching antenna 201 in the zenith direction of the wireless terminal 211 during data communication.

The present embodiment has described the wireless terminal 211 using the directivity switching antennas 201 described in connection with the sixth through ninth embodiments. However, the present invention is not limited to the embodiments.

An antenna apparatus of any configuration may be used, so long as the directivity of the antenna can be switched between the zenith direction (i.e., the horizontal direction with respect to the display surface of the display section 212 and the upward direction with reference to displayed messages) and the backward direction (the direction opposite the display surface of the display section 212) through about 90°.

The present invention has been described in detail by reference to the specific embodiments. However, it is obvious to those skilled in the art that the present invention can be subjected to various alterations or modifications without departing from the spirit and scope of the present invention.

The present invention claims priority to Japanese Patent Application (No. 2004-290063) filed on Oct. 1, 2004 and Japanese Patent Application (No. 2004-290143) filed on Oct. 1, 2004, which are incorporated herein by reference in their entireties.

INDUSTRIAL APPLICABILITY

The antenna apparatus of the present invention and the wireless terminal using the antenna apparatus yield the advantage of the ability to switch the directivity of the antenna between the backward direction and the zenith direction by means of short-circuiting and opening the switches. The antenna apparatus is useful as an antenna which enables high-quality communication when applied to a wireless terminal to be employed in various usage patterns such as voice conversation and data communication. Further, the present invention is also useful for use with an information terminal, such as a wireless terminal or a PC, which requires diversity receiving operation.

The antenna apparatus of the present invention and the terminal using the antenna apparatus yield the advantage of the ability to switch the directivity of the antenna in three directions by means of short-circuiting and opening the switches. The antenna apparatus is useful as an antenna which enables high-quality communication even in the case of receipt of a terrestrial digital broadcast for a vehicle-mounted device.

The invention claimed is:

1. An antenna apparatus comprising:

a linear radiating element placed on a first plane;

a first parasitic element placed on the first plane in parallel to the radiating element;

a first ground conductor placed on the first plane;

a first switch which connects both ends of the first parasitic element to the first ground conductor;

a second ground conductor placed on a second plane opposing the first plane; and a control unit which controls short-circuiting/opening of the switch, wherein a part of the first ground conductor is placed in parallel to the radiating element and on a side opposite the first parasitic element with the radiating element sandwiched therebetween, and wherein the second ground conductor is placed opposite the radiating element, and ends of the second ground conductor oppose an area sandwiched between the radiating element and the first parasitic element.

2. An antenna apparatus comprising:

a linear radiating element placed on a first plane;

a first linear parasitic element placed on the first plane in parallel to the radiating element;

a linear auxiliary element provided at both ends of the first parasitic element;

a first ground conductor placed on the first plane;

a first switch which connects both ends of the first parasitic element to the auxiliary element;

a second ground conductor placed on a second plane opposing the first plane; and a control unit which controls short-circuiting/opening of the switch, wherein the first ground conductor is placed in parallel to the radiating element and on a side opposite the first parasitic element with the radiating element sandwiched therebetween, and wherein the second ground conductor is placed opposite the radiating element, and ends of the second ground conductor oppose an area sandwiched between the radiating element and the first parasitic element.

3. An antenna apparatus comprising:

a linear radiating element placed on a first plane;

a first parasitic element placed on the first plane in parallel to the radiating element;

a second linear parasitic element which is provided on the first plane opposite the first parasitic element with the radiating element interposed therebetween, and in parallel to the radiating element;

a linear auxiliary element provided at both ends of the respective first and second parasitic elements;

a first switch and a second switch which connect both ends of the first and second parasitic elements to the auxiliary elements provided on both sides of the respective first and second parasitic elements;

a second ground conductor placed on a second plane opposing the first plane; and a control unit which controls short-circuiting/opening of the switch, wherein the second ground conductor is placed opposite the radiating element, and one end of the second ground conductor opposes an area sandwiched between the radiating element and the first parasitic element, and the other end of the second ground conductor opposes an area sandwiched between the radiating element and the second parasitic element.

4. The antenna apparatus according to claim 3, further comprising a first substrate on which the first and second planes are provided.

5. The antenna apparatus according to claim 4, wherein the radiating element and the second ground conductor are arranged such that a spacing between the radiating element and the second ground conductor becomes greater than the thickness of the first substrate.

6. The antenna apparatus according to claim 4, wherein the radiating element has a dipole configuration having a structure folded in a vertical direction with respect to the substrate, and wherein the radiating element comprises:

a lower conductor placed on the first substrate;

folded sections placed on both ends of the lower conductor in an upright position with respect to the first substrate; and an upper conductor disposed for connecting ends of the folded ends.

7. The antenna apparatus according to claim 6, further comprising:

a second substrate provided on the first substrate, wherein the lower conductor is interposed between the first and second substrates, wherein the folded section is provided so as to penetrate through the second substrate, and wherein the upper conductor is provided on the second substrate.

8. The antenna apparatus according to claim 6, further comprising:

a dielectric block on the first substrate, wherein the lower conductor, the folded section, and the upper conductor are provided on and/or in the dielectric block.

9. The antenna apparatus according to claim 3, wherein the parasitic element becomes a director with respect to the radiating element when the switch is opened.

10. The antenna apparatus according to claim 3, wherein the parasitic element and the auxiliary element act as reflectors with respect to the radiating element when the switches are short-circuited.

11. The antenna apparatus according to claim 3, wherein reactance of the parasitic element is variable.

12. A wireless terminal comprising:

the antenna apparatus according to claim 3;

a transceiving section for transceiving a radio wave by means of the antenna apparatus;

an antenna directivity switching section for switching directivity of the antenna apparatus; and a control section for controlling individual sections, wherein the control section controls the antenna directivity switching section and the transceiving section such that the antenna apparatus, whose directivity has been determined to exhibit superior receiving sensitivity on the basis of the intensity of a detected radio wave, performs transmission and receipt by causing the antenna directivity switching section to switch directivity of the antenna apparatus and causing the transceiving section to receive a radio wave.

13. The wireless terminal according to claim 12, wherein the control section performs control operation for causing the antenna apparatus to perform diversity receiving operation in a receiving state and causing the antenna apparatus, in a transmission state, to perform transmission with the directivity used in a receiving state.

14. The wireless terminal according to claim 12, wherein the control section performs control operation for causing the antenna apparatus to perform diversity receiving operation in a receiving state and causing the antenna apparatus, in a transmission state, to perform transmission with directivity at which a maximum radiation direction of the antenna apparatus is oriented in a direction opposite a direction from the wireless terminal toward a user of the wireless terminal.

15. An antenna apparatus comprising:

a first substrate;

a linear radiating element placed on a first plane which is one surface of the first substrate;

a ground conductor placed on a second plane which is the other surface of the first substrate;

a first conductor which is placed, in parallel to the radiating element, on the second plane while being electrically isolated from the ground conductor;

a first switch for connecting the ground conductor to the conductor; and a control unit which controls short-circuiting/opening of the switch, wherein one of the ground conductor and the conductor is placed opposite the radiating element.

16. The antenna apparatus according to claim 15, further comprising:

a second conductor placed at a position symmetrical to the first conductor with respect to the ground conductor; and a second switch for connecting the ground conductor to the second conductor, wherein the ground conductor is placed opposite the radiating element.

17. The antenna apparatus according to claim 15, wherein reactance of the conductor is variable.

18. The antenna apparatus according to claim 15, wherein the conductor comprises:

a plurality of conductor pieces divided into a widthwise direction thereof; and a third switch for connecting the plurality of conductor pieces.

19. The antenna apparatus according to claim 15, wherein the first switch comprises a plurality of switches for connecting the ground conductor to the metal conductor at a plurality of locations.

20. The antenna apparatus according to claim 19, wherein the third switch connects the ground conductor and the metal conductor, which are provided at positions opposite the vicinity of a maximum voltage position on the radiating element.

* * * * *

UNITED STATES PATENT AND TRADEMARK OFFICE

CERTIFICATE OF CORRECTION

PATENT NO. : 7,602,340 B2
APPLICATION NO. : 11/574894
DATED : October 13, 2009
INVENTOR(S) : Junji Sato It is certified that error appears in the above-identified patent and that said Letters Patent is hereby corrected as shown below:

Column 3, line 25, please replace -An other- with "Another",

Column 20, line 18, please insert the number --5-- after the word "ductor" and before the word "and", Column 29, line 18, please delete the spacing between the word "director." and before the word "Conversely", Column 39, line 33, please delete the spacing between the word "communication." and before the word "The".

Signed and Sealed this

Twenty-sixth Day of January, 2010

David J. Kappos

David J. Kappos
*Director of the United States Patent and Trademark Office*